US006708011B2

(12) United States Patent
Nomura et al.

(10) Patent No.: US 6,708,011 B2
(45) Date of Patent: Mar. 16, 2004

(54) SYSTEM FOR FORMING COLOR IMAGES

(75) Inventors: Yujiro Nomura, Nagano-Ken (JP); Nobumasa Abe, Nagano-Ken (JP); Kaneo Yoda, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/187,787

(22) Filed: Jul. 3, 2002

(65) Prior Publication Data

US 2003/0053819 A1 Mar. 20, 2003

(30) Foreign Application Priority Data

| | | |
|---|---|---|
| Jul. 5, 2001 | (JP) | 2001-204361 |
| Jul. 27, 2001 | (JP) | 2001-227814 |
| Aug. 31, 2001 | (JP) | 2001-262907 |
| Sep. 28, 2001 | (JP) | 2001-299753 |

(51) Int. Cl.[7] ..... G03G 15/01; G03G 21/18

(52) U.S. Cl. ..... 399/110; 399/112; 399/113; 399/299; 399/302

(58) Field of Search ..... 399/110, 111, 399/112, 113, 118, 119, 299, 302

(56) References Cited

U.S. PATENT DOCUMENTS

| | | | | |
|---|---|---|---|---|
| 5,282,012 A | * | 1/1994 | Terada et al. | 399/112 |
| 5,442,421 A | * | 8/1995 | Kojima | 399/112 |
| 5,444,515 A | * | 8/1995 | Haneda et al. | 399/112 |
| 5,541,720 A | * | 7/1996 | Haneda | 399/119 X |
| 5,758,232 A | * | 5/1998 | Ikunami | 399/111 |
| 6,101,349 A | * | 8/2000 | Ohashi et al. | 399/110 |
| 6,484,003 B2 | * | 11/2002 | Tokutake et al. | 399/110 |
| 6,498,915 B2 | * | 12/2002 | Yamaguchi et al. | 399/110 |
| 2002/0044791 A1 | * | 4/2002 | Shinkai et al. | 399/112 |

FOREIGN PATENT DOCUMENTS

| | | |
|---|---|---|
| JP | 62-141574 | 6/1987 |
| JP | 3-238467 | 10/1991 |
| JP | 9-160471 | 6/1997 |
| JP | 9-304994 | 11/1997 |
| JP | 11-174772 | 7/1999 |
| JP | 2001-356549 | * 12/2001 |
| JP | 2002-108050 | * 4/2002 |

* cited by examiner

*Primary Examiner*—Sophia S. Chen
(74) *Attorney, Agent, or Firm*—Sughrue Mion, PLLC

(57) ABSTRACT

A tandem system for the formation of color images having a plurality of image carriers integrated into a single cartridge and developing devices designed to be detachable from or attachable thereto, thereby improving the integrity of maintenance and cutting back on running costs. At least two image formation stations are provided, each having an image carrier, a charger, a developing device and a primary transfer roller disposed therearound. A transfer medium is passed through the image formation stations to form color images in a tandem fashion. A plurality of image carriers are disposed with respect to an image carrier cartridge, which is detachable from and attachable to the system proper while they are mutually positioned. A developing device is provided with respect to each image carrier attached to the image carrier cartridge in a detachable/attachable manner.

58 Claims, 57 Drawing Sheets

SYSTEM FOR FORMING COLOR IMAGES

BACKGROUND OF THE INVENTION

The present invention relates generally to a system for forming color images, and more particularly to a tandem type color image formation system wherein a plurality of photosensitive members are designed in a single cartridge unit form for detachment/attachment purposes, thereby improving the integrity of maintenance.

Generally, toner image formation means for electrophotography comprises a photosensitive member acting as an image carrier having a photosensitive layer on its outer surface, charger means for uniformly charging the outer surface of the photosensitive member, exposure means for subjecting the outer surface of that member uniformly charged by the charger means to selective exposure to form an electrostatic latent image and developing means for imparting toner that is a developing agent to the electrostatic latent image formed by the exposure means to make a visible (toner) image.

The tandem system for forming color images known in the art are broken down into two types, one called the intermediate transfer belt type wherein a plurality of (e.g., four) such toner image formation means as mentioned above are provided with respect to an intermediate transfer belt (that is one example of the transfer belt) and toner images formed by these monochromatic toner image formation means on photosensitive members are successively transferred on the intermediate transfer belt so that the toner images of different colors (e.g., yellow, cyan, magenta and black) are superposed on the intermediate transfer belt, thereby obtaining a full-color image thereon, and another called the delivery belt type wherein a recording medium (e.g., a recording sheet) is carried and delivered onto a recording medium carrier belt (that is another example of the transfer belt) and toner images formed by a plurality of different monochromatic image formation means are successively transferred on the recording medium, so that the toner images of different colors are superposed on the recording medium, thereby obtaining a full-color image thereon.

For instance, one such conventional tandem image formation system is disclosed in JP-A 62-141574. This system is constructed of a plurality of joinable units, each comprising a plurality of developing and other processing means, so that the joined units are attachable to or detachable from the system proper. The system is economically advantageous because the units are individually designed as being attachable or detachable, so that a dead cartridge(s) alone can be replaced by new one.

JP-A 03-238467 describes an image formation system wherein a plurality of process units, each comprising developing means and an image carrier, are supported on one single support plate. All the process units are removed from the system at a time, and so the integrity of maintenance of the system is improved.

JP-A 09-160471 shows that process units except one for black are integrated together for easy replacement, so that the frequency of replacement of a process portion can be reduced, making control of consumable parts easy.

JP-A 09-304994 shows that a plurality of image carriers are integrally supported. In the examples, such image carriers inclusive of developing means are integrated together, so that the precision of positions of the image carriers in the system proper can be improved, resulting in elimination of color misalignments, improvements in the integrity of maintenance, and no risk of anything wrong upon insertion of the image cartridges.

JP-A 11-174772 shows that a support member is provided to locate both ends of each image formation member at a given position, thereby minimizing position misalignments of each image formation member.

In general image formation systems wherein toner is imparted from developing means to electrostatic latent images on image carriers to render the latent images visible, the service life of the image carriers differs largely from that of the developing means. Especially in the case of an image formation system using a mono-component developing agent, it is necessary to engage a control blade with a developing roller under high loads, thereby controlling the thickness of a developing agent thin layer on the developing roller. Then, the developing roller and control blade wear away due to friction between both, inevitably resulting in their service life becoming shorter than that of the image carriers. Thus, a problem with a conventional system wherein image carriers and developing means are replaced at the same time is that running costs increase because the service life of the system is governed by the developing means and so there is a need of replacing the image carriers even when they are still of avail. In particular, recently developed image carriers are being shifted to the "cleanerless" type wherein the service life of image carriers is increased because of the absence of any material that wears off the image carriers. There is thus an especially large difference in service life between the image carriers and developing means, leading to growing demands for replacement of only the developing means.

In the tandem type comprising a plurality of image carriers, the precision of color matching is largely depending on the position and shape of the image carriers. When the image carriers are replaced, color matching operation is needed after replacement, because it is difficult to keep the position and shape of the image carriers in perfect alignment between before and after replacement. Referring here to the aforesaid prior art wherein the image carriers are replaced along with the developing means, frequent color matching operations are needed, resulting in a problem that the efficiency of operation becomes low.

In a tandem system for the formation of images, the precision of color matching is largely dependent on the positions of the image carriers on which latent images are to be written. In the aforesaid prior art, write means are mounted on the system proper, and when the image carriers are replaced, there are displacements of latent images written on the image carriers, which give rise to color misalignments and cause image quality to deteriorate.

Furthermore in the tandem for forming images, the precision of color matching is considerably dependent on the precision of transfer positions on the image carriers. In the aforesaid prior art, when the image carriers are replaced, there are displacements of toner images transferred from the image carriers onto a transfer member (an intermediate transfer belt or recording medium), resulting in color misalignments and deterioration of image quality.

SUMMARY OF THE INVENTION

In view of such problems with the prior art as mentioned above, an object of the present invention is to provide a tandem system for the formation of color images wherein a plurality of image carriers are integrated into a single cartridge and developing means for each image carrier is designed to be detachable from or attachable to the cartridge, thereby improving the integrity of maintenance and cutting back on running costs.

Another object of the present invention is to provide a tandem system for the formation of color images wherein a plurality of image carriers and write means are integrated into a single cartridge and developing means for each image carrier is designed to be detachable from or attachable to the cartridge, thereby improving the integrity of maintenance, cutting back on running costs, and reducing color misalignments.

Yet another object of the present invention is to provide a tandem system for the formation of color images wherein a plurality of image carriers and an intermediate transfer belt are integrated into a single cartridge and developing means for each image carrier is designed to be detachable from or attachable to the cartridge, thereby improving the integrity of maintenance, cutting back on running costs, and improving the precision of transfer positions to reduce color misalignments.

A further object of the present invention is to provide a tandem system for the formation of color images wherein a plurality of image carriers and a recording medium carrier belt are integrated into a single cartridge and developing means for each image carrier is designed to be detachable from or attachable to the cartridge, thereby improving the integrity of maintenance, cutting back on running costs, and improving the precision of transfer positions to reduce color misalignments.

According to the first aspect of the present invention, the aforesaid objects are achievable by the provision of a tandem system for forming color images comprising at least two image formation stations, each comprising an image carrier, and charging means, developing means and transfer means disposed around said image carrier, wherein a color image is formed by passing a transfer medium through each station, characterized in that:

- a plurality of image carrier are mounted on an image carrier cartridge detachable from or attachable to a system proper while they are mutually positioned, and
- developing means is provided in such a way as to be detachable from or attachable to each image carrier mounted on said image carrier cartridge.

The color image formation system according to the first aspect of the invention is suitable for the case where a developing agent in the developing means comprises a mono-component developing agent.

Thus, a plurality of image carriers are integrally mounted on the image carrier cartridge while they are mutually positioned. In this case, a plurality of developing cartridges, each forming developing means for each of the plurality of image carriers, may be disposed with respect to the image carrier cartridge in a separately detachable/attachable manner. Alternatively, a developing cartridge, wherein all developing means for the plurality of image carriers may be integrated into one piece, may be disposed with respect to the image carrier cartridge in a detachable/attachable manner. Still alternatively, two developing cartridges may be disposed with respect to the image carrier cartridge in a separately detachable/attachable manner, wherein in one of said two developing cartridges there is developing means for one specific image carrier in the plurality of image carriers, and in another of said two developing cartridges all developing means for the remaining image carriers are integrated together.

Preferably in this aspect of the invention, the driving forces for the plurality of image carriers and the developing means for each of the plurality of image carriers are received at one site on the system proper and the driving force for the plurality of image carriers is divided in the image carrier cartridge and then transmitted to the developing means.

In this case, the mutual transmission of driving force between the plurality of image carriers takes place via a gear train, a belt or a chain.

Alternatively, the driving force for the plurality of image carriers may be received from one driving source of the system proper and the driving force for developing means for each of the plurality of image carriers may be received from another driving source of the system proper.

Preferably, the color image formation system according to the first aspect of the invention comprises a mechanism for adjusting color misalignments by regulating the position of at least one image carrier in the image carrier cartridge relative to other image carriers therein.

It is acceptable that around each image carrier in the image carrier cartridge there is no cleaning means for collecting the remnants of the developing agent in an independent manner.

According to the second aspect of the present invention, there is provided a tandem system for forming color images comprising at least two image formation stations, each comprising an image carrier, and charging means, write means, developing means and transfer means disposed around said image carrier, wherein a color image is formed by passing a transfer medium through each station, characterized in that:

- a plurality of image carriers are mounted on an image carrier cartridge detachable from or attachable to a system proper while they are mutually positioned,
- developing means is provided in such a way as to be detachable from or attachable to each image carrier mounted on said image carrier cartridge, and
- write means is located and mounted at a position corresponding to each of said plurality of image carriers in said image carrier cartridge.

The color image formation system according to the second aspect of the invention is suitable for the case where the developing agent in the developing means comprises a mono-component developing agent.

Thus, a plurality of image carriers are integrally mounted on the image carrier cartridge while they are mutually positioned. In this case, a plurality of developing cartridges, each forming developing means for each of the plurality of image carriers, may be disposed with respect to the image carrier cartridge in a separately detachable/attachable manner. Alternatively, a developing cartridge, wherein all developing means for the plurality of image carriers are integrated into one piece, may be disposed with respect to the image carrier cartridge in a detachable/attachable manner. Yet alternatively, two developing cartridges may be disposed with respect to the image carrier cartridge in a separately detachable/attachable manner, wherein in one of the two developing cartridges there is developing means for one specific image carrier in the plurality of image carriers, and in another of the two developing cartridges all developing means for the remaining image carriers are integrated together.

Preferably in the second aspect of the invention, the driving forces for the plurality of image carriers and the developing means for each of the plurality of image carriers are received at one site on the system proper and the driving force for the plurality of image carrier is divided in the image carrier cartridge and then transmitted to the developing means.

In that case, the mutual transmission of driving force between the plurality of image carriers takes place via a gear train, a belt or a chain.

In accordance with the second aspect of the invention, it is acceptable that the driving force for the plurality of image carriers is received from one driving source of the system proper and the driving force for developing means for each of the plurality of image carriers is received from another driving source of the system proper.

Preferably, the color image formation system according to the second aspect of the invention comprises a mechanism for adjusting the position of at least one image carrier in the image carrier cartridge relative to other image carriers therein, thereby adjusting color misalignments.

It is preferable that the write means is constructed as a line head for performing line writing on each of the image carriers.

It is also acceptable that around each image carrier in the image carrier cartridge there is no cleaning means for collecting the remnants of the developing agent in an independent manner.

According to the third aspect of the present invention, there is provided a tandem system for forming color images comprising at least two image formation stations, each comprising an image carrier, and charging means, developing means and transfer means disposed around said image carrier, wherein a color image is formed by passing a transfer medium through each station, characterized in that:

a plurality of image carriers are mounted on an image carrier cartridge detachable from or attachable to a system proper while they are mutually positioned, and an intermediate transfer belt is provided contiguously to said plurality of image carriers, and developing means is provided in such a way as to be detachable from or attachable to each image carrier mounted on said image carrier cartridge.

The color image formation system according to this aspect of the invention is suitable for the case where the developing agent in the developing means comprises a mono-component developing agent.

Thus, a plurality of image carriers are integrally mounted on the image carrier cartridge while they are mutually positioned. In this case, a plurality of developing cartridges, each forming developing means for each of the plurality of image carriers, may be disposed with respect to the image carrier cartridge in a separately detachable/attachable manner. Alternatively, a developing cartridge, wherein all developing means for said plurality of image carriers are integrated into one piece, may be disposed with respect to the image carrier cartridge in a detachable/attachable manner. Yet alternatively, two developing cartridges may be disposed with respect to the image carrier cartridge in a separately detachable/attachable manner, wherein in one of the two developing cartridges there is developing means for one specific image carrier in the plurality of image carriers, and in another of the two developing cartridges all developing means for the remaining image carriers are integrated together.

Preferably in the third aspect of the invention, the driving forces for the plurality of image carriers, the developing means for each of the plurality of image carriers and the intermediate transfer belt are received at one site on the system proper and the driving force for the plurality of image carriers is divided in the image carrier cartridge and then transmitted to the developing means.

Preferably in that case, the mutual transmission of driving force between the plurality of image carriers takes place via a gear train, a belt or a chain.

It is acceptable that the driving forces for the plurality of image carriers and the intermediate transfer belt are received from one driving source of the system proper and the driving force for developing means for each of the plurality of image carriers is received from another driving source of the system proper.

Preferably in the third aspect of the invention, there is a speed difference between the peripheral speed of the plurality of image carriers and the delivery speed of the intermediate transfer belt.

Preferably in that case, the color image formation system comprises a mechanism for adjusting the transfer position at which the intermediate transfer belt comes into contact with the plurality of image carriers, thereby adjusting color misalignments.

The color image formation system according to the third aspect of the invention may also comprise a mechanism for adjusting the position of at least one image carrier in the image carrier cartridge relative to other image carriers therein, thereby adjusting color misalignments.

It is also acceptable that the write means is located and mounted at the position corresponding to each of the plurality of image carriers in the image carrier cartridge.

Preferably, the color image formation system of the third aspect comprises a mechanism for adjusting the position of at least one write means mounted on the image carrier cartridge, thereby adjusting color misalignments.

It is also preferable that the write means is constructed as a line head for performing line writing on each of the image carriers.

It is also acceptable that around each image carrier in said image carrier cartridge there is no cleaning means for collecting the remnants of the developing agent in an independent manner.

According to the fourth aspect of the present invention, there is provided a tandem system for forming color images comprising at least two image formation stations, each comprising an image carrier, and charging means, developing means and transfer means disposed around said image carrier, wherein a color image is formed by passing a transfer medium through each station, characterized in that:

a plurality of image carriers are mounted on an image carrier cartridge detachable from or attachable to a system proper while they are mutually positioned, and a recording medium carrier belt is provided contiguously to said plurality of image carriers, and developing means is provided in such a way as to be detachable from or attachable to each image carrier mounted on said image carrier cartridge.

The color image formation system according to the fourth aspect of the invention is suitable for the case where the developing agent in said developing means comprises a mono-component developing agent.

Thus, a plurality of image carriers are integrally mounted on the image carrier cartridge while they are mutually positioned. In this case, a plurality of developing cartridges, each forming developing means for each of the plurality of image carriers, may be disposed with respect to the image carrier cartridge in a separately detachable/attachable manner. Alternatively, a developing cartridge, wherein all developing means for the plurality of image carriers are integrated into one piece, may be disposed with respect to the said image carrier cartridge in a detachable/attachable manner.

Yet alternatively, two developing cartridges may be disposed with respect to said image carrier cartridge in a separately detachable/attachable manner, wherein in one of the two developing cartridges there is developing means for one specific image carrier in the plurality of image carriers, and in another of the two developing cartridges all developing means for the remaining image carriers are integrated together.

Preferably in the third aspect of the invention, the driving forces for the plurality of image carriers, the developing means for each of said plurality of image carriers and the recording medium carrier belt are received at one site on the system proper and the driving force for the plurality of image carriers is divided in the image carrier cartridge and then transmitted to the developing means.

Preferably in that case, the mutual transmission of driving force between the plurality of image carriers takes place via a gear train, a belt or a chain.

It is acceptable that the driving forces for the plurality of image carriers and the recording medium carrier belt are received from one driving source of the system proper and the driving force for developing means for each of the plurality of image carriers is received from another driving source of the system proper.

Preferably in the fourth aspect of the invention, there is a speed difference between the peripheral speed of the plurality of image carriers and the delivery speed of the recording medium carrier belt.

Preferably in that case, there is provided a mechanism for adjusting the transfer position at which the recording medium carrier belt comes into contact with the plurality of image carriers, thereby adjusting color misalignments.

Preferably, there is also provided a mechanism for adjusting the position of at least one image carrier in the image carrier cartridge relative to other image carriers therein, thereby adjusting color misalignments.

It is acceptable that the write means is located and mounted at a position corresponding to each of the plurality of image carriers in the image carrier cartridge.

Preferably in that case, there is provided a mechanism for adjusting the position of at least one write means mounted on the image carrier cartridge, thereby adjusting color misalignments.

It is also preferable that the write means is constructed as a line head for performing line writing on each of the image carriers.

It is also acceptable that around each image carrier in the image carrier cartridge there is no cleaning means for collecting the remnants of the developing agent in an independent manner.

As described above, the first aspect of the present invention provides a system for forming color images, wherein a plurality of image carriers are mounted on an image carrier cartridge detachable from or attachable to a system proper while they are mutually positioned, and developing means is provided in such a way as to be detachable from or attachable to each image carrier mounted on said image carrier cartridge. Thus, the precision of relative positions of the image carriers is so improved that any misalignments ascribable to position and parallelism misalignments of the image carriers can be prevented. Since a plurality of image carriers can be replaced at the same time, the integrity of maintenance of the system can be improved. The developing means and the image carrier cartridge can be independently replaced so that running cost reductions are achievable because even when used-up developing means are replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

The second aspect of the present invention provides a system for forming color images, wherein a plurality of image carriers are mounted on an image carrier cartridge detachable from or attachable to a system proper while they are mutually positioned, developing means is provided in such a way as to be detachable from or attachable to each image carrier mounted on said image carrier cartridge, and write means are located and mounted at positions of said image carrier cartridge corresponding to a plurality of image carriers. Thus, the precision of relative positions of the image carriers and write means is so improved that any misalignments ascribable to position and parallelism misalignments of the image carriers and write means can be prevented. Since a plurality of image carriers can be replaced at the same time, the integrity of maintenance of the system can be improved. The developing means and the image carrier cartridge can be independently replaced so that running cost reductions are achievable because even when used-up developing means are replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

The third aspect of the present invention provides a system for forming color images, wherein a plurality of image carriers are mounted on an image carrier cartridge detachable from or attachable to a system proper, an intermediate transfer belt is mounted contiguously to said plurality of image carriers, and developing means is provided in such a way as to be detachable from or attachable to each image carrier mounted on said image carrier cartridge. Thus, the precision of relative positions of the image carriers, and the precision of transfer positions is so improved that any misalignments ascribable to position and parallelism misalignments of the image carriers and transfer position misalignments can be prevented. Since a plurality of image carriers can be replaced at the same time, the integrity of maintenance of the system can be improved. The developing means and the image carrier cartridge can be independently replaced so that running cost reductions are achievable because even when used-up developing means are replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

The fourth aspect of the present invention provides a system for forming color images, wherein a plurality of image carriers are mounted on an image carrier cartridge detachable from or attachable to a system proper while they are mutually positioned, and developing means is provided in such a way as to be detachable from or attachable to each image carrier mounted on said image carrier cartridge. Thus, the precision of relative positions of the image carriers is so improved that any misalignments ascribable to position and parallelism misalignments of the image carriers can be prevented. Since a plurality of image carriers can be replaced at the same time, the integrity of maintenance of the system can be improved. The developing means and the image carrier cartridge can be independently replaced so that running cost reductions are achievable because even when used-up developing means are replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

Still other objects and advantages of the invention will in part be obvious and will in part be apparent form the specification.

The invention accordingly comprises the features of construction, combinations of elements, and arrangement of parts which will be exemplified in the construction hereinafter set forth, and the scope of the invention will be indicated in the claims]

DESCRIPTION OF THE PREFERRED EMBODIMENTS

The color image formation system according to the first aspect of the present invention is now explained with reference to its embodiments.

Figure 1:
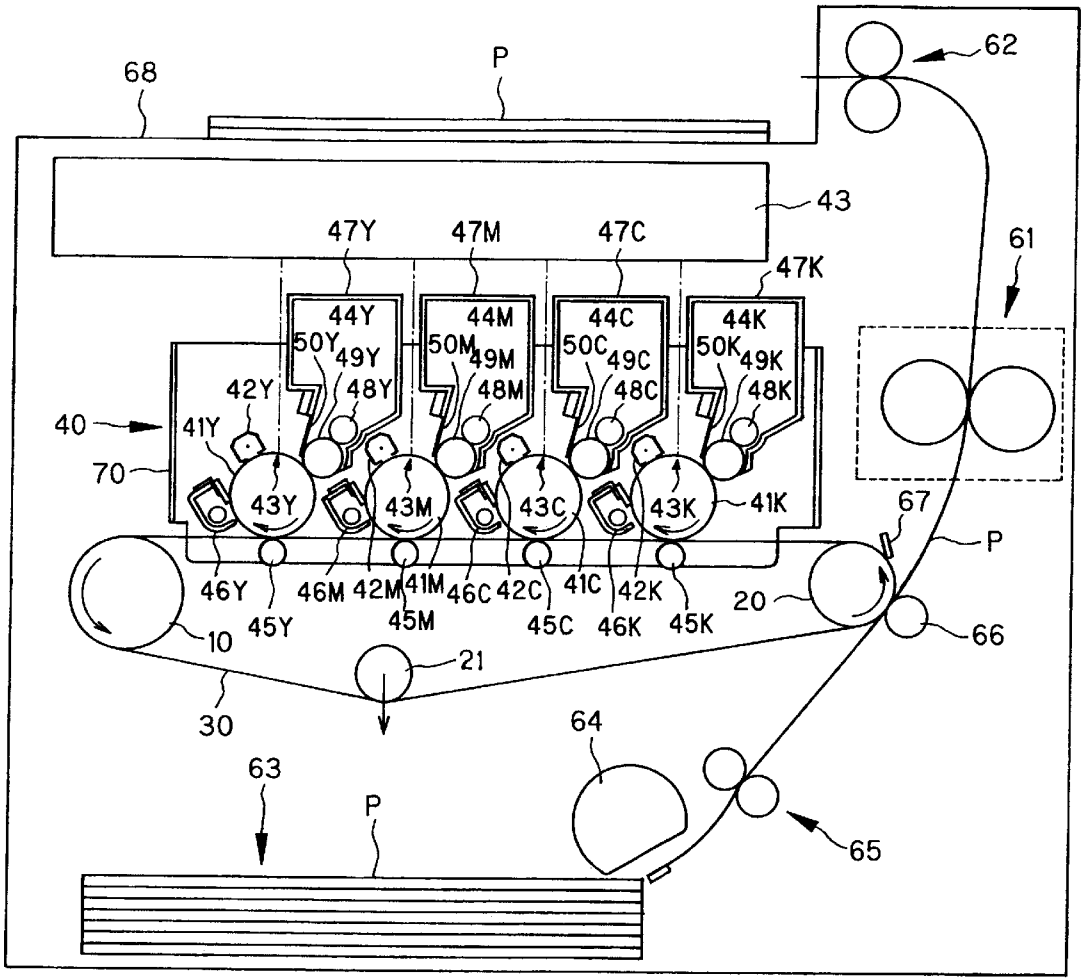
FIG. 1 is a front schematic illustrative of the whole construction of one example of the color image formation system to which the invention is applied.

FIG. 1 is a front schematic illustrative of the whole construction of one embodiment of the color image formation system to which the invention is applied. As shown in FIG. 1, this image formation system comprises an intermediate transfer belt 30 that is spanned in place with tensions applied thereon by a driving roller 10, a follower roller 20 and a tension roller 21, and driven endlessly in the (counterclockwise) direction shown by an arrow. Four photosensitive members (drums) 41K, 41C, 41M and 41Y having photosensitive layers on their outer surfaces, i.e., image carriers, are arranged at a given interval with respect to the intermediate transfer belt 30. The capital letters K, C, M and Y added to the numeral reference mean black, cyan, magenta and yellow, indicating the photosensitive members for black, cyan, magenta and yellow, respectively. The same holds true for other members. The photosensitive members 41K, 41C, 41M and 41Y are rotationally driven in synchronism with the intermediate transfer belt 30 in the (clockwise) direction indicated by an arrow. Around each photosensitive member 41 (K, C, M, Y), there is located a corona charger 42 (K, C, M, Y) comprising Scorotron acting as means for uniformly charging the outer surface of the photosensitive member 41 (K, C, M, Y), an exposure site 43 (K, C, M, Y) for selectively exposing the outer surface of the member 41 (K, C, M, Y) uniformly charged by the corona charger 42 (K, C, M, Y) to exposure light from an exposure unit 43 for each color, thereby forming an electrostatic latent image, a developing device 44 (K, C, M, Y) for imparting a developing agent that is a toner to the electrostatic latent image formed at this exposure site 43 (K, C, M, Y) to make a visible (toner) image, a primary transfer roller 45 (K, C, M, Y) for successively transferring toner images developed at this developing device 44 (K, C, M, Y) onto the intermediate transfer belt 30 for primary transfer purposes, and a cleaning device 46 (K, C, M, Y) working as cleaning means for removing the remnants of toner on the surface of the photosensitive member 41 (K, C, M, Y) after transfer.

Figure 4:
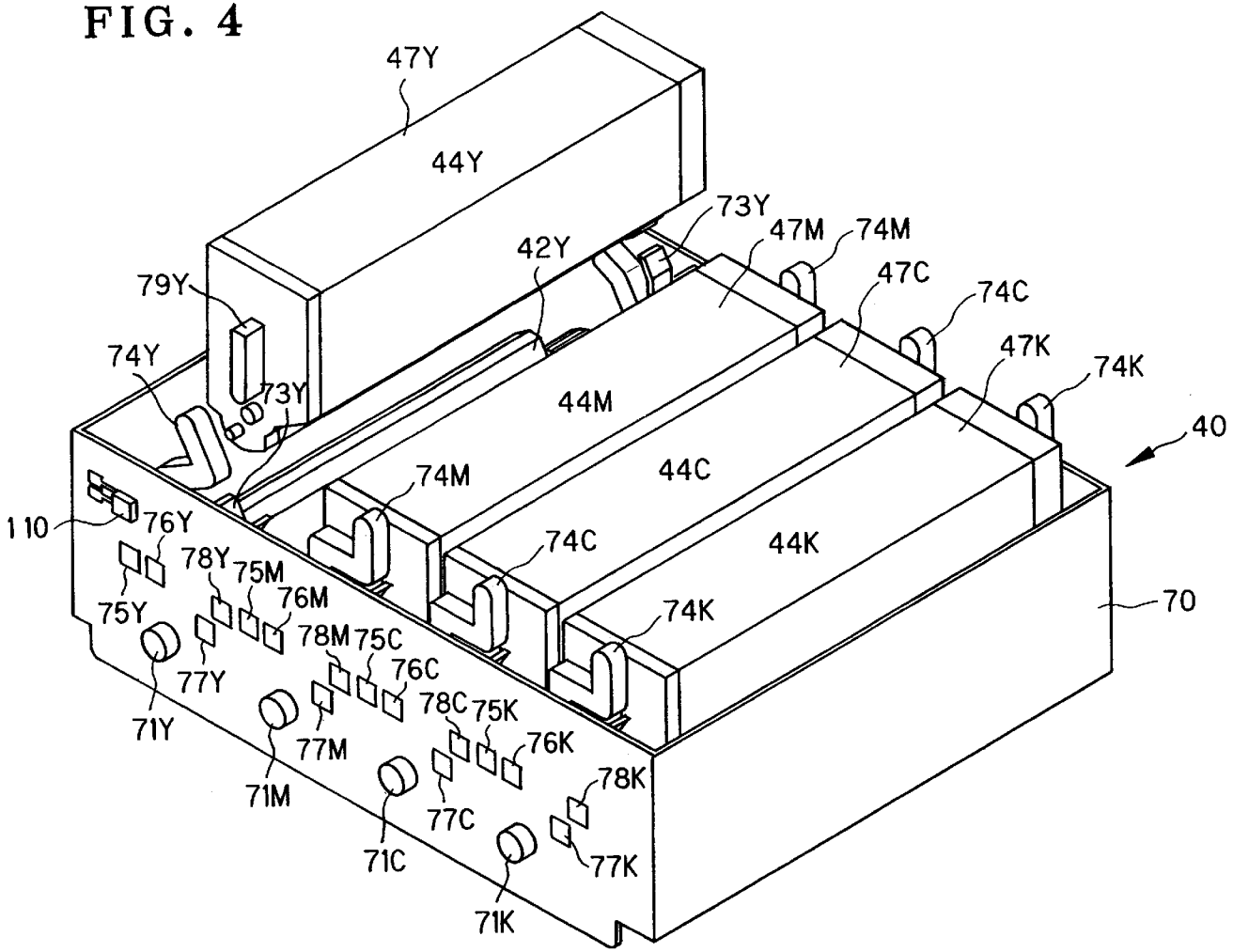
FIG. 4 is a perspective view illustrative of how one of a plurality of developing devices is detached from or attached to the photosensitive member cartridge with the rest remaining mounted thereon.

Typically using a non-magnetic mono-component toner as the developing agent, the developing device 44 (K, C, M, Y) is constructed in the form of a developing cartridge 47 (K, C, M, Y) (see FIG. 4). Such a mono-component toner stored in the cartridge 47 is delivered to a developing roller 49 (K, C, M, Y) by way of a feed roller 48 (K, C, M, Y). The thickness of a developing agent film deposited onto the surface of the developing roller 49 (K, C, M, Y) is controlled by a control blade 50 (K, C, M, Y). Then, the developing roller 49 (K, C, M, Y) is brought into contact or engagement with the photosensitive member 41 (K, C, M, Y) so that the developing agent is deposited onto the photosensitive member 41 (K, C, M, Y) depending on the potential level of the photosensitive member, thereby developing the latent image in the form of a toner image.

The black, cyan, magenta and yellow toner images formed at four such monochromatic toner image-formation stations are successively primary transferred onto the intermediate transfer belt 30 by primary transfer biases applied on the primary transfer rollers 45 (K, C, M, Y), so that they are superposed successively one upon another on the intermediate transfer belt 30, yielding a full-color toner image. Then, the full-color toner image is secondary transferred onto a recording medium P such as a recording sheet at a secondary transfer roller 66, passing between a pair of fixing rollers 61 that are fixing means so that the toner image is fixed on the recording medium P. Finally, the recording medium is ejected by way of a pair of ejecting rollers 62 on an output tray 68 mounted on the top of the system.

In FIG. 1, it is noted that reference numeral 63 is a sheet feed cassette for storing a multiplicity of recording media P in a superposed fashion, 64 a pickup roller for feeding recording media P from the sheet feed cassette 63 one by one, 65 is a pair of gate rollers for controlling the timing of when the recording medium P is to be fed to the secondary transfer site of the secondary transfer roller 66, 66 the secondary transfer roller behaving as secondary transfer means for defining the secondary transfer site between it and the intermediate transfer belt 30, and 67 a cleaning blade working as cleaning means for removal of the remnants of toner on the surface of the intermediate transfer belt 30 after secondary transfer.

It is here noted that the reasons why the black developing device 44K is located on the uppermost stream side of the intermediate transfer belt 30 in its endless direction and the yellow developing device 44Y is positioned on the lowermost stream side are that when the toner image is transferred onto the recording medium P, black causes the most noticeable fogging whereas yellow causes the least noticeable fogging. In the case of reversal development or the like, fogging is caused by toner particles that are allowed to bear charges of polarity opposite to normal polarity at the developing device. However, black toner particles showing the most noticeable fogging are first transferred onto the intermediate transfer belt 30 as the lowermost layer. Of the black toner particles, fogging-prone toner particles remain firmly deposited onto the intermediate transfer belt 30 by means of image force or the like, so that they are less likely to be transferred onto the recording medium P at the secondary transfer site. On the other hand, toner particles that cause the least noticeable yellow fogging are deposited onto the intermediate transfer belt 30 as the uppermost layer. Although they are easily passed onto the recording medium P, yet they are less noticeable. Such an arrangement as explained above ensures that fogging is generally less noticeable because the black toner particles leading to the most noticeable fogging are relatively less likely to be passed onto the recording medium P whereas the yellow toner particles leading to the least noticeable fogging are passed onto the recording medium P with relative ease.

Since a mono-component developing agent such as a non-magnetic mono-component toner is used, there is no need of using a carrier such as a two-component developing agent. Accordingly, it is possible to reduce the volume of each developing device 44 (K, C, M, Y) and so achieve a color image formation system of small size.

Figure 2:
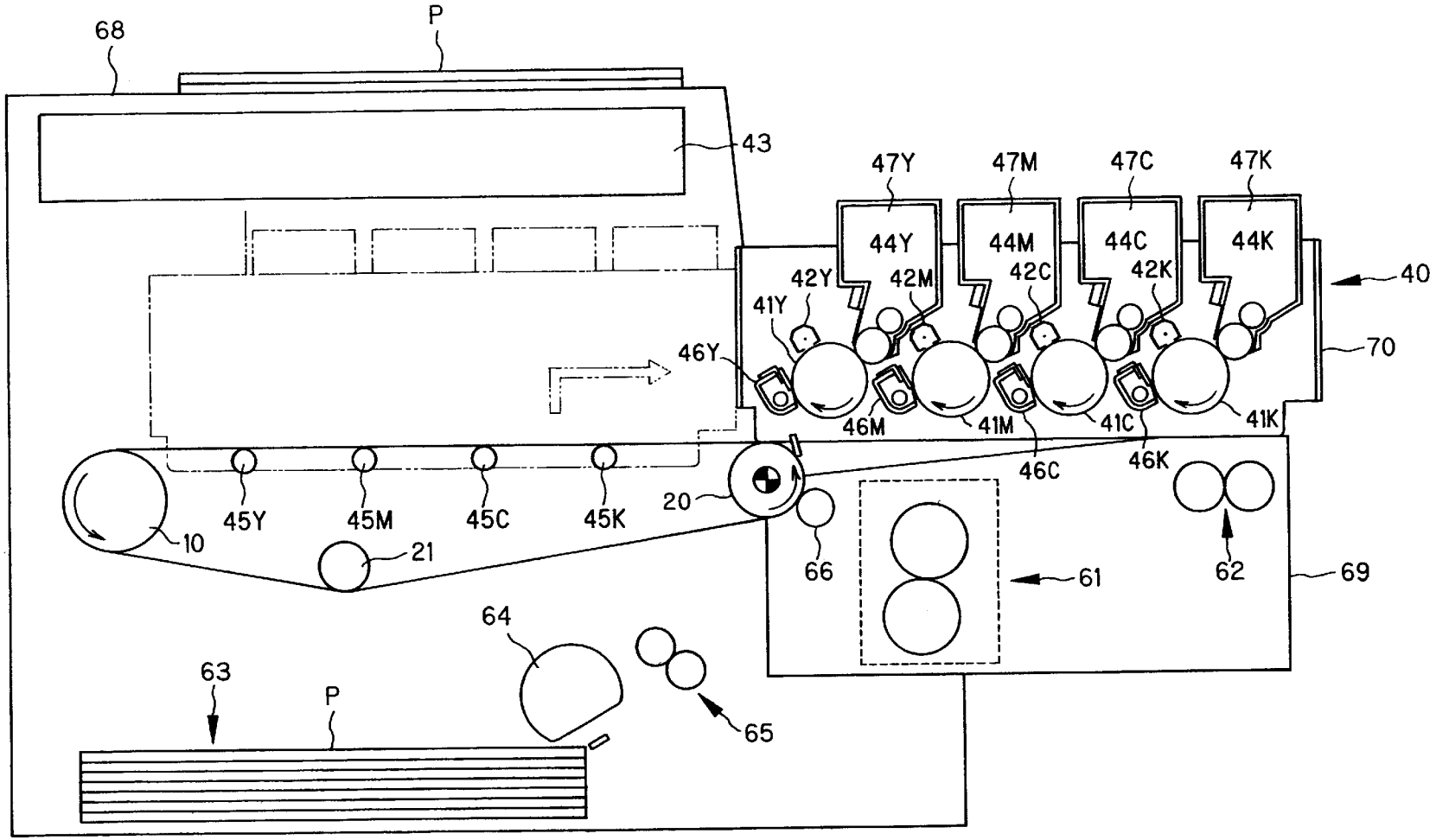
FIG. 2 is illustrative of the construction of FIG. 1 wherein photosensitive member cartridges are withdrawn out of the system proper.

In such a color image formation system as constructed as explained above according to the present invention, the four photosensitive members 41K, 41C, 41M and 41Y, each provided therearound with the corona charger 42 (K, C, M, Y) and the cleaning device 46 (K, C, M, Y), are constructed in the form of an integral photosensitive member cartridge 40 that can be detached from or attached to the system proper, as shown in FIGS. 1 and 2. In this case, the developing devices 44K, 44C, 44M and 44Y that are appendixes to the photosensitive members 41K, 41C, 41M and 41Y are detachable from and attachable to the photosensitive member cartridge 40.

Referring to FIG. 2, the photosensitive member cartridge 40 is provided on its frame 70 with the four photosensitive members 41K, 41C, 41M and 41Y and their appendixes, i.e., the corona chargers 42 (K, C, M, Y) and cleaning devices 46 (K, C, M, Y) while they are relatively positioned. To withdraw this cartridge from the system proper, it is first lifted up as shown by a double-arrow and then slid. To this end, a pair of fixing rollers 61 and a pair of ejecting rollers 62 are mounted on a side plate 69 that can turn concentrically with respect to the center of rotation of the follower roller 20. The pair of fixing rollers 61 and the pair of ejecting rollers 62 are retracted, thereby defining an opening through which the photosensitive member cartridge 40 is withdrawn out of the system. In the state where the photosensitive member cartridge 40 has been withdrawn out of the system, the photosensitive members 41 (K, C, M, Y) are spaced away from the intermediate transfer belt 30 so that the photosensitive member cartridge 40 can be detached from the system and replaced by a new photosensitive member cartridge 40.

Figure 3:
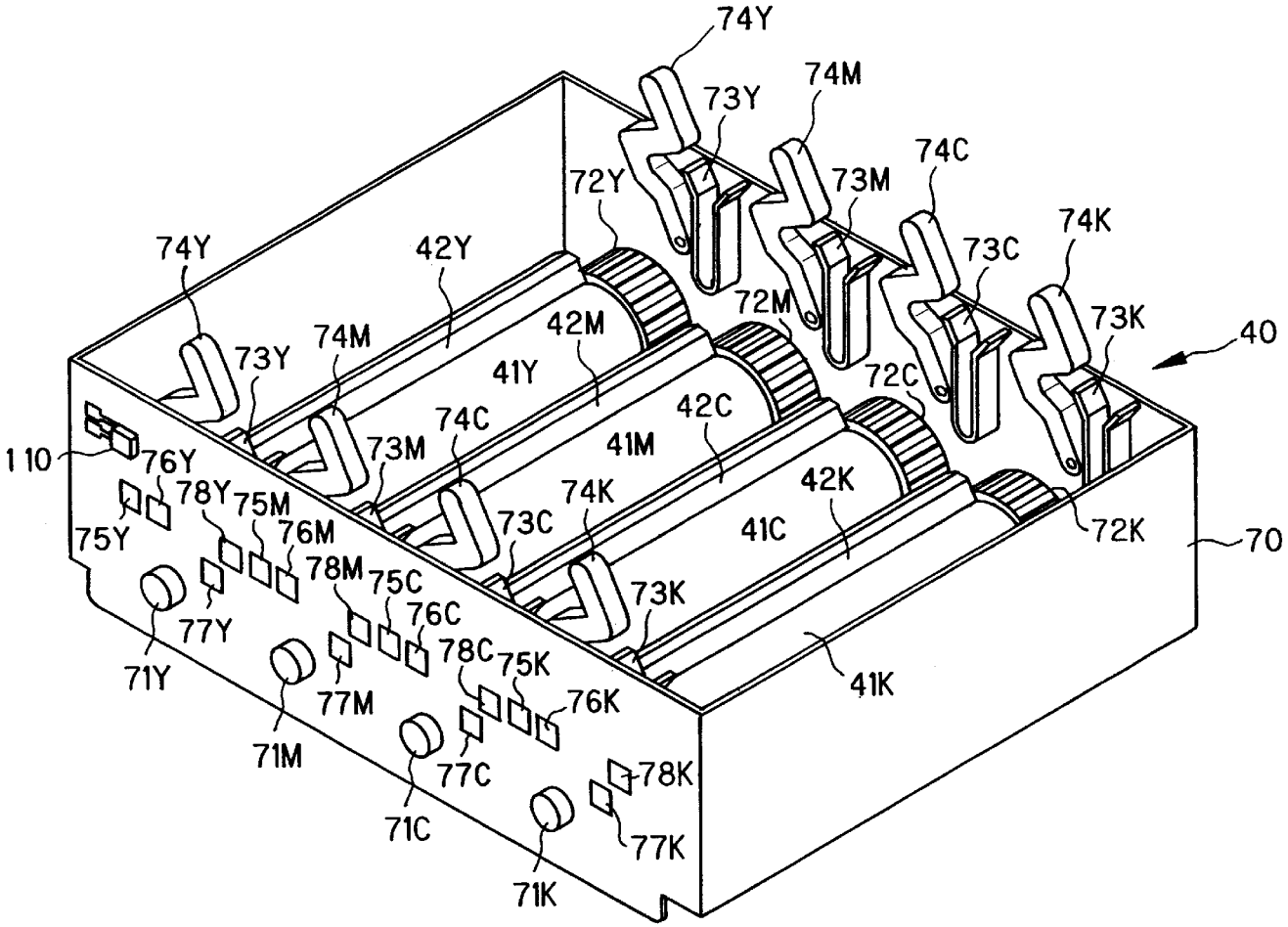
FIG. 3 is a perspective view of the photosensitive cartridge 40 from which the developing devices are removed.

FIG. 3 is a perspective view of the photosensitive cartridge 40 from which the developing devices 44K, 44C, 44M and 44Y are removed, and FIG. 4 is a perspective view illustrative of how the developing device 44Y is detached from or attached to the photosensitive member cartridge 40 with the developing devices 44K, 44C and 44M remaining mounted thereon. The frame 70 is in a rectangular box form, between both sides plates of which there are four photosensitive members 41K, 41C, 41M and 41Y that are positioned at a given interval and parallel with one another for rotation on their shafts 71K, 71C, 71M and 71Y. The shaft 71 (K, C, M, Y) of each photosensitive member 41 (K, C, M, Y) is provided at its one end with a gear 72 (K, C, M, Y). By way of the gear train to be referred to later, the photosensitive members 41 (K, C, M, Y) are rotatable in the (clockwise) direction indicated by the arrow in FIG. 1 at the same speed and in synchronism with one another.

Between the same two side plates of the frame 70, the corona chargers 42 (K, C, M, Y) and cleaning devices 46 (K, C, M, Y) (which, in FIG. 3, are invisible because of being concealed by the photosensitive members 41 (K, C, M, Y) and frame 70), all appendixes to the photosensitive members 41 (K, C, M, Y), are mounted at given positions. On one side of the side plate of the frame 70 there are provided electrodes 75 (K, C, M, Y) for applying high voltages on the discharge wires of the corona chargers or Scorotrons 42 (K, C, M, Y) and electrodes 76 (K, C, M, Y) for applying high voltages on the grits of the Scorotrons. On the same one side of the side plate of the frame 70 there are also provided electrodes 77 (K, C, M, Y) for applying developing bias voltages on the developing rollers 49 (K, C, M, Y) of the developing devices 44 (K, C, M, Y) in the state where the developing devices 44 (K, C, M, Y) are mounted on the photosensitive member cartridge 40 and electrodes 78 (K, C, M, Y) for applying developing feed bias voltages on the feed rollers 48 (K, C, M, Y) in the same state. On the same side plate, there is further provided an IC 110 as memory means for storing information about the fabrication and use of the photosensitive member cartridge 40, color misalignments, etc. Upon the photosensitive member cartridge 40 mounted on the system proper, the electrodes 75 (K, C, M, Y), electrodes 76 (K, C, M, Y), electrodes 77 (K, C, M, Y), electrodes 78 (K, C, M, Y) and IC 110 are automatically connected to the power source circuit and control circuit of the system proper. In this state, the shafts 71 (K, C, M, Y) of the photosensitive members 41 (K, C, M, Y) are also automatically connected to ground for earth purposes.

At the inner upper sides of the same two side plates of the frame 70, there are provided guide grooves 73 (K, C, M, Y) for receiving the developing devices 44 (K, C, M, Y) at constant positions corresponding to the photosensitive members 41 (K, C, M, Y). To fix the developing devices 44 (K, C, M, Y) received along the guide grooves 73 (K, C, M, Y), fixing levers 74 (K, C, M, Y) are pivotally provided. On both sides of the developing cartridge 47 (K, C, M, Y) of each developing device 44 (K, C, M, Y), there are guide ridges 79 (K, C, M, Y) that are to be inserted in the associated guide grooves 73 (K, C, M, Y) from the upper open ends thereof (see FIG. 4 where only one guide ridge 79Y of the developing cartridge 47Y is visible). To mount the developing devices 44 (K, C, M, Y) on the associated photosensitive members 41 (K, C, M, Y), the guide ridges 79 (K, C, M, Y) are inserted from above into the associated guide grooves 73 (K, C, M, Y) and the fixing levers 74 (K, C, M, Y) are then pivoted to fix the developing devices in place. To remove the developing cartridges 47 (K, C, M, Y) for replacement or other purposes, the fixing levers 74 (K, C, M, Y) are pivoted back to guide the developing cartridges 47 (K, C, M, Y) upward along the guide grooves 73 (K, C, M, Y).

According to the embodiment of FIG. 4, the developing cartridges 47 (K, C, M, Y) forming part of the individual developing devices 44 (K, C, M, Y) can separately be attached to or detached from the associated photosensitive members 41 (K, C, M, Y); of the developing devices 44 (K, C, M, Y), only an exhausted or dead developing device(s) can be replaced with no wasteful replacement of the rest, so that running cost reductions are achievable.

Figure 5:
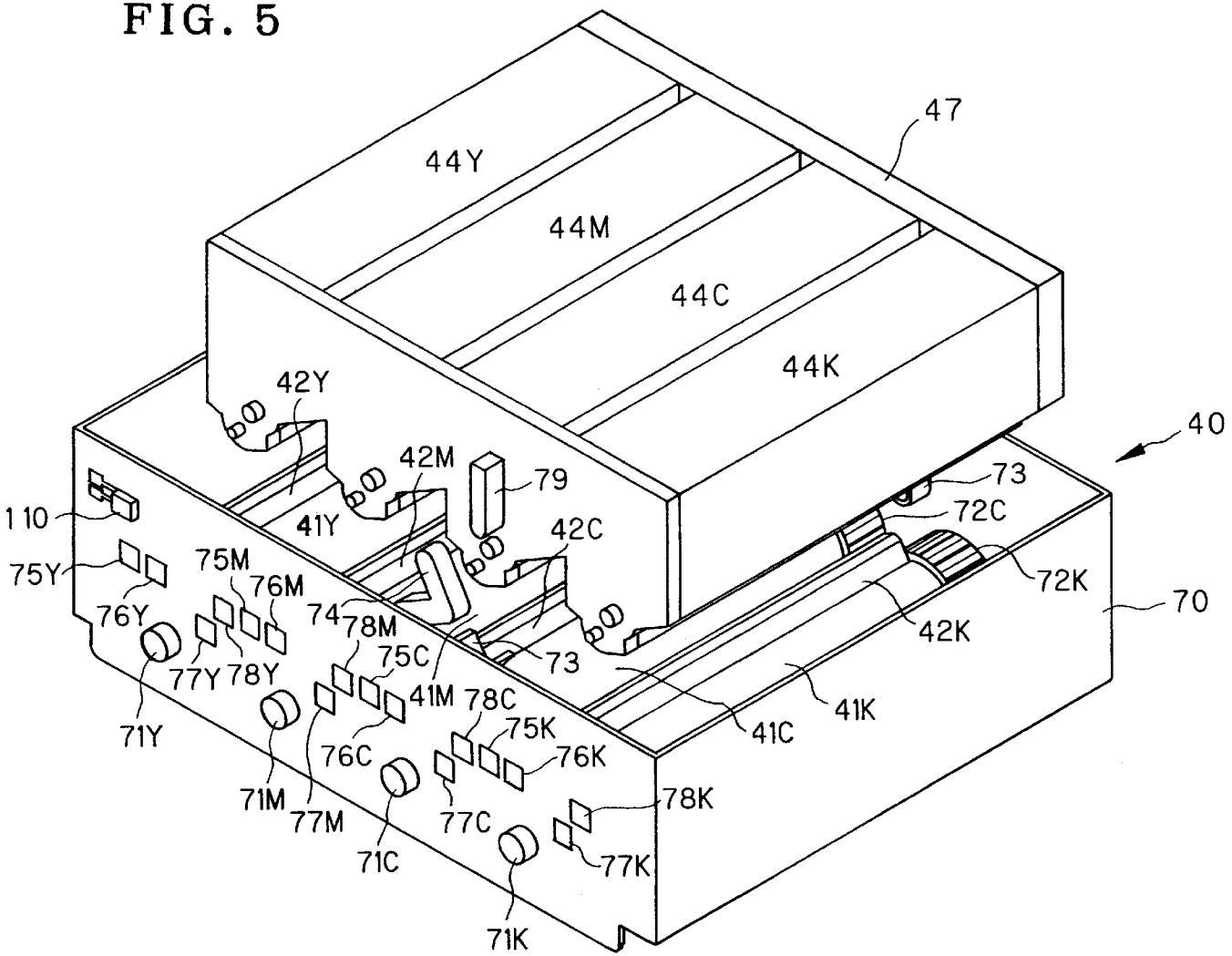
FIG. 5 is a perspective view illustrative of the attachment/detachment mechanism for one embodiment where all developing devices are constructed in the form of an integral developing cartridge.

FIG. 5 is a perspective view illustrative of the attachment/detachment mechanism for an embodiment of the invention wherein four or black, cyan, magenta and yellow developing devices 44 (K, C, M, Y) are constructed in the form of an integral development cartridge 47 for such a photosensitive member cartridge 40 as described above. In this embodiment, only one pair of guide grooves 73 are provided at the inner upper sites of both side plates of the frame 70 of the photosensitive member cartridge 40, spanning between both side plates. Accordingly, only one pair of pivotal fixing levers 74 are provided. On the other hand, the four developing devices 44 (K, C, M, Y) are constructed in the form of an integrated single developing cartridge 47. On each side of the developing cartridge 47 there is mounted a guide ridge 79 that is to be inserted into the associated guide groove 73 from the upper open end thereof (in FIG. 5, one guide ridge 79 alone is visible). To mount the developing cartridge 47 on the photosensitive member cartridge 40, the guide ridges 79 are inserted from above into the guide grooves 73 and the fixing levers 74 are then pivoted to fix the developing cartridge in place. To remove the developing cartridge 47 for replacement or other purposes, the fixing levers 74 are pivoted back so that the developing cartridge 47 can be guided upward along the guide grooves 73.

The embodiment of FIG. 5, wherein the four or black, cyan, magenta and yellow developing devices 44 (K, C, M, Y) are designed as the integral developing cartridge 47, has the merit of reducing the number of consumable parts, thereby improving the integrity of maintenance and avoiding a risk of anything wrong happening upon mounting.

Figure 6:
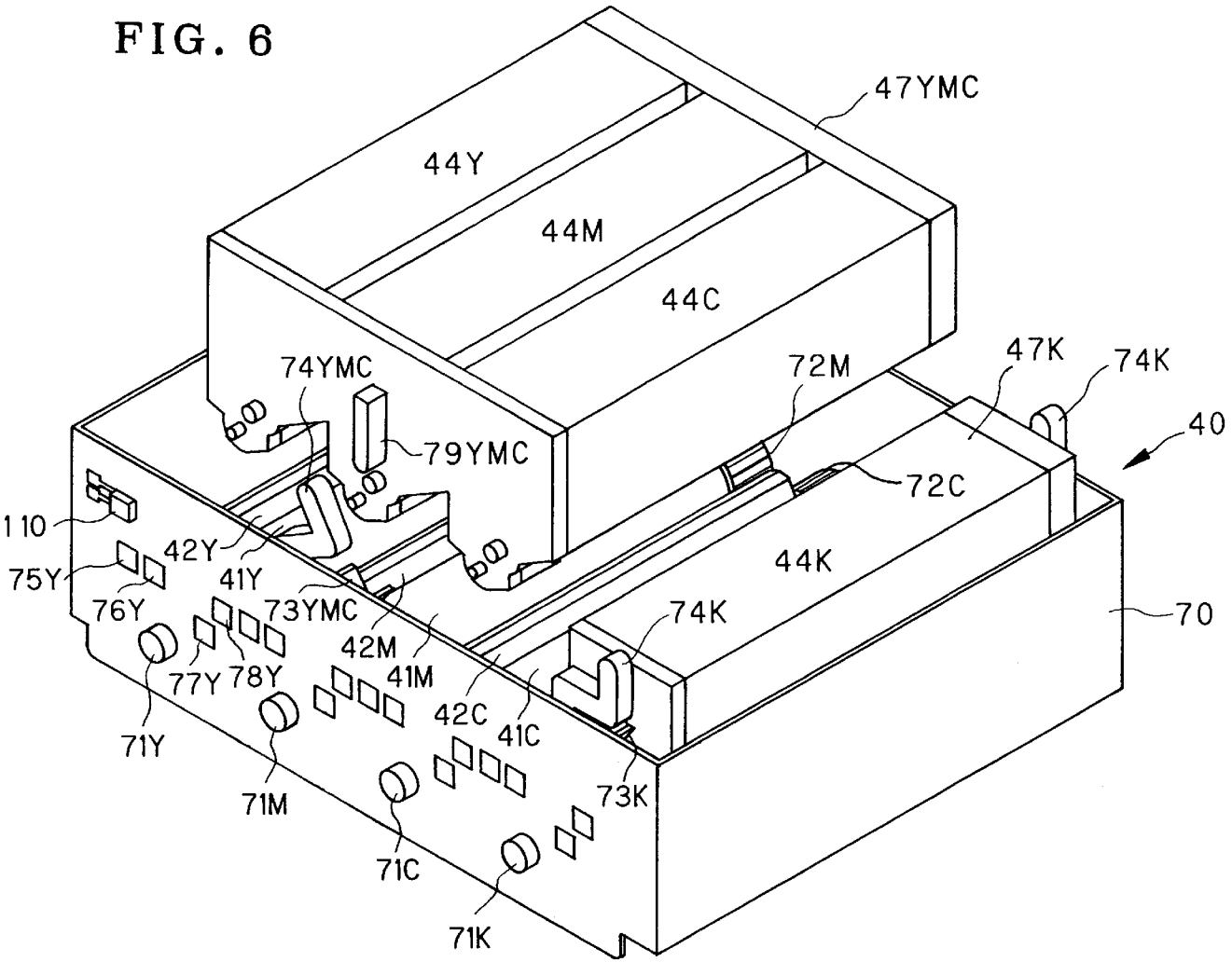
FIG. 6 is a perspective view illustrative of the attachment/detachment mechanism for an embodiment of the invention, wherein the black developing device is constructed in the form of a single developing cartridge and the remaining developing devices are constructed in the form of an integral developing cartridge.

FIG. 6 is a perspective view illustrative of the attachment/detachment mechanism for such a photosensitive member cartridge 40 as described above, wherein a black developing device 44K is constructed in the form of one single developing cartridge 47K that is detachable from or attachable to a black photosensitive member 41K as is the case with FIG. 3 or FIG. 4, and three or cyan, magenta and yellow developing devices 44 (C, M, Y) are constructed in the form of an integral developing cartridge 47YMC. At the inner upper sites of both side plates of a frame 70 of the photosensitive member cartridge 40 there are provided guide grooves 73K for receiving the developing cartridge 47K between both side plates and guide grooves 73YMC for receiving the developing cartridge 47YMC, and there are provided pivotal fixing levers 74K and 74YMC, accordingly. On the other hand, the black photosensitive member cartridge 40 is provided on both its sides with guide ridges 79K and the three-color developing cartridge 47YMC is provided on both its sides with guide ridges 79YMC (in FIG. 6, only one guide ridge 79YMC is visible on the developing cartridge 47YMC). To mount the developing cartridge 47K or 47YMC on the photosensitive member cartridge 40, the guide ridges 79K or 79YMC are inserted from above into the guide grooves 73K or 73YMC, whereupon the fixing levers 74K or 74YMC are pivoted to fix the developing cartridge in place. To remove the developing cartridge 47K or 47YMC for replacement or other purposes, the fixing levers 74K or 74YMC are pivoted back so that the developing cartridge 47K or 47YMC can be guided upward along the guide grooves 73K or 73YMC.

The embodiment of FIG. 6, wherein the three-color or cyan, magenta and yellow developing devices 44 (C, M, Y) are constructed in the form of the integral developing cartridge 47YMC, has the merit of removing the number of consumable parts, thereby improving the integrity of maintenance and avoiding a risk of anything wrong happening upon mounting. This embodiment has another merit of preventing the three-color or cyan, magenta and Y developing devices 44 (C, M, Y) from going to waste, because the black developing device 44K most frequently used in general can be replaced in the form of the independent developing cartridge 47K.

Figure 7:
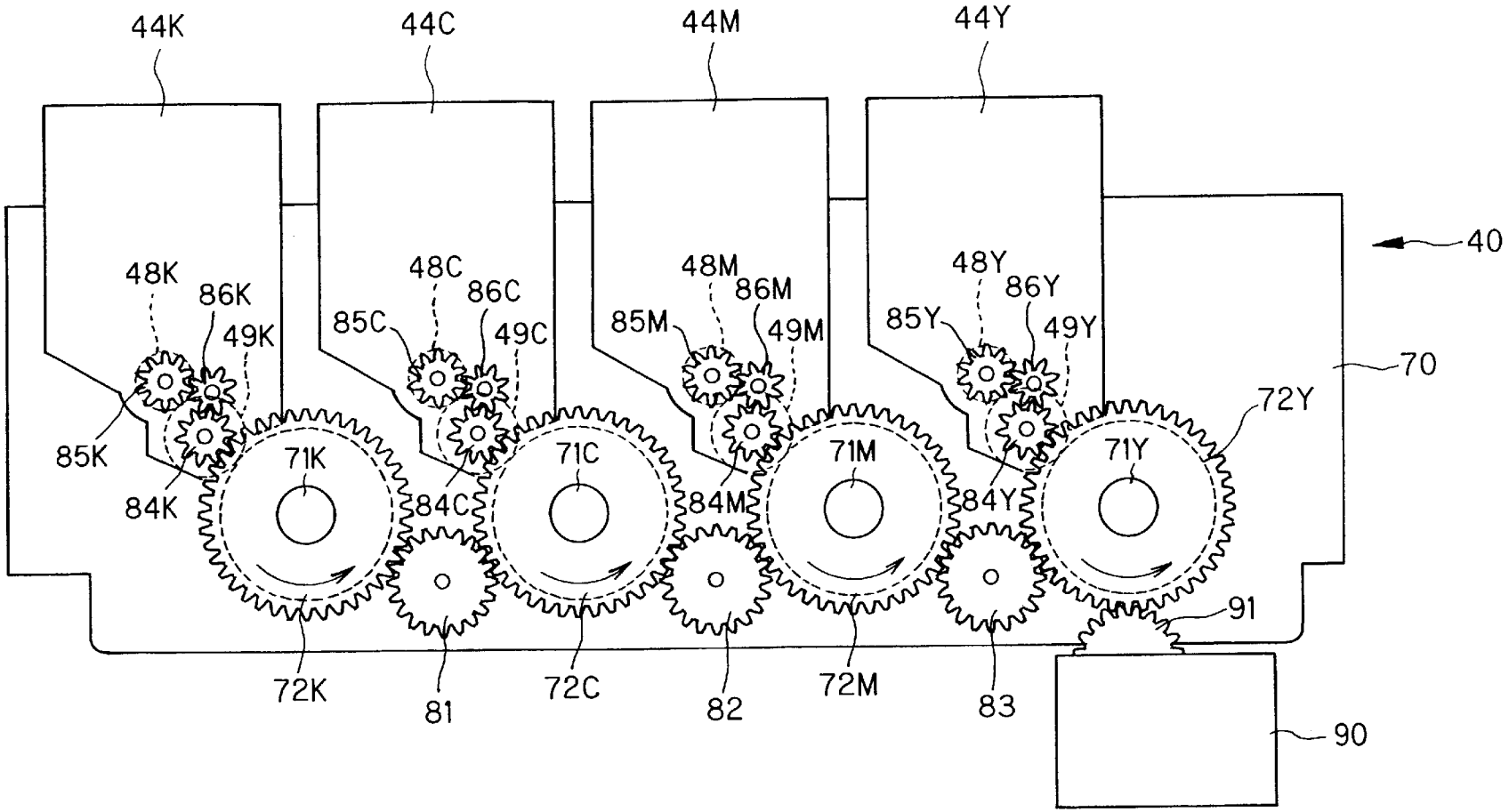
FIG. 7 is illustrative of one embodiment of the mechanism for rotating the photosensitive members in the photosensitive member cartridge in synchronism with one another.

Next, an account is given of the mechanism of, upon the photosensitive member cartridge 40 mounted on the system proper, rotating the photosensitive members 41K, 41C, 41M and 41Y in the cartridge 40 in synchronism with one another, thereby preventing any color misalignments. FIG. 7 is illustrative of one construction for achieving this. As already mentioned, the shafts 71 (K, C, M, Y) of the photosensitive members 41 (K, C, M, Y) are mounted at their one ends with gears 72K, 72C, 72M and 72Y, respectively, which are molded using the same mold. Three idle gears for transmission of rotational force are provided; an idle gear 81 is interposed between the gears 71K and 72C, an idle gear 82 between the gears 72C and 72M, and an idle gear 83 between the gears 72M and 72Y, forming a gear train. A driving gear 91 in mesh with one gear in this gear train, for instance, gear 72Y, is disposed at a driving source 90 on the side of the system proper, so that upon the photosensitive cartridge 40 mounted at a given position, the driving gear 91 meshes with the gear 72Y.

On the other hand, the shaft of the developing roller 49 (K, C, M, Y) of the developing device 44 (K, C, M, Y) is fixedly provided at its one end with a developing roller gear 84 (K, C, M, Y), and the shaft of the feed roller 48 (K, C, M, Y) is fixedly provided at its one end with a feed roller gear 85 (K, C, M, Y). An idle roller 86 (K, C, M, Y) is interposed between the developing roller gear 84 (K, C, M, Y) and the feed roller gear 85 (K, C, M, Y). The developing roller gear 84 (K, C, M, Y) meshes with the gear 72 (K, C, M, Y) of the photosensitive member 41 (K, C, M, Y), so that the developing roller 49 (K, C, M, Y) and feed roller 48 (K, C, M, Y) of the developing device 44 (K, C, M, Y), too, can be rotationally driven in synchronism with the photosensitive member 41 (K, C, M, Y).

By rotating the driving gear 91 of the driving source at one site on the side of the system proper according to this arrangement, it is possible to rotationally drive the four photosensitive members 41 (K, C, M, Y) and the appendixes thereto, i.e., the developing rollers 49 (K, C, M, Y) and feed rollers 48 (K, C, M, Y) of the developing devices 44 (K, C, M, Y), all in synchronism with one another.

This embodiment ensures the operating efficiency of attachment/detachment of the photosensitive member cartridge 40 is improved because the point of meshing of the gears for transmission of driving force upon attachment/detachment of the photosensitive member cartridge 40 is limited to one. Since the positioning criterion for the photosensitive member cartridge 40 is defined by this driving force transmission gear 91, it is also possible to improve the precision of meshing and, hence, provide a system for forming high-quality images that are substantially free from any color misalignment or any banding (variations in densities, etc. at right angles with the feed direction).

It is understood that the mechanism for synchronized transmission of rotational force for the photosensitive members 41K, 41C, 41M and 41Y is not limited to such a gear train as shown, and so may be constructed using a belt or chain, for instance.

Figure 8:
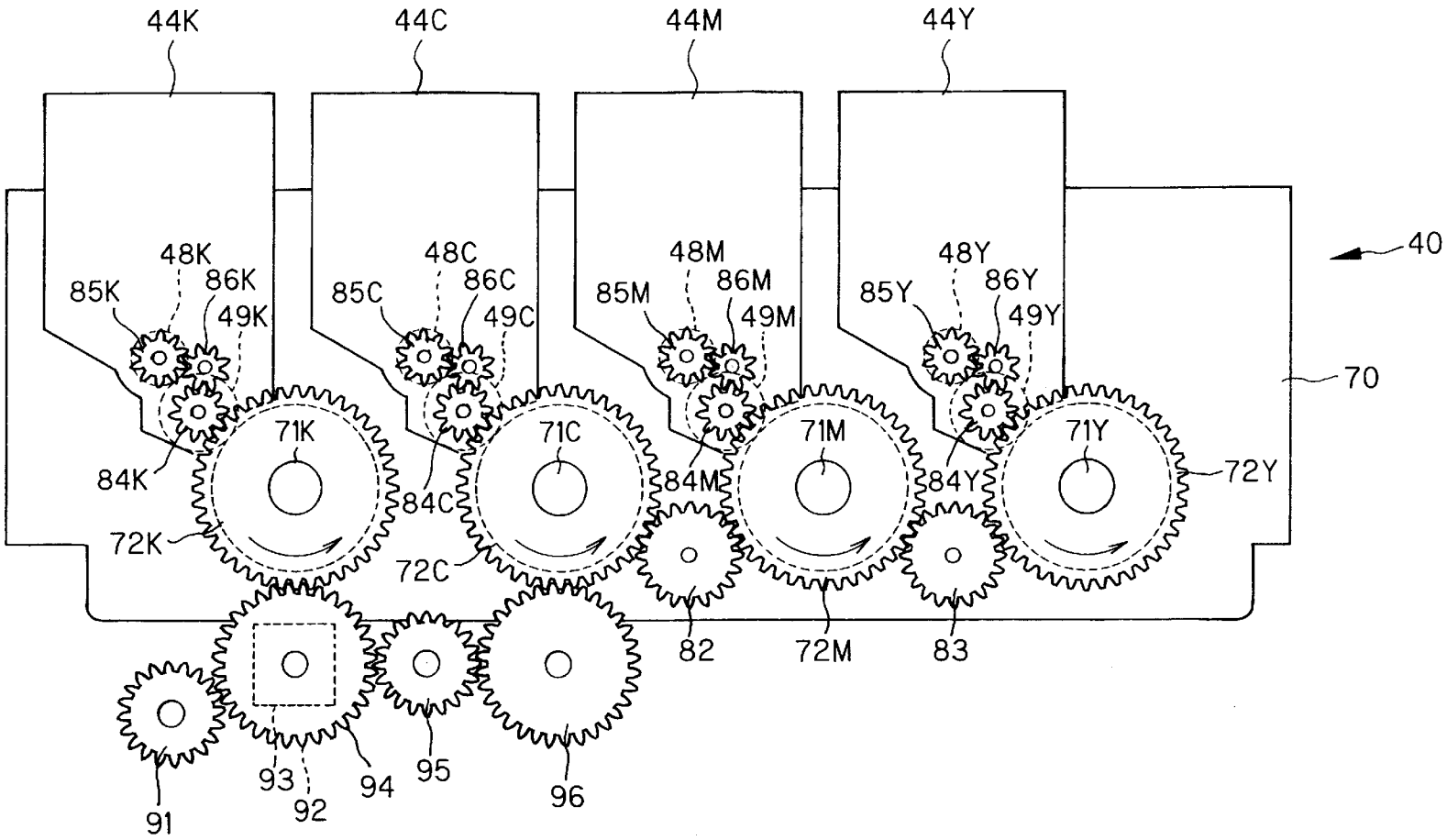
FIG. 8 is illustrative of one modification to the embodiment of FIG. 7.
Figure 9:
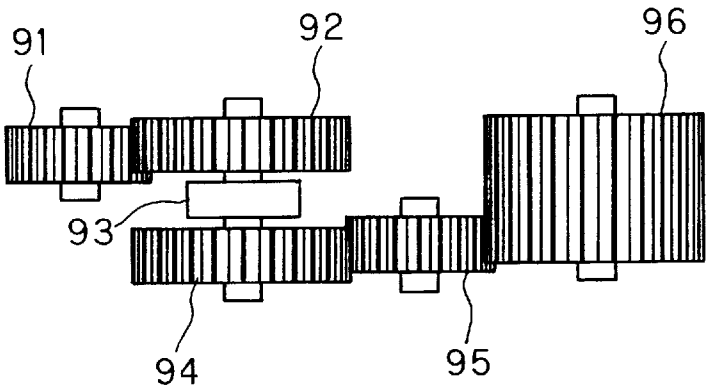
FIG. 9 is a schematic of the rotation transmission portion of FIG. 8 as viewed from above.

FIG. 9 is illustrative of one modification to the embodiment of FIG. 8. FIG. 9 is a schematic of the rotation transmission portion comprising the gear 91, gear 92, clutch 93 and gears 94 to 96 of FIG. 8 as viewed from above. In this modification, the driving gear 91 of the driving source (FIG. 7) on the side of the system proper is designed to mesh with the gear 72K via the gear 92, with the omission of the idle gear 81 interposed between the gears 72K and 72C. Instead, a rotation transmission mechanism comprising the gear 92, clutch 93 and gears 94 to 96 as shown in FIG. 9 is interposed between the gear 72K and 72C. As the clutch 93 is put on, the rotational force of the gear 92 is transmitted to the gear 94 and then to gear 95 in mesh with that gear 94, so that rotation in the same direction as is the case with the gear 72K is transmitted to the gear 72C via the gear 96 interposed between that gear 95 and the gear 72C. The rotation of the gears 72M and 72Y is transmitted as is the case with FIG. 7. It is here noted that since the gears 92, 94 and 96 are molded using the same mold, the four photosensitive members are rotationally driven in synchronism and at the same speed.

In this modification, as the clutch 93 is put off, the rotation of the driving gear 91 is transmitted to only the black developing device 44K, so that other developing devices 44 (C, M, Y) remain inoperative. When only a black image is formed, therefore, there is only the need of putting the black photosensitive member 41K and the associated developing device 44K in effective operation; other photosensitive members 41 (C, M, Y) and the associated developing devices 44 (C, M, Y), which are not required to be placed in operation, are rendered inoperative. It is thus possible to prevent unnecessary consumption of the developing devices 44 (C, M, Y), thereby extending their service lives.

Figure 10:
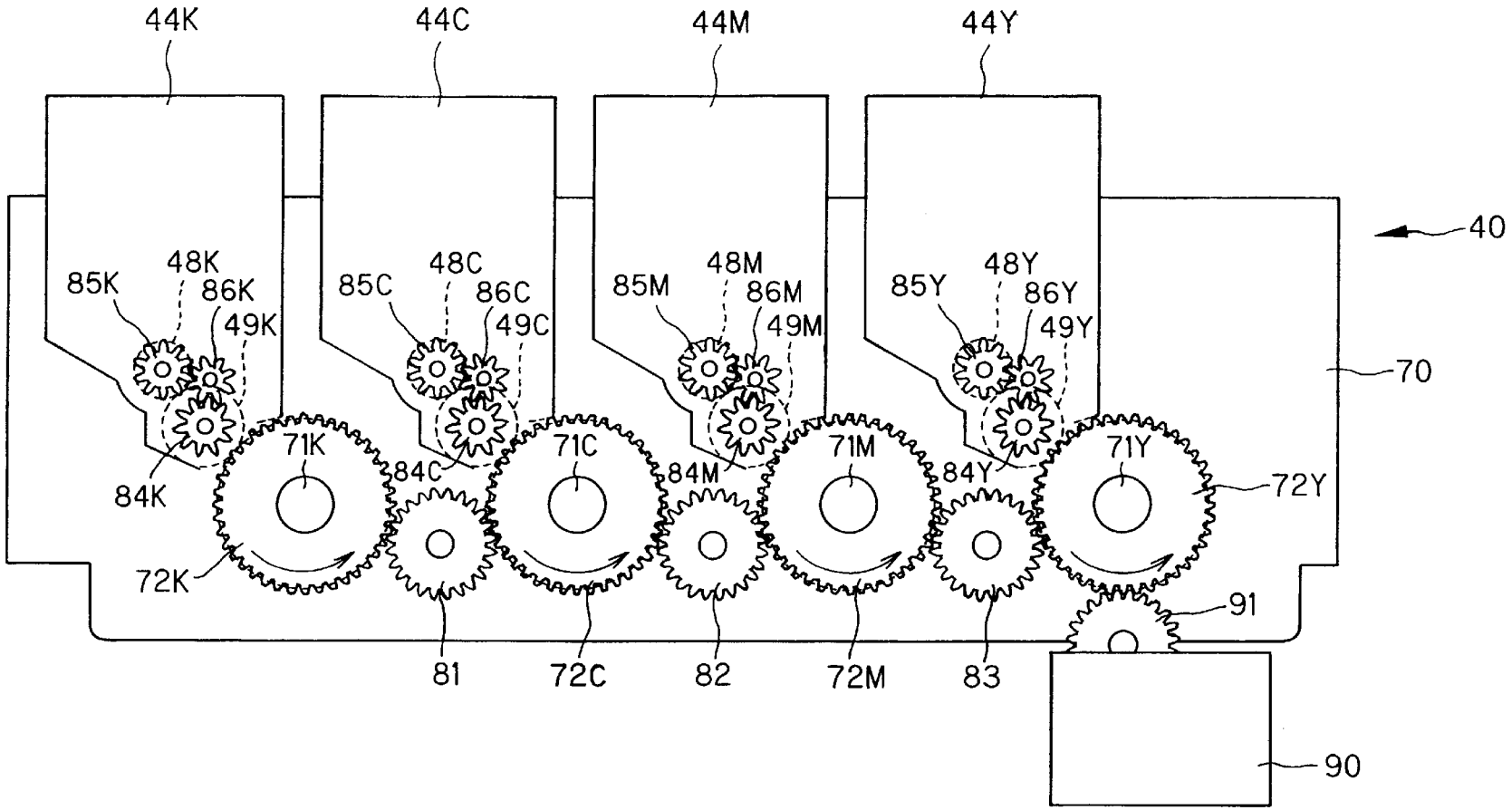
FIG. 10 is illustrative of the construction of the mechanism for synchronized rotation of the photosensitive members in an embodiment of the invention, wherein the photosensitive member cartridge 40 is mounted on the system proper, and the photosensitive members and developing devices are driven by means of separate driving sources.
Figure 11:
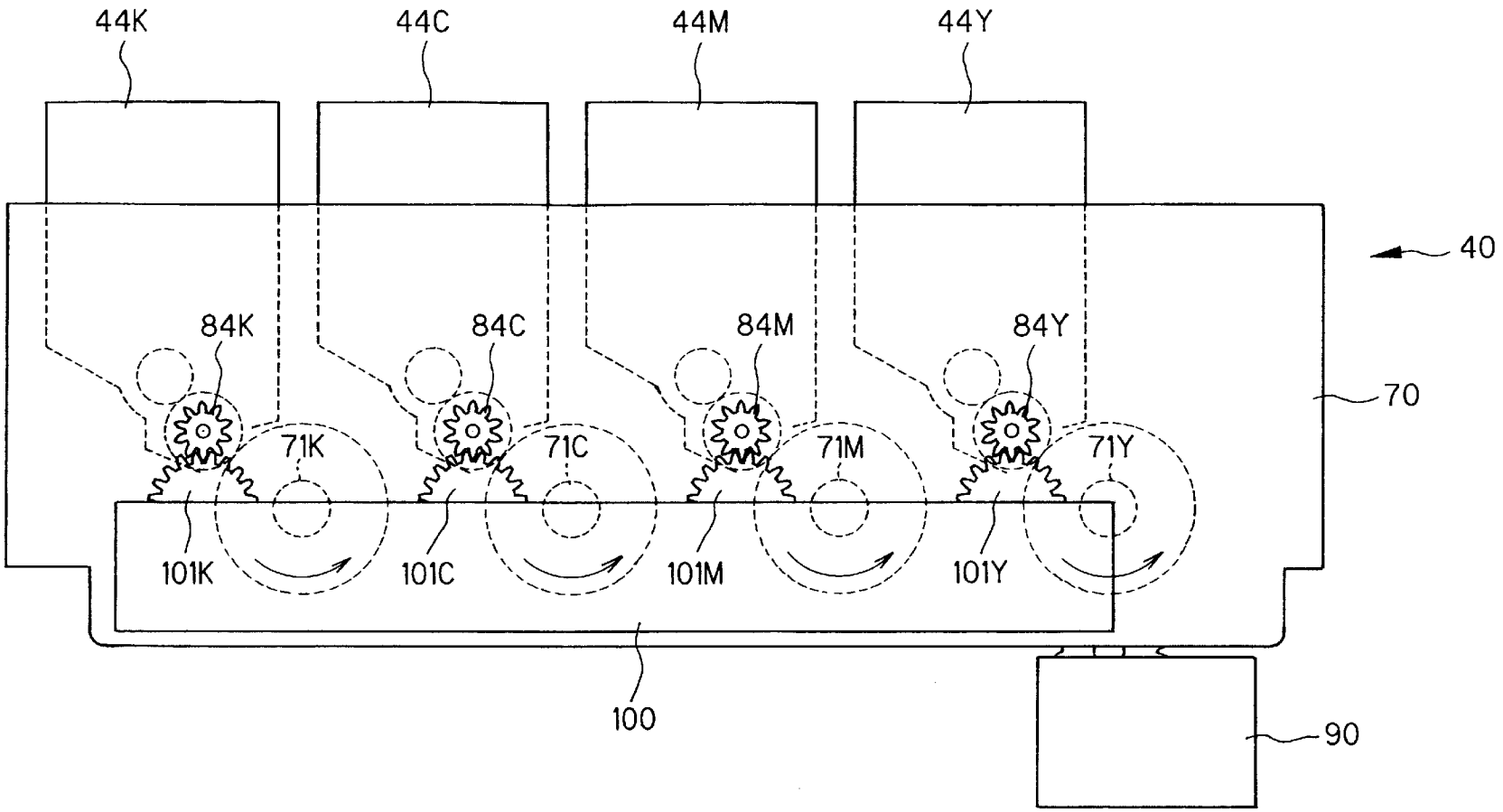
FIG. 11 is illustrative of the construction of the mechanism for rotating the developing devices in the embodiment of FIG. 10.

FIGS. 10 and 11 are illustrative of an embodiment of the invention, wherein the photosensitive member cartridge 40 is mounted on the system proper and the photosensitive members 41 (K, C, M, Y) and developing devices 44 (K, C, M, Y) of the photosensitive member cartridge 40 are driven by means of separate driving sources. FIG. 10 is similar to FIG. 7. In this embodiment, the developing roller gears 84 (K, C, M, Y) of the developing devices 44 (K, C, M, Y) are not in mesh with the gears 72 (K, C, M, Y) of the photosensitive members 41 (K, C, M, Y) or separated therefrom, as can be seen from FIG. 10. The embodiment of FIG. 10 is different from that of FIG. 7 only in terms of the gear train of the photosensitive member cartridge 40. By rotating the driving gear 91 of the driving source 90 on the side of the system proper, the four photosensitive members 41 (K, C, M, Y) can thus be rotationally driven in synchronism, as can be see from FIG. 10. Although depending on the driving force of that driving source 90, however, the developing roller 49 (K, C, M, Y) and feed roller 48 (K, C, M, Y) of the developing device 44 (K, C, M, Y) are kept from rotation. In this embodiment, there is another driving source 100 at another site on the side of the system proper, as shown in FIG. 11. When the photosensitive member cartridge 40 is mounted at a given position of the system proper, four gears 101 (K, C, M, Y) of the separate driving source 100, designed to rotate in synchronism and in the same direction, are positioned in such a way that they mesh with the developing roller gears 84 (K, C, M, Y) fixed at one ends of the shafts of the developing rollers 49 (K, C, M, Y) of the developing devices 44 (K, C, M, Y) mounted on the photosensitive member cartridge 40. Thus, the developing devices 44 (K, C, M, Y) are rotationally driven by the driving source 100 that is separate from that for the photosensitive members 41 (K, C, M, Y).

In such an arrangement as shown in FIG. 1, color misalignments and image banding are largely dependent on the precision of rotation of the image carriers; however, they are less dependent on the precision of rotation of the developing rollers. Therefore, if the driving source 90 for the photosensitive members 41 (K, C, M, Y) of the photosensitive member cartridge 40 is made separate from the driving source 100 for the developing devices 44 (K, C, M, Y) as shown in FIGS. 10 and 11, it is then possible to prevent rotation variations caused as by fluctuations in the torque of developing means from having influences on the rotation of the image carriers and, hence, provide a system for forming high-quality images with neither color misalignments nor image banding.

Figure 12:
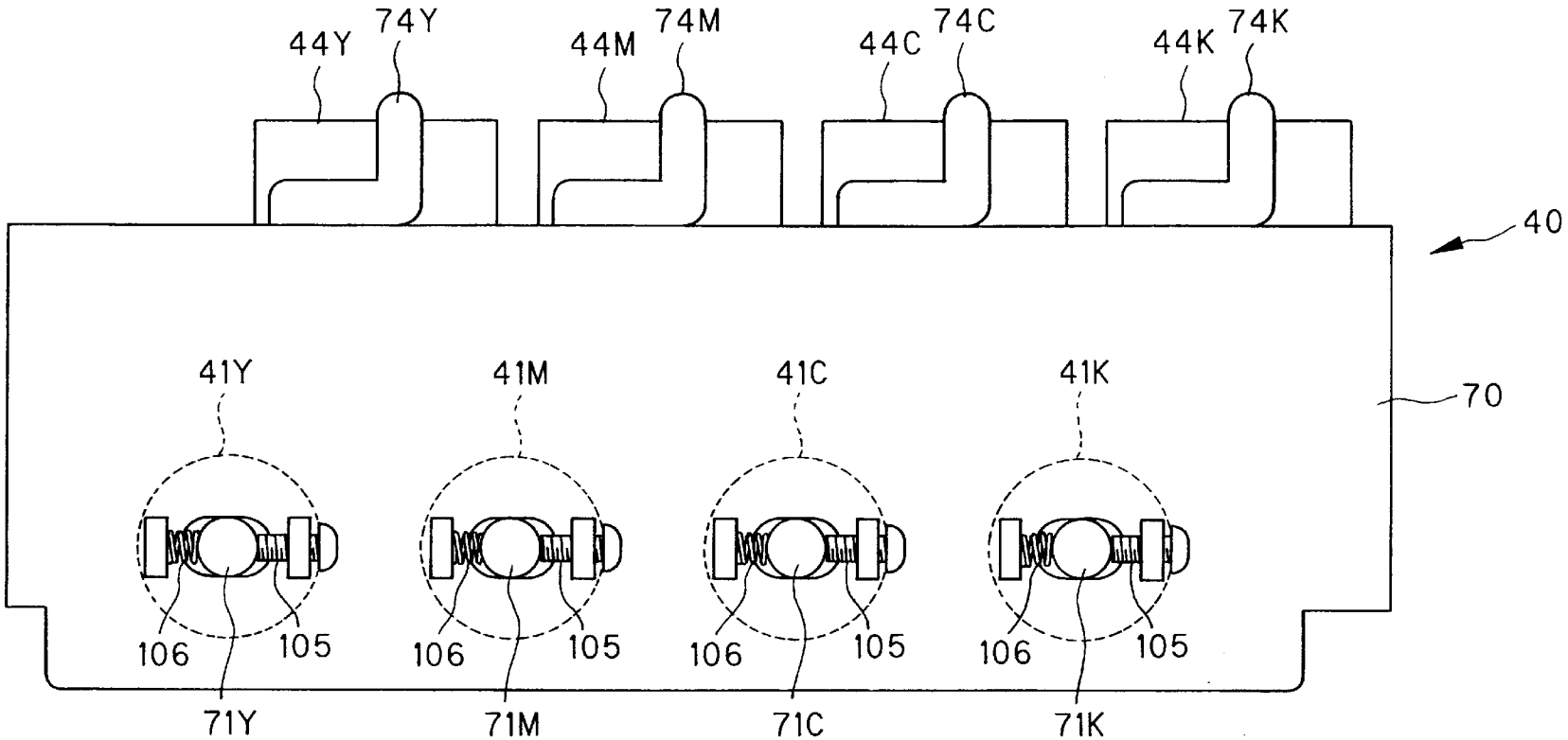
FIG. 12 is illustrative of one embodiment of the mechanism for adjusting the photosensitive member cartridge for color misalignments.

FIG. 12 is illustrative of one embodiment of the mechanism for adjusting color misalignments occurring due to position misalignments between the photosensitive members 41K, 41C, 41M and 41Y, especially skews in parallelism, when four different monochromatic toner images are transferred onto the intermediate transfer belt 30 in a superposed fashion. As shown in FIG. 12, while the shaft 71 (K, C, M, Y) of each photosensitive member 41 (K, C, M, Y) extending from one side plate of the frame 70 is sandwiched between an adjustment screw 105 and the leading end of an extensible spring 106, the other end of the extensible spring 106 is fixed to the side plate 70. In this state, if the leading end of the adjustment screw 105 is adjustable in the direction opposite to the direction of extension of the extensible spring 106 to adjust the position of one end of the shaft 71 (K, C, M, Y), it is then possible to adjust skews in parallelism between the photosensitive members 41K, 41C, 41M and 41Y. It is not always required to provide all the four photosensitive members 41K, 41C, 41M and 41Y with such color misalignment adjustment mechanisms. It is noted that it is acceptable to provide the opposite ends of the shafts 71 (K, C, M, Y) with such color misalignment adjustment mechanisms. However, this is not always necessary because misalignments can be electrically eliminated by controlling the timing of when color latent images formed on the photosensitive members 41 (K, C, M, Y) are to be written, as long as given parallelism is maintained between the photosensitive members 41 (K, C, M, Y).

By providing the photosensitive member cartridge 40 with the position alignment mechanism for the photosensitive members 41 (K, C, M, Y) in this way, it is possible to make fine adjustments of the positions of the photosensitive members 41 (K, C, M, Y) onto which latent images are to be written and transferred, thereby reducing color misalignments. It is here noted that the color misalignment adjustment by this color (position) misalignment adjustment mechanism may be made upon shipment of the photosensitive member cartridge 40 or anytime after its attachment to the system proper.

Figure 13:
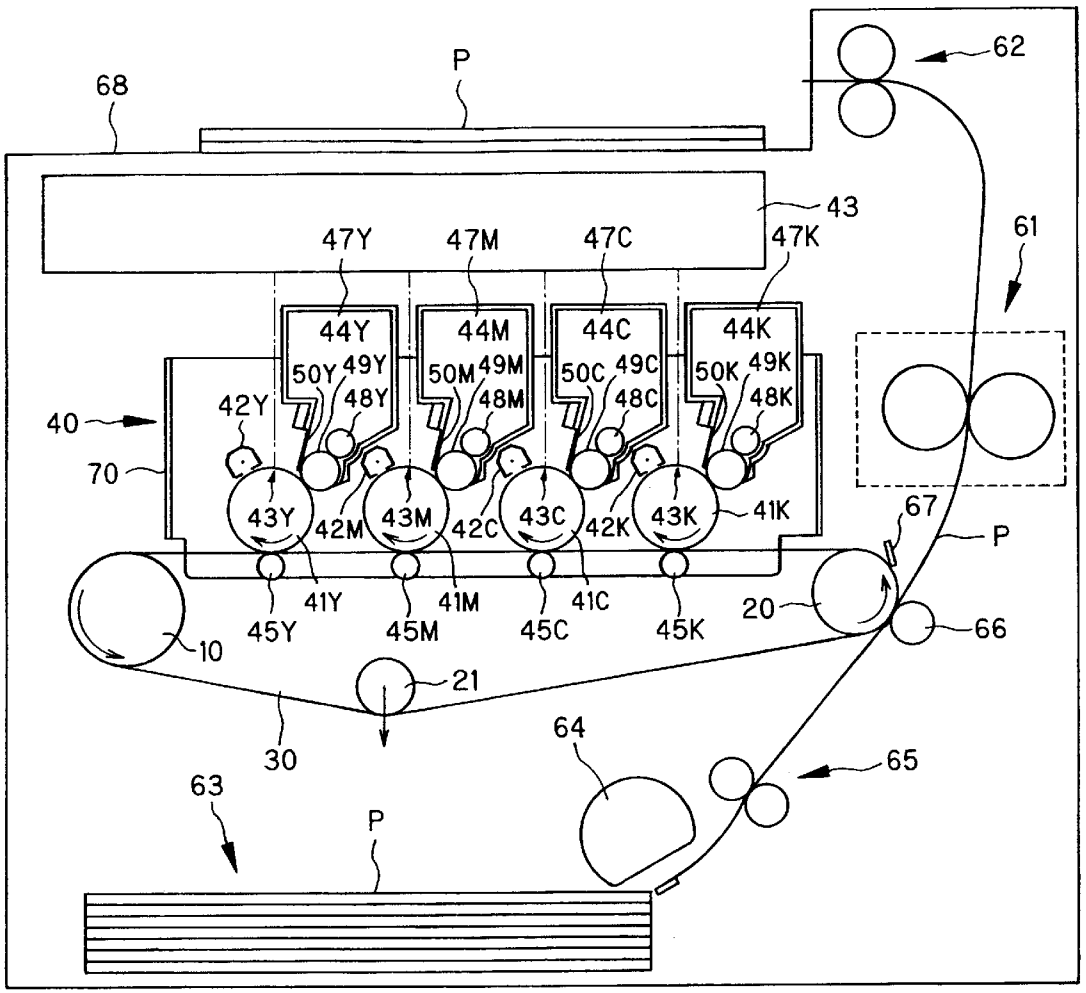
FIG. 13 is a front schematic illustrative of the whole construction of an embodiment of the color image formation system using a "cleaner-less" mode.

Referring now to an electrographic system wherein latent images formed on image carriers are toner developed and the resulting toner images are transferred onto transfer media, there is a so-called "cleaner-less" mode wherein the remnants of toner not transferred onto the image carriers are recovered at developing devices without recourse to such cleaning devices as shown in FIG. 1 (for instance, see JP-B 06-77166). This "cleaner-less" mode is embodied as shown in FIG. 13, dispensing with the cleaning devices 46 (K, C, M, Y). The embodiment of FIG. 13 is the same in construction as that of FIG. 1 with the exception of the absence of the cleaning devices 46 (K, C, M, Y); any detailed account of its construction and action is not given. The construction of the photosensitive member cartridge 40 in this embodiment, too, is the same as that of FIGS. 1 and 2 with the exception of the absence of the cleaning devices 46 (K, C, M, Y); four photosensitive members 41K, 41C, 41M and 41Y are integrated with corona chargers 42 (K, C, M, Y) disposed around them.

By use of the mode that dispenses with any cleaning device, it is possible to reduce the size of the photosensitive member cartridge 40 and the system proper. In addition, it is possible to diminish reaction force that may otherwise act on the photosensitive members 41 (K, C, M, Y) through the blades, etc. of cleaning devices, resulting in prevention of color misalignments. This is because the frame 70 is kept from deformation so that any position misalignment between the photosensitive members 41 (K, C, M, Y) can be avoided.

Figure 14:
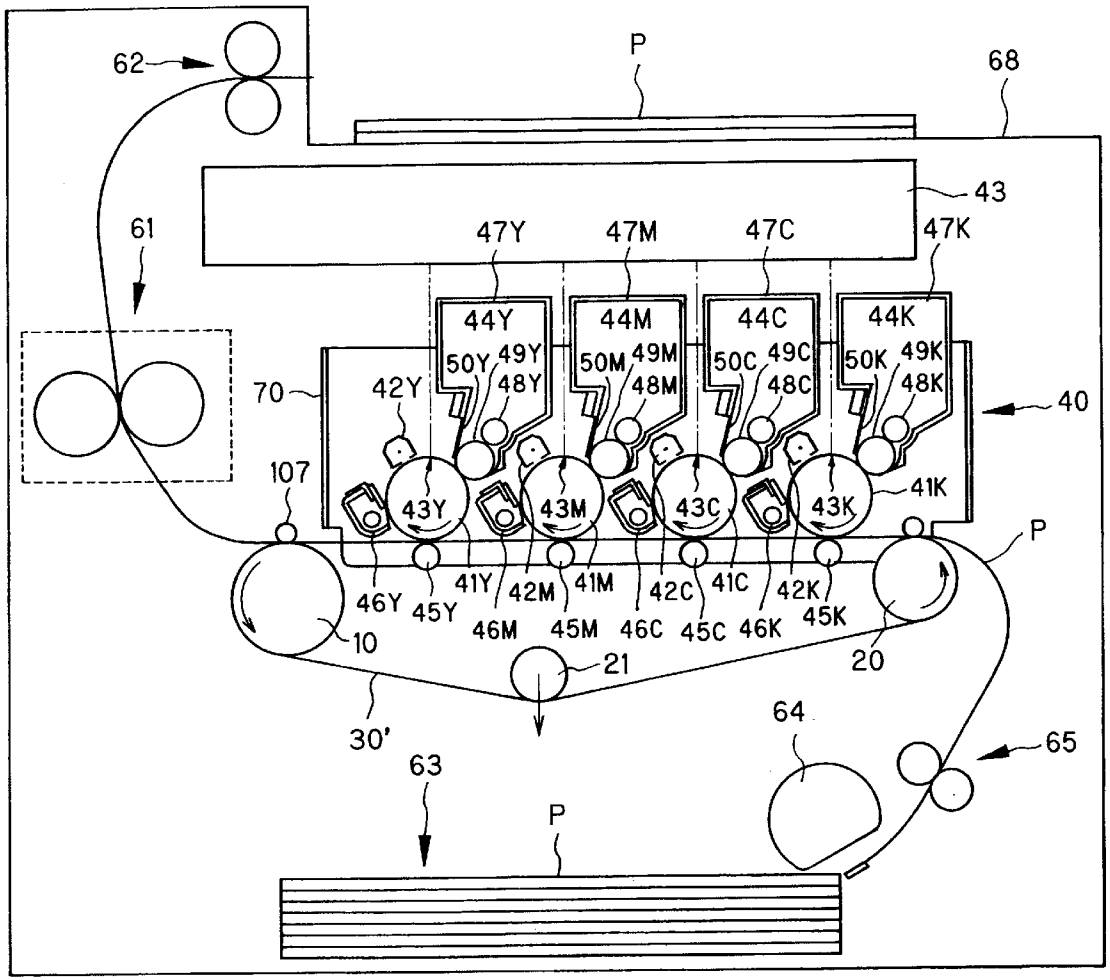
FIG. 14 is a front schematic illustrative of the whole construction of an embodiment of the color image formation system using a recording medium carrier belt instead of the intermediate transfer belt.

The present invention has been explained with reference to some embodiments applied to the tandem type system for forming color images using the intermediate transfer belt 30 (FIG. 1), wherein four photosensitive members 41 (K, C, M, Y) are integrated into the photosensitive member cartridge 40 according to the present invention. It is here noted that instead of the intermediate transfer belt, it is acceptable to use a recording medium carrier belt. In this case, the recording medium carrier belt is used to carry and deliver recording media such as recording sheets. A plurality of monochromatic toner images are successively transferred directly onto a recording sheet, followed by the fixation of toner images of different colors which are superposed one upon another on the recording medium. A typical example of this is shown in FIG. 14. The embodiment of FIG. 14 is the same as that of FIG. 1 with the exception of the following points. Instead of the intermediate transfer belt 30 of FIG. 1, a recording medium carrier belt 30' is used to carry and deliver a recording medium (sheet) P. The recording sheets from a sheet feed cassette 63 are picked up by a pickup roller 64 on a one-by-one basis, and the feed timing of the recording sheet is controlled by a pair of gate rollers 65 in such a way that it is in synchronism with electrostatic latent images formed on the photosensitive members 41 (K, C, M, Y). Toner images formed on the photosensitive members 41 (K, C, M, Y) are successively transferred and superposed onto the recording medium P being delivered under the action of primary transfer rollers 45 (K, C, M, Y). Then, the recording medium P bearing the resulting full-color image thereon is released from the recording medium carrier belt 30' by a release roller 107, and passes between a pair of fixing rollers 61 defining a fixing portion, where the full-color toner image is fixed onto the recording medium P. Finally, the recording medium is ejected via a pair of ejecting rollers 62 onto an output tray 68 mounted on the upper portion of the system. The construction of the photosensitive member cartridge 40 in particular is the same as that of FIG. 1 or the like. To those skilled in the art, it would be apparent that any one of the aforesaid embodiments can be applied to the tandem type of color image formation system where recording media are carried and delivered by such a recording medium carrier belt, not by the intermediate transfer belt, and toner images are transferred onto the recording media.

In accordance with the inventive color image formation system wherein, as explained above, a plurality of photosensitive members 41 (K, C, M, Y) are mutually positioned and mounted on a photosensitive member cartridge 40 detachable from and attachable to the system proper and developing devices 44 (K, C, M, Y) are disposed in such a way as to be detachable from and attachable to the photosensitive members 41 (K, C, M, Y) mounted on the photosensitive member cartridge 40, the precision of relative positions between the photosensitive members is so improved that color misalignments ascribable to misalignments between the photosensitive members and skews thereof can be prevented.

Gears can be associated with the photosensitive members in such phase relations as to reduce speed fluctuations due to the gears that drive the photosensitive member, so that the cartridge 40 can be constructed in an integral form. In addition, color misalignments due to the photosensitive member-driving gears can be considerably reduced (FIG. 7 and so on). Where the photosensitive members are individually mounted on the system proper, it is impossible to make phase adjustments of such gears because the photosensitive members rotate by themselves.

Further, the photosensitive member cartridge 40 can be finished up using photosensitive members of uniform performance singled out at the time of shipping, so that color changes due to variations in the photosensitive members' properties of different colors can be prevented. In addition, the integrity of maintenance can be improved because a plurality of photosensitive members can be replaced at the same time.

Furthermore, the arrangement wherein the developing devices 44 (K, C, M, Y) are designed as detachable from and attachable to the photosensitive member cartridge 40 ensures that the developing devices 44 (K, C, M, Y) can be replaced independently of the photosensitive member cartridge 40. Therefore, even when the developing devices 44 (K, C, M, Y) are exhausted or used up and so must be replaced with new ones, there is no need of making a replacement for the photosensitive members 41 (K, C, M, Y), so that running cost reductions are achievable.

What is necessary when the developing devices 44 (K, C, M, Y) are used up is only their replacement. There is no need of any color matching operation depending on the positions and configuration of the photosensitive members 41 (K, C, M, Y). It is thus possible to provide an image formation system having improved operating efficiency.

For replacement of the developing devices 44 (K, C, M, Y), only the withdrawal of the photosensitive member cartridge 40 is needed. Then, new developing devices are attached to the photosensitive member cartridge 40. Thus, the operation for replacement of the developing devices 44 (K, C, M, Y) is so facilitated that the integrity of maintenance can be improved.

It is also acceptable to construct a plurality of photosensitive members 41 (K, C, M, Y) in the form of one single replacement and the developing devices 44 (K, C, M, Y) in the form of one single replacement 47 (FIG. 19), so that the integrity of maintenance can be much more improved.

The color image formation system according to the second aspect of the present invention is now explained with reference to some embodiments.

Figure 15:
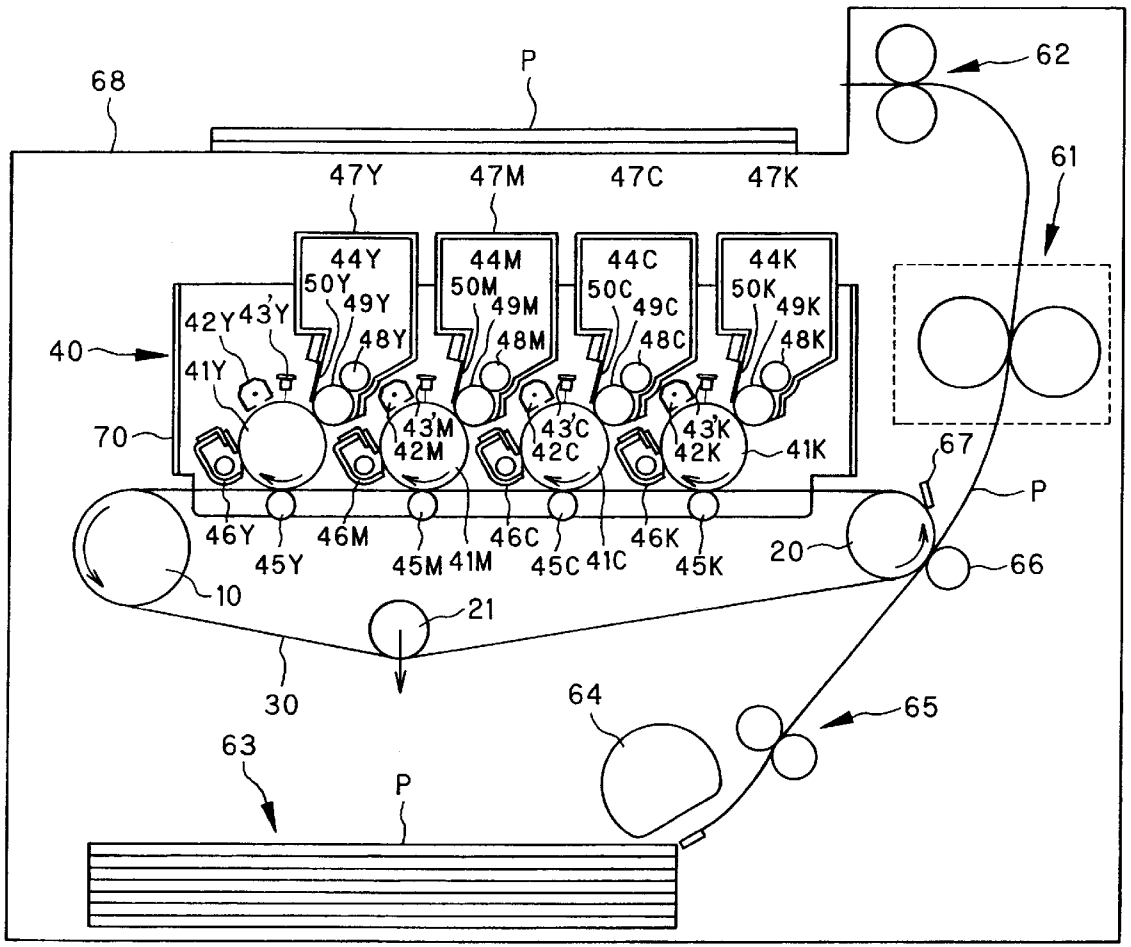
FIG. 15 is a front schematic illustrative of the whole construction of another color image formation system to which the invention is applied.

FIG. 15 is a front schematic illustrative of the whole construction of another color image formation system to which the invention is applied. As shown in FIG. 15, this image formation system comprises an intermediate transfer belt 30 that is spanned in place with tensions applied thereon by a driving roller 10, a follower roller 20 and a tension roller 21, and driven endlessly in the (counterclockwise) direction indicated by an arrow. Four photosensitive members (drums) 41K, 41C, 41M and 41Y having photosensitive layers on their outer surfaces, i.e., image carriers, are arranged at a given interval with respect to the intermediate transfer belt 30. The capital letters K, C, M and Y annexed to the numeral reference mean black, cyan, magenta and yellow, indicating the photosensitive members for black, cyan, magenta and yellow, respectively. The same holds true for other members. The photosensitive members 41K, 41C, 41M and 41Y are rotationally driven in synchronism with the intermediate transfer belt 30 in the (clockwise) direction indicated by an arrow. Around each photosensitive member 41 (K, C, M, Y), there is located a corona charger 42 (K, C, M, Y) comprising Scorotron acting as means for uniformly charging the outer surface of the photosensitive member 41 (K, C, M, Y), an exposure device 43' (K, C, M, Y) for selectively exposing the outer surface of the member 41 uniformly charged by the corona charger 42 (K, C, M, Y) to exposure light for each color, thereby forming an electrostatic latent image, a developing device 44 (K, C, M, Y) for imparting a developing agent that is a toner to the electrostatic latent image formed at this exposure device 43' (K, C, M, Y) to make a visible (toner) image, a primary transfer roller 45 (K, C, M, Y) for successively transferring toner images developed at this developing device 44 (K, C, M, Y) onto the intermediate transfer belt 30 for primary transfer purposes, and a cleaning device 46 (K, C, M, Y) working as cleaning means for removing the remnants of toner on the surface of the photosensitive member 41 (K, C, M, Y) after transfer.

Figure 18:
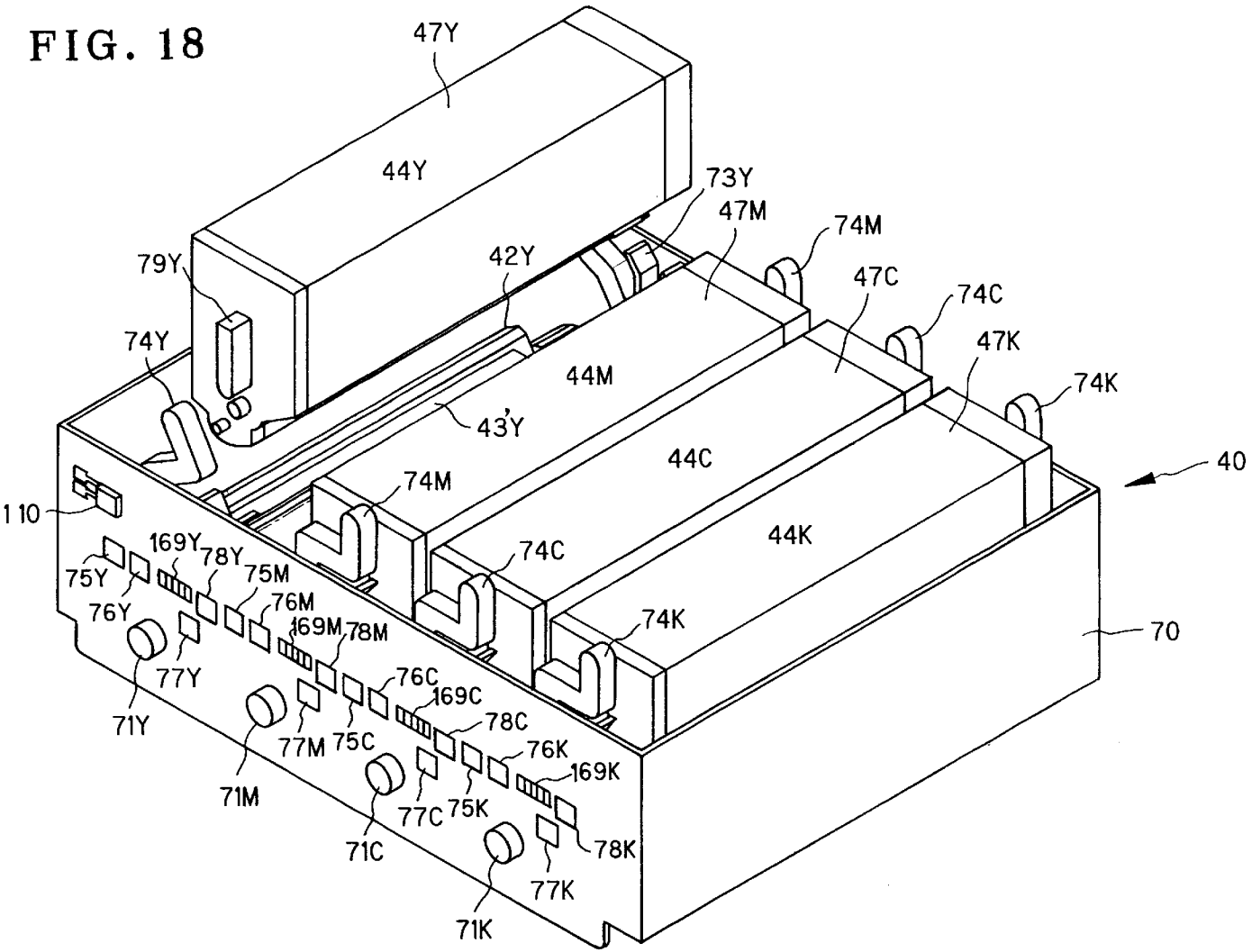
FIG. 18 is a perspective view illustrative of how one of a plurality of developing devices is detached from or attached to the photosensitive member cartridge with the rest remaining mounted thereon.

Typically using a non-magnetic mono-component toner as the developing agent, the developing device 44 (K, C, M, Y) is constructed in the form of a developing cartridge 47 (K, C, M, Y) (see FIG. 18). Such a mono-component toner stored in the cartridge 47 is delivered to a developing roller 49 (K, C, M, Y) by way of a feed roller 48 (K, C, M, Y). The thickness of a developing agent film deposited onto the surface of the developing roller 49 (K, C, M, Y) is controlled by a control blade 50 (K, C, M, Y). Then, the developing roller 49 (K, C, M, Y) is brought into contact or engagement with the photosensitive member 41 (K, C, M, Y) so that the developing agent is deposited onto the photosensitive member 41 (K, C, M, Y) depending on the potential level of the photosensitive member, thereby developing the latent image in the form of a toner image.

The black, cyan, magenta and yellow toner images formed at four different such monochromatic toner image-formation stations are successively primary transferred onto the intermediate transfer belt 30 by primary transfer biases applied on the primary transfer roller 45 (K, C, M, Y), so that they are superposed successively one upon another on the intermediate transfer belt 30, yielding a full-color toner image. Then, the full-color toner image is secondary transferred onto a recording medium P such as a recording sheet at a secondary transfer roller 66, passing between a pair of fixing rollers 61 that are fixing means so that the toner image is fixed on the recording medium P. Finally, the recording medium is ejected by way of a pair of ejecting rollers 62 on an output tray 68 mounted on the top of the system.

In FIG. 15, it is noted that reference numeral 63 is a sheet feed cassette for storing a multiplicity of recording media P in a superposed fashion, 64 is a pickup roller for feeding recording media P from the sheet feed cassette 63 one by one, 65 is a pair of gate rollers for controlling the timing of when the recording medium P is to be fed to the secondary transfer site of the secondary transfer roller 66. The secondary transfer roller 66 behaves as secondary transfer means for defining the secondary transfer site between it and the intermediate transfer belt 30, and 67 is a cleaning blade working as cleaning means for removal of the remnants of toner on the surface of the intermediate transfer belt 30 after secondary transfer.

It is here noted that the reasons why the black developing device 44K is located on the uppermost stream side of the intermediate transfer belt 30 in its endless direction and the yellow developing device 44Y is positioned on the lowermost stream side are that when the toner image is transferred onto the recording medium P, black causes the most noticeable fogging whereas yellow causes the least noticeable fogging. In the case of reversal development or the like, fogging is caused by toner particles that are allowed to bear charges of polarity opposite to normal polarity at the developing device. However, black toner particles showing the most noticeable fogging are first transferred onto the intermediate transfer belt 30 as the lowermost layer. Of the black toner particles, fogging-prone toner particles remain firmly deposited onto the intermediate transfer belt 30 by means of image force or the like, so that they are less likely to be transferred onto the recording medium P at the secondary transfer site. On the other hand, toner particles that cause the least noticeable yellow fogging are deposited onto the intermediate transfer belt 30 as the uppermost layer. Although they are easily passed onto the recording medium P, yet they are less noticeable. Such an arrangement as explained above ensures that fogging is generally less noticeable because the black toner particles leading to the most noticeable fogging are relatively less likely to be passed onto the recording medium P whereas the yellow toner particles leading to the least noticeable fogging are passed onto the recording medium P with relative ease.

Since a mono-component developing agent such as a non-magnetic mono-component toner is used, there is no need of using a carrier such as a two-component developing agent. Accordingly, it is possible to reduce the volume of each developing device 44 (K, C, M, Y) and so achieve a color image formation system of small size.

Figure 16:
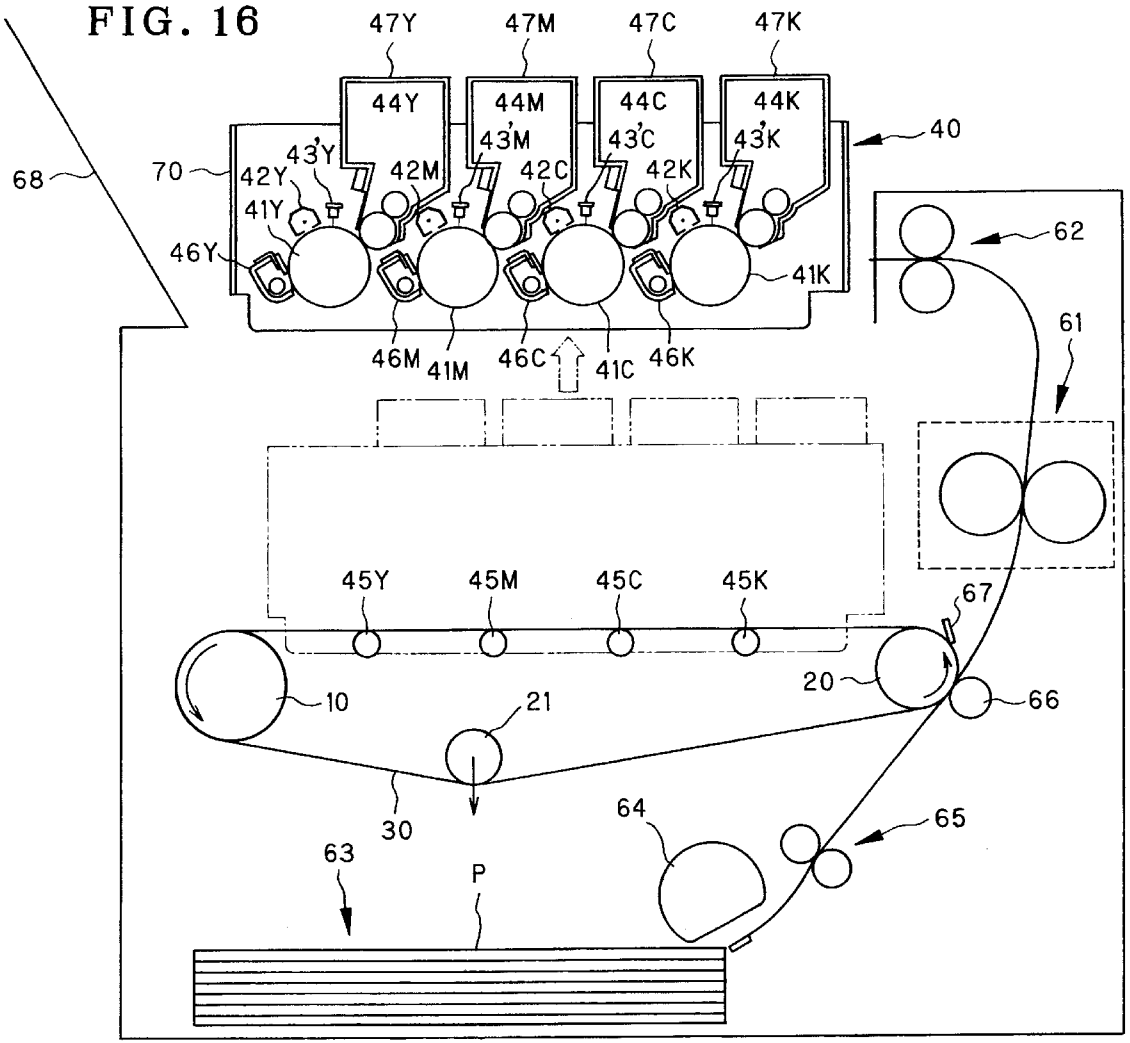
FIG. 16 is illustrative of the system proper, from which the photosensitive member cartridge has been withdrawn.

In such a color image formation system as constructed as explained above according to the present invention, the four photosensitive members 41K, 41C, 41M and 41Y, each provided therearound with the corona charger 42 (K, C, M, Y), exposure device 43' (K, C, M, Y) and the cleaning device 46 (K, C, M, Y), are constructed in the form of an integral cartridge 40 that can be detached from or attached to the system proper, as shown in FIGS. 15 and 16. In this case, the developing devices 44K, 44C, 44M and 44Y that are appendixes to the photosensitive members 41K, 41C, 41M and 41Y are detachable from and attachable to the photosensitive member cartridge 40.

Referring to FIG. 16, the photosensitive member cartridge 40 is provided on its frame 70 with the four photosensitive members 41K, 41C, 41M and 41Y and their appendixes, i.e., the corona chargers 42 (K, C, M, Y), exposure devices 43' (K, C, M, Y) and cleaning devices 46 (K, C, M, Y) while they are relatively. To withdraw this cartridge from the system proper, it is lifted up as shown by a double-arrow. To this end, the output tray 68 is mounted at its one end on the system proper in such a way that it can turn upwardly. The output tray 68 is retracted, thereby defining an opening through which the photosensitive cartridge 40 is withdrawn out of the system. In the state where the photosensitive member cartridge 40 has been withdrawn out of the system, the photosensitive members 41 (K, C, M, Y) are spaced away from the intermediate transfer belt 30 so that the photosensitive member cartridge 40 can be detached from the system and replaced by a new photosensitive member cartridge 40.

Figure 17:
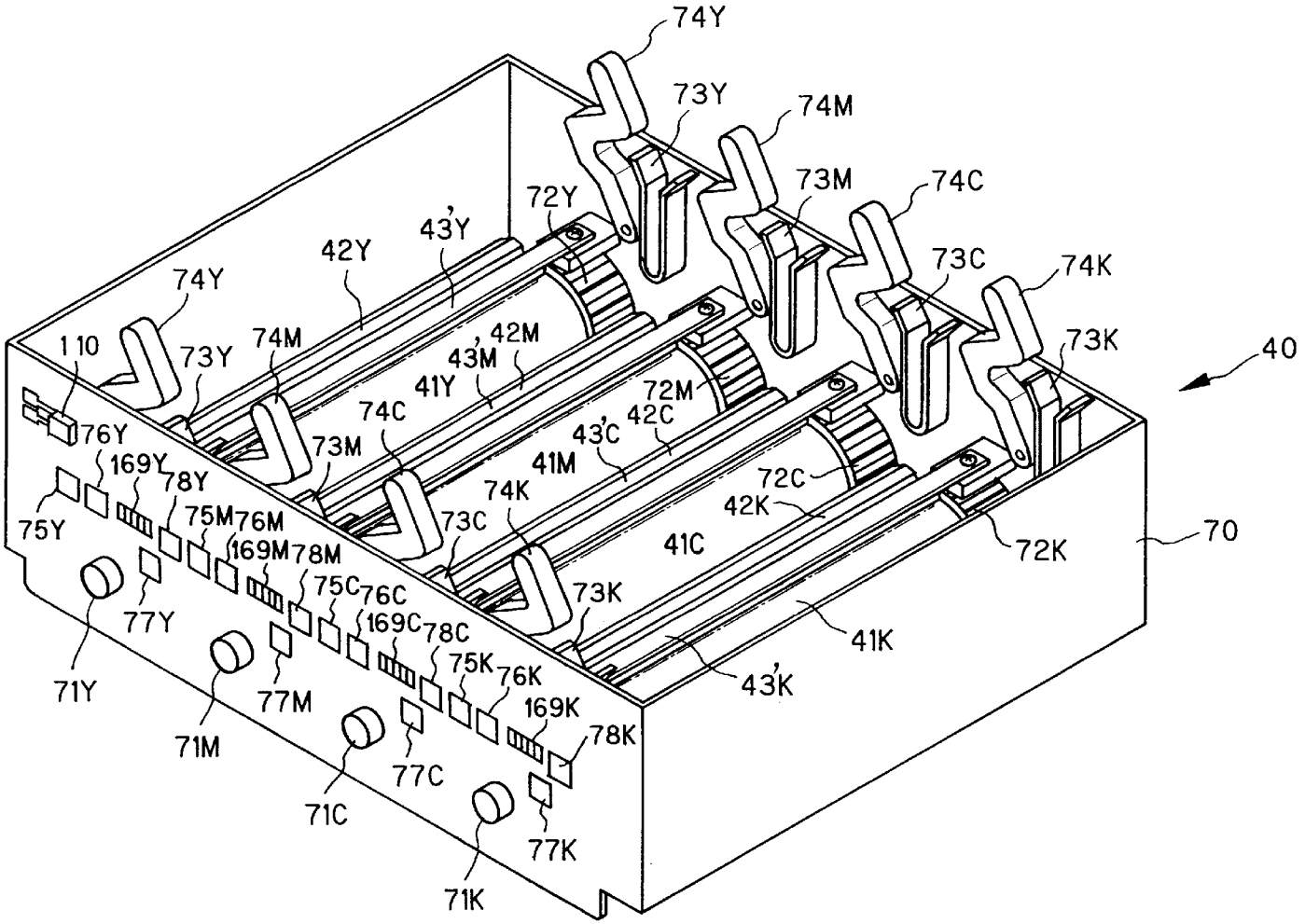
FIG. 17 is a perspective view of the photosensitive cartridge from which the developing devices are removed.

FIG. 17 is a perspective view of the photosensitive cartridge 40 from which the developing devices 44K, 44C, 44M and 44Y are removed, and FIG. 18 is a perspective view illustrative of how the developing device 44Y is detached from or attached to the photosensitive member cartridge 40 with the developing devices 44K, 44C and 44M remaining mounted thereon. The frame 70 is in a rectangular box form, between both sides plates of which there are four photosensitive members 41K, 41C, 41M and 41Y that are positioned at a given interval and parallel with one another for rotation on their shafts 71K, 71C, 71M and 71Y. The shaft 71 (K, C, M, Y) of each photosensitive member 41 (K, C, M, Y) is provided at its one end with a gear 72 (K, C, M, Y). By way of the gear train to be referred to later, the photosensitive members 41 (K, C, M, Y) are rotatable in the (clockwise) direction indicated by the arrow in FIG. 15 at the same speed and in synchronism with one another.

Between the same two side plates of the frame 70, the corona chargers 42 (K, C, M, Y), exposure devices 43' (K, C, M, Y) and cleaning devices 46 (K, C, M, Y) (which, in FIG. 17, are invisible because of being concealed by the photosensitive members 41 (K, C, M, Y) and frame 70), all appendixes to the photosensitive members 41 (K, C, M, Y), are mounted at given positions. On one side of the side plate of the frame 70 there are provided electrodes 75 (K, C, M, Y) for applying high voltages on the discharge wires of the corona chargers or Scorotrons 42 (K, C, M, Y) and electrodes 76 (K, C, M, Y) for applying high voltages on the grits of the Scorotrons. On the same one side of the side plate of the frame 70 there are also provided electrodes 169 (K, C, M, Y) for applying light emission control signals on the LED line heads of the exposure devices 43' (K, C, M, Y) as well as electrodes 77 (K, C, M, Y) for applying developing bias voltages on the developing rollers 49 (K, C, M, Y) of the developing devices 44 (K, C, M, Y) in the state where the developing devices 44 (K, C, M, Y) mounted on the photosensitive member cartridge 40 and electrodes 78 (K, C, M, Y) for applying developing feed bias voltages on the feed rollers 48 (K, C, M, Y) in the same state. On the same side plate, there is further provided an IC 110 as memory means for storing information about the fabrication and use of the photosensitive member cartridge 40, color misalignments, etc. Upon the photosensitive member cartridge 40 mounted on the system proper, the electrodes 75 (K, C, M, Y), electrodes 76 (K, C, M, Y), electrodes 169 (K, C, Y, M), electrodes 77 (K, C, M, Y), electrodes 78 (K, C, M, Y) and IC 110 are automatically connected to the power source circuit and control circuit of the system proper. In this state, the shafts 71 (K, C, M, Y) of the photosensitive members 41 (K, C, M, Y) are also automatically connected to ground for earth purposes.

At the inner upper sides of the same two side plates of the frame 70, there are provided guide grooves 73 (K, C, M, Y) for receiving the developing devices 44 (K, C, M, Y) at constant positions corresponding to the photosensitive members 41 (K, C, M, Y). To fix the developing devices 44 (K, C, M, Y) received along the guide grooves 73 (K, C, M, Y), fixing levers 74 (K, C, M, Y) are pivotally provided. On both sides of the developing cartridge 47 (K, C, M, Y) of each developing device 44 (K, C, M, Y), there are guide ridges 79 (K, C, M, Y) that are to be inserted in the associated guide grooves 73 (K, C, M, Y) from the upper open ends thereof (see FIG. 18 where only one guide ridge 79Y of the developing cartridge 47Y is visible). To mount the developing devices 44 (K, C, M, Y) on the associated photosensitive members 41 (K, C, M, Y), the guide ridges 79 (K, C, M, Y) are inserted from above into the associated guide grooves 73 (K, C, M, Y) and the fixing levers 74 (K, C, M, Y) are then pivoted to fix the developing devices in place. To remove the developing cartridges 47 (K, C, M, Y) for replacement or other purposes, the fixing levers 74 (K, C, M, Y) are pivoted back to guide the developing cartridges 47 (K, C, M, Y) upward along the guide grooves 73 (K, C, M, Y).

According to the embodiment of FIG. 18, the developing cartridges 47 (K, C, M, Y) forming part of the individual developing devices 44 (K, C, M, Y) can separately be attached to or detached from the associated photosensitive members 41 (K, C, M, Y); of the developing devices 44 (K, C, M, Y), only an exhausted or dead developing device(s) can be replaced with no wasteful replacement of the rest, so that running cost reductions are achievable.

Figure 19:
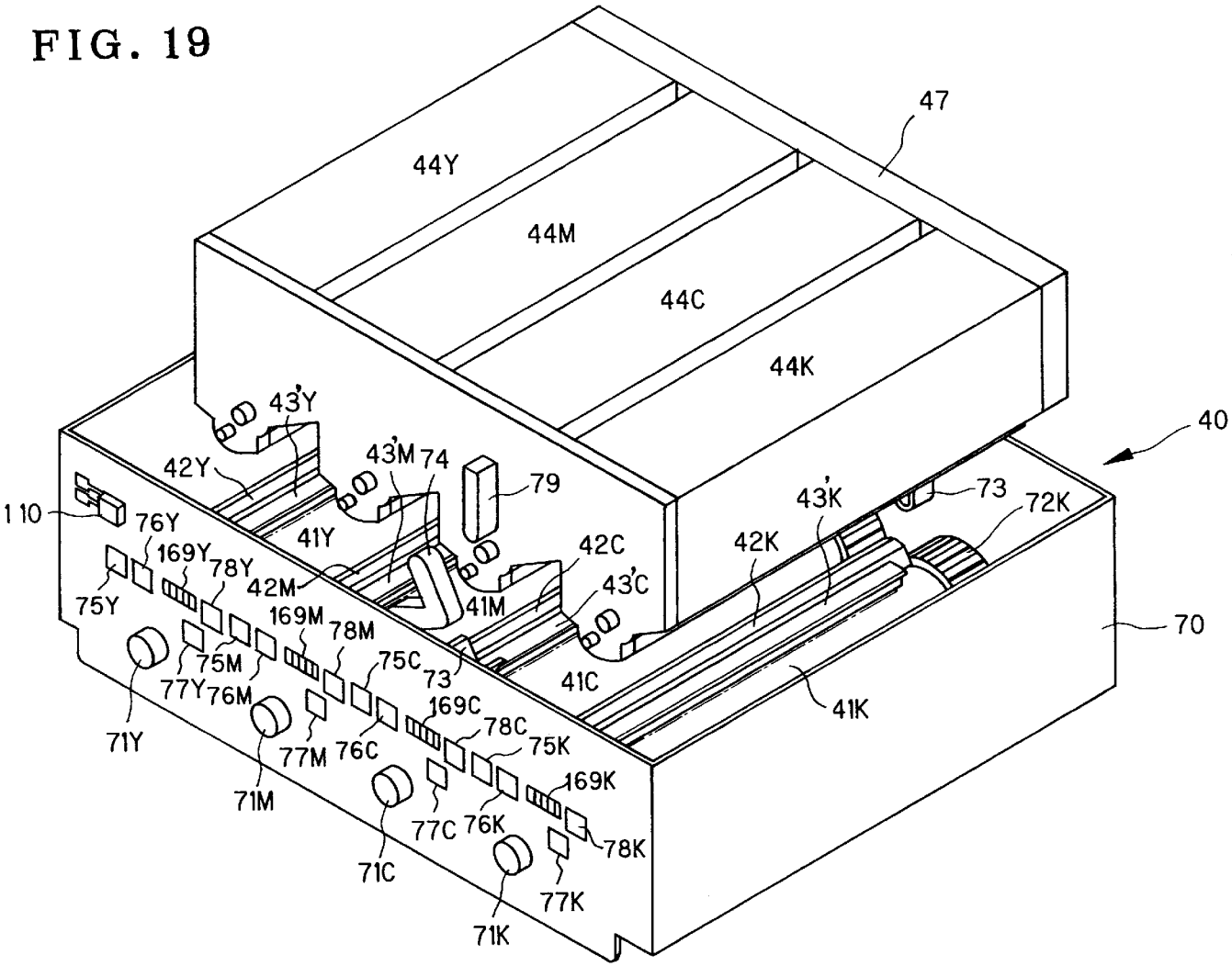
FIG. 19 is a perspective view illustrative of the attachment/detachment mechanism for one embodiment where all developing devices are constructed in the form of an integral developing cartridge.

FIG. 19 is a perspective view illustrative of the attachment/detachment mechanism for an embodiment of the invention wherein four or black, cyan, magenta and yellow developing devices 44 (K, C, M, Y) are constructed in the form of an integral development cartridge 47 for such a photosensitive member cartridge 40 as described above. In this embodiment, only one pair of guide grooves 73 are provided at the inner upper sites of both side plates of the frame 70 of the photosensitive member cartridge 40, spanning between both side plates. Accordingly, only one pair of pivotal fixing levers 74 are provided. On the other hand, the four developing devices 44 (K, C, M, Y) are constructed in the form of an integrated single developing cartridge 47. On each side of the developing cartridge 47 there is mounted a guide ridge 79 that is to be inserted into the associated guide groove 73 from the upper open end thereof (in FIG. 19, one guide ridge 79 alone is visible). To mount the developing cartridge 47 on the photosensitive member cartridge 40, the guide ridges 79 are inserted from above into the guide grooves 73 and the fixing levers 74 are then pivoted to fix the developing cartridge in place. To remove the developing cartridge 47 for replacement or other purposes, the fixing levers 74 are pivoted back so that the developing cartridge 47 can be guided upward along the guide grooves 73.

The embodiment of FIG. 19, wherein the four or black, cyan, magenta and yellow developing devices 44 (K, C, M, Y) are designed as the integral developing cartridge 47, has the merit of reducing the number of consumable parts, thereby improving the integrity of maintenance and avoiding a risk of anything wrong happening upon mounting.

Figure 20:
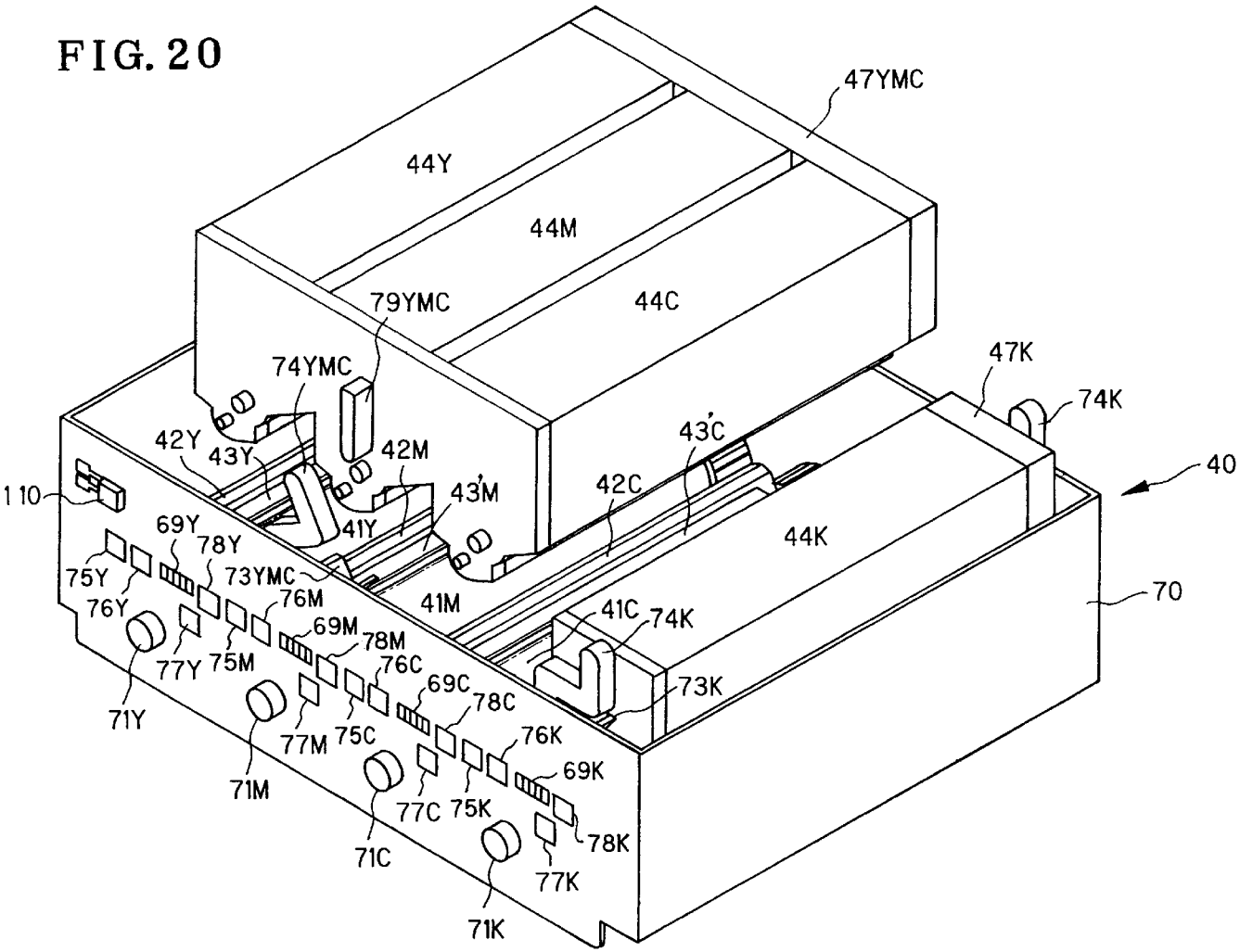
FIG. 20 is a perspective view illustrative of the attachment/detachment mechanism for an embodiment of the invention, wherein the black developing device is constructed in the form of a single developing cartridge and the remaining developing devices are constructed in the form of an integral developing cartridge.

FIG. 20 is a perspective view illustrative of the attachment/detachment mechanism for such a photosensitive member cartridge 40 as described above, wherein a black developing device 44K is constructed in the form of one single developing cartridge 47K that is detachable from or attachable to a black photosensitive member 41K as is the case with FIG. 17 or FIG. 18, and three or cyan, magenta and yellow developing devices 44 (C, M, Y) are constructed in the form of an integral developing cartridge 47YMC. At the inner upper sites of both side plates of a frame 70 of the photosensitive member cartridge 40 there are provided guide grooves 73K for receiving the developing cartridge 47K between both side plates and guide grooves 73YMC for receiving the developing cartridge 47YMC, and there are provided pivotal fixing levers 74K and 74YMC, accordingly. On the other hand, the black photosensitive member cartridge 40 is provided on both its sides with guide ridges 79K and the three-color developing cartridge 47YMC is provided on both its sides with guide ridges 79YMC (in FIG. 20, only one guide ridge 79YMC is visible on the developing cartridge 47YMC). To mount the developing cartridge 47K or 47YMC on the photosensitive member cartridge 40, the guide ridges 79K or 79YMC are inserted from above into the guide grooves 73K or 73YMC, whereupon the fixing levers 74K or 74YMC are pivoted to fix the developing cartridge in place. To remove the developing cartridge 47K or 47YMC for replacement or other purposes, the fixing levers 74K or 74YMC are pivoted back so that the developing cartridge 47K or 47YMC can be guided upward along the guide grooves 73K or 73YMC.

The embodiment of FIG. 20, wherein the three-color or cyan, magenta and yellow developing devices 44 (C, M, Y) are constructed in the form of the integral developing cartridge 47YMC, has the merit of removing the number of consumable parts, thereby improving the integrity of maintenance and avoiding a risk of anything wrong happening upon mounting. This embodiment has another merit of preventing the three-color or cyan, magenta and yellow developing devices 44 (C, M, Y) from going to waste, because the black developing device 44K most frequently used in general can be replaced in the form of the independent developing cartridge 47K.

Figure 21:
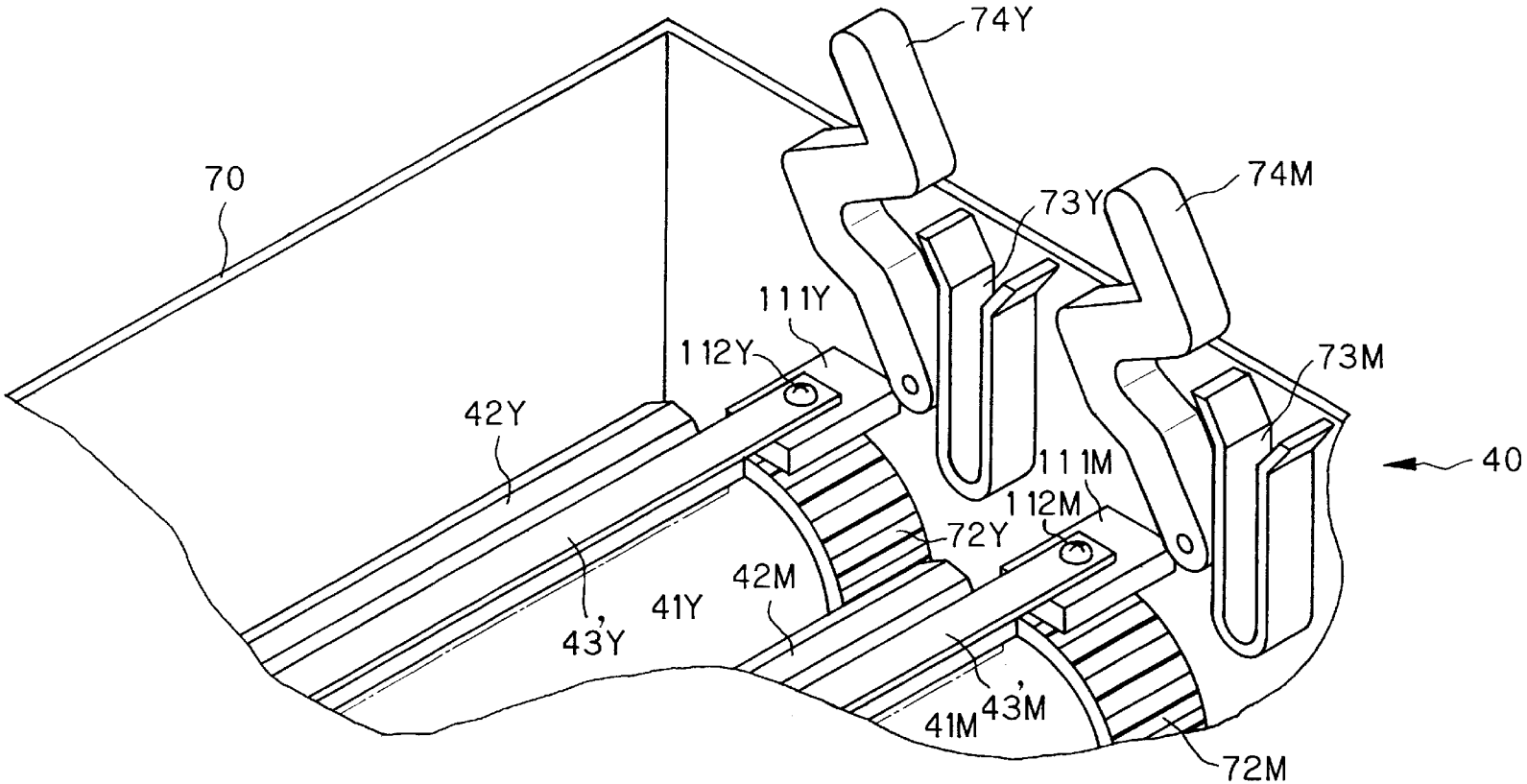
FIG. 21 is illustrative of one embodiment of how exposure devices are attached to the frame of the photosensitive member cartridge.

In the second aspect of the invention as explained above, the frame 70 of the photosensitive member cartridge 40 is provided with the four photosensitive members 41K, 41C, 41M and 41Y and the appendixes thereto, i.e., the corona chargers 42 (K, C, M, Y), exposure devices 43' (K, C, M, Y) and cleaning devices 46 (K, C, M, Y) while they are relatively positioned, as shown in FIG. 17. FIG. 21 is illustrative of one embodiment of how the exposure devices 43' (K, C, M, Y) are attached to the frame 70 of the photosensitive member cartridge 40. To be specific, FIG. 21 is a partly enlarged perspective view of only one end portions of the photosensitive members 41Y and 41M in the photosensitive member cartridge 40. To mount the exposure devices 43' (K, C, M, Y) at precisely located positions on the associated photosensitive members 41 (K, C, M, Y) and parallel therewith, mounting struts 111 (K, C, M, Y) are provided, extending from the inside surfaces of both side plates of the frame 70 and opposing to each other. Each strut 111 (K, C, Y, M) is provided with locating holes for receiving locating pins and threaded holes, both holes not shown. Locating pins 115 provided at both ends of a long-length substrate 113 (FIG. 22) of each exposure device 43' (K, C, M, Y) are inserted into the locating holes in the associated mounting strut 111 (K, C, M, Y) while fixing screws 112 (K, C, M, Y) are fixedly screwed into the threaded holes in the mounting strut 111 (K, C, M, Y) through screw-insertion holes in both ends of the long-length substrate 113 (FIG. 22), so that the each exposure device 43' (K, C, M, Y) is fixed in place.

Figure 22:
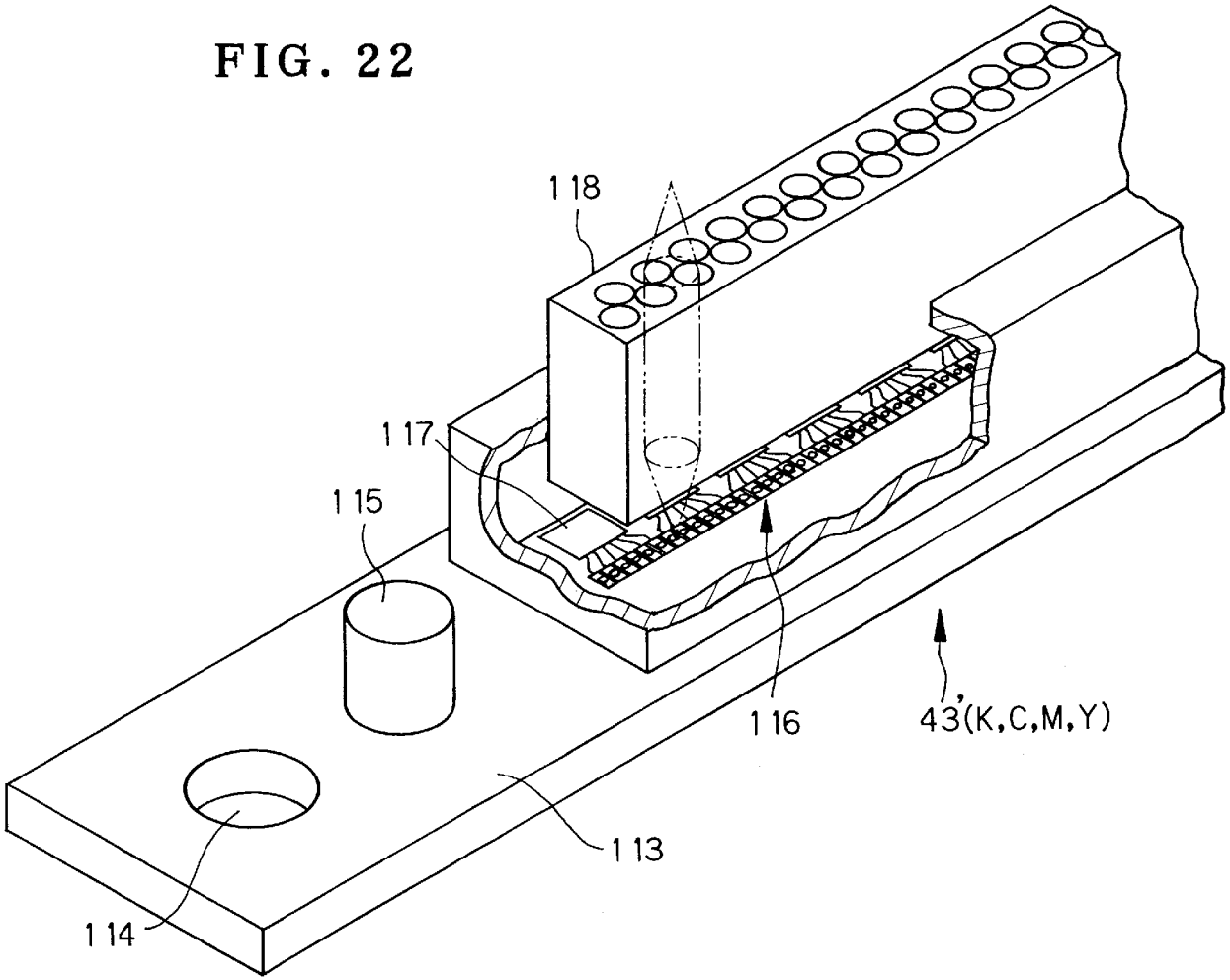
FIG. 22 is a perspective schematic illustrative of how the exposure devices are each constructed in the form of an LED line head comprising an LED array.

FIG. 22 is a perspective schematic of each exposure device 43' (K, C, M, Y) constructed in the form of an LED line head comprising an LED array 116. As mentioned above, each exposure device 43' (K, C, M, Y) is mounted on the long-length substrate 113, spanning between both side plates of the frame 70. The LED array 116 for forming a line image on the photosensitive member 41 (K, C, M, Y) and parallel with its axis is mounted on the long-length substrate 113, with each LED connected to a driver IC 117 for controlling light emission. The long-length substrate 113 is provided at each end with a locating pin 115 for the determination of a mounting position and a hole 114 for the insertion of a mounting screw. Thus, each exposure device is fixed at a precise position for the associated photosensitive member 41 (K, C, M, Y). In front of the LED array 116 there is integrally fixed a gradient index type rod lens array 118 having an image-formation action, by which a train of light emission points defined by the LED array 116 are allowed to form an image on the photosensitive surface of the associated photosensitive member 41 (K, C, M, Y).

Next, an account is given of the mechanism of, upon the photosensitive member cartridge 40 mounted on the system proper, rotating the photosensitive members 41K, 41C, 41M and 41Y in the cartridge 40 in synchronism with one another, thereby preventing any color misalignment. FIG. 7 is illustrative of one construction for achieving this. As already mentioned, the shafts 71 (K, C, M, Y) of the photosensitive members 41 (K, C, M, Y) are mounted at their one ends with gears 72K, 72C, 72M and 72Y, respectively, which are molded using the same mold. Three idles gears for transmission of rotational force are provided; an idle gear 81 is interposed between the gears 71K and 72C, an idle gear 82 between the gears 72C and 72M, and an idle gear 83 between the gears 72M and 72Y, forming a gear train. A driving gear 91 in mesh with one gear in this gear train, for instance, gear 72Y, is disposed at a driving source 90 on the side of the system proper, so that upon the photosensitive cartridge 40 mounted at a given position, the driving gear 91 meshes with the gear 72Y.

On the other hand, the shaft of the developing roller 49 (K, C, M, Y) of the developing device 44 (K, C, M, Y) is fixedly provided at its one end with a developing roller gear 84 (K, C, M, Y), and the shaft of the feed roller 48 (K, C, M, Y) is fixedly provided at its one end with a feed roller gear 85 (K, C, M, Y). An idle roller 86 (K, C, M, Y) is interposed between the developing roller gear 84 (K, C, M, Y) and the feed roller gear 85 (K, C, M, Y). The developing roller gear 84 (K, C, M, Y) meshes with the gear 72 (K, C, M, Y) of the photosensitive member 41 (K, C, M, Y), so that the developing roller 49 (K, C, M, Y) and feed roller 48 (K, C, M, Y) of the developing device 44 (K, C, M, Y), too, can be rotationally driven in synchronism with the photosensitive member 41 (K, C, M, Y).

By rotating the driving gear 91 of the driving source at one site on the side of the system proper according to this arrangement, it is possible to rotationally drive the four photosensitive members 41 (K, C, M, Y) and the appendixes thereto, i.e., the developing rollers 49 (K, C, M, Y) and feed rollers 48 (K, C, M, Y) of the developing devices 44 (K, C, M, Y), all in synchronism with one another.

This embodiment ensures that the operating efficiency of attachment/detachment of the photosensitive member cartridge 40 is improved because the point of meshing of the gears for transmission of driving force upon attachment/detachment of the photosensitive member cartridge 40 is limited to one. Since the positioning criterion for the photosensitive member cartridge 40 is defined by this driving force transmission gear 91, it is also possible to improve the precision of meshing and, hence, provide a system for forming high-quality images that are substantially free from any color misalignment or any banding (variations in densities, etc. at right angles with the feed direction).

It is understood that the mechanism for synchronized transmission of rotational force for the photosensitive members 41K, 41C, 41M and 41Y is not limited to such a gear train as shown, and so may be constructed using a belt or chain, for instance.

FIG. 9 is illustrative of one modification to the embodiment of FIG. 8. FIG. 9 is a schematic of the rotation transmission portion comprising the gear 91, gear 92, clutch 93 and gears 94 to 96 of FIG. 8 as viewed from above. In this modification, the driving gear 91 of the driving source (FIG. 7) on the side of the system proper is designed to mesh with the gear 72K via the gear 92, with the omission of the idle gear 81 interposed between the gears 72K and 72C. Instead, a rotation transmission mechanism comprising the gear 92, clutch 93 and gears 94 to 96 as shown in FIG. 9 is interposed between the gear 72K and 72C. As the clutch 93 is put on, the rotational force of the gear 92 is transmitted to the gear 94 and then to gear 95 in mesh with that gear 94, so that rotation in the same direction as is the case with the gear 72K is transmitted to the gear 72C via the gear 96 interposed between that gear 95 and the gear 72C. The rotation of the gears 72M and 72Y is transmitted as is the case with FIG. 7. It is here noted that since the gears 92, 94 and 96 are molded using the same mold, the four photosensitive members are rotationally driven in synchronism and at the same speed.

In this modification, as the clutch 93 is put off, the rotation of the driving gear 91 is transmitted to only the black developing device 44K, so that other developing devices 44 (C, M, Y) remain inoperative. When only a black image is formed, therefore, there is only the need of putting the black photosensitive member 41K and the associated developing device 44K in effective operation; other photosensitive members 41 (C, M, Y) and the associated developing devices 44 (C, M, Y), which are not required to be placed in operation, are rendered inoperative. It is thus possible to prevent unnecessary consumption of the developing devices 44 (C, M, Y), thereby extending their service lives.

FIGS. 10 and 11 are illustrative of an embodiment of the invention, wherein the photosensitive member cartridge 40 is mounted on the system proper and the photosensitive members 41 (K, C, M, Y) and developing devices 44 (K, C, M, Y) of the photosensitive member cartridge 40 are driven by means of separate driving sources. FIG. 10 is similar to FIG. 7. In this embodiment, the developing roller gears 84 (K, C, M, Y) of the developing devices 44 (K, C, M, Y) are not in mesh with the gears 72 (K, C, M, Y) of the photosensitive members 41 (K, C, M, Y) or separated therefrom, as can be seen from FIG. 10. The embodiment of FIG. 10 is different from that of FIG. 7 only in terms of the gear train of the photosensitive member cartridge 40. By rotating the driving gear 91 of the driving source 90 on the side of the system proper, the four photosensitive members 41 (K, C, M, Y) can thus be rotationally driven in synchronism, as can be see from FIG. 10. Although depending on the driving force of that driving source 90, however, the developing roller 49 (K, C, M, Y) and feed roller 48 (K, C, M, Y) of the developing device 44 (K, C, M, Y) are kept from rotation. In this embodiment, there is another driving source 100 at another site on the side of the system proper, as shown in FIG. 11. When the photosensitive member cartridge 40 is mounted at a given position of the system proper, four gears 101 (K, C, M, Y) of the separate driving source 100, designed to rotate in synchronism and in the same direction, are positioned in such a way that they mesh with the developing roller gears 84 (K, C, M, Y) fixed at one ends of the shafts of the developing rollers 49 (K, C, M, Y) of the developing devices 44 (K, C, M, Y) mounted on the photosensitive member cartridge 40. Thus, the developing devices 44 (K, C, M, Y) are rotationally driven by the driving source 100 that is separate from that for the photosensitive members 41 (K, C, M, Y).

In such an arrangement as shown in FIG. 15, color misalignments and image banding are largely dependent on the precision of rotation of the image carriers; however, they are less dependent on the precision of rotation of the developing rollers. Therefore, if the driving source 90 for the photosensitive member cartridges 41 (K, C, M, Y) of the photosensitive member cartridge 40 is made separate from the driving source 100 for the developing devices 44 (K, C, M, Y) as shown in FIGS. 10 and 11, it is then possible to prevent rotation variations caused as by fluctuations in the torque of developing means from having influences on the rotation of the image carriers and, hence, provide a system for forming high-quality images with neither color misalignments nor image banding.

Figure 23:
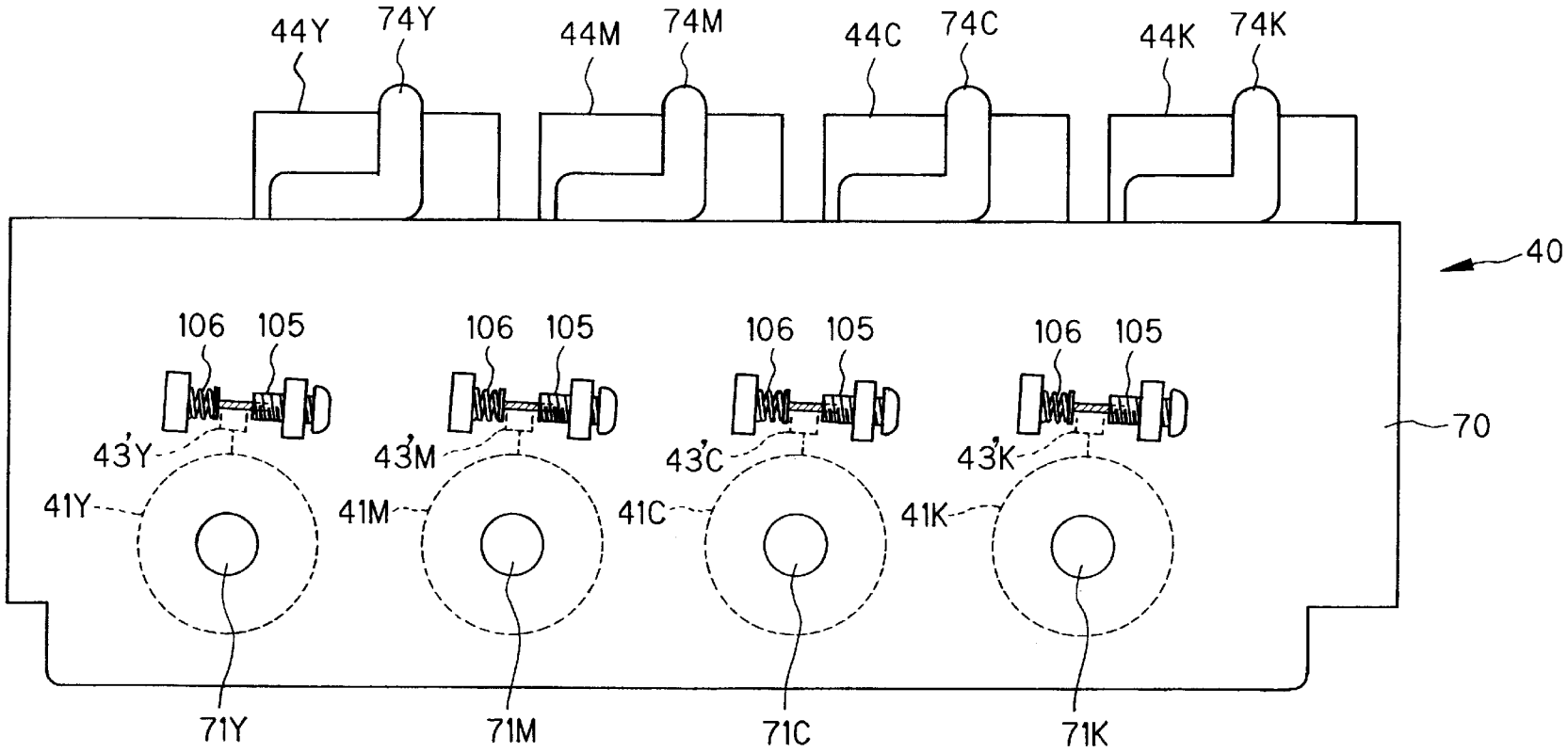
FIG. 23 is illustrative of an embodiment of regulating color misalignments for the photosensitive member cartridge.

FIG. 23 is illustrative of one embodiment of the mechanism for adjusting color misalignments occurring due to relative position misalignments between the exposure devices 43'K, 43'C, 43'M and 43'Y positioned and mounted on the photosensitive members 41 (K, C, M, Y), especially skews in parallelism, when four different monochromatic toner images are transferred onto the intermediate transfer belt 30 in a superposed fashion. As shown in FIG. 23, while the mounting ridge 111 (K, C, M, Y) of each exposure device 43' (K, C, M, Y) extending from one side plate of the frame 70 or a long-length substrate 113 is sandwiched between an adjustment screw 105 and the leading end of an extensible spring 106, the other end of the extensible spring 106 is fixed to the side plate 70. In this state, if the leading end of the adjustment screw 105 is adjustable in the direction opposite to the direction of extension of the extensible spring 106 to adjust the position of one end of the exposure device 43' (K, C, M, Y), it is then possible to adjust skews in parallelism between the exposure devices 43'K, 43'C, 43'M and 43'Y. It is not always required to provide all the four exposure devices 43'K, 43'C, 43'M and 43'Y with such color misalignment adjustment mechanisms. It is noted that it is acceptable to provide the opposite ends of the exposure devices 43' (K, C, M, Y) with such color misalignment adjustment mechanisms. However, this is not always necessary because misalignments can be electrically eliminated by controlling the timing of when color latent images formed at the exposure devices 43' (K, C, M, Y) are to be written, as long as given parallelism is maintained between the exposure devices 43' (K, C, M, Y).

By providing the photosensitive member cartridge 40 with the position alignment mechanism for the exposure devices 43' (K, C, M, Y) in this way, it is possible to make fine adjustments of the positions of the photosensitive members 41 (K, C, M, Y) onto which latent images are to be written and transferred, thereby reducing color misalignments. It is here noted that the color misalignment adjustment by this color (position) misalignment adjustment mechanism may be made upon shipment of the photosensitive member cartridge 40 or anytime after its attachment to the system proper.

Figure 24:
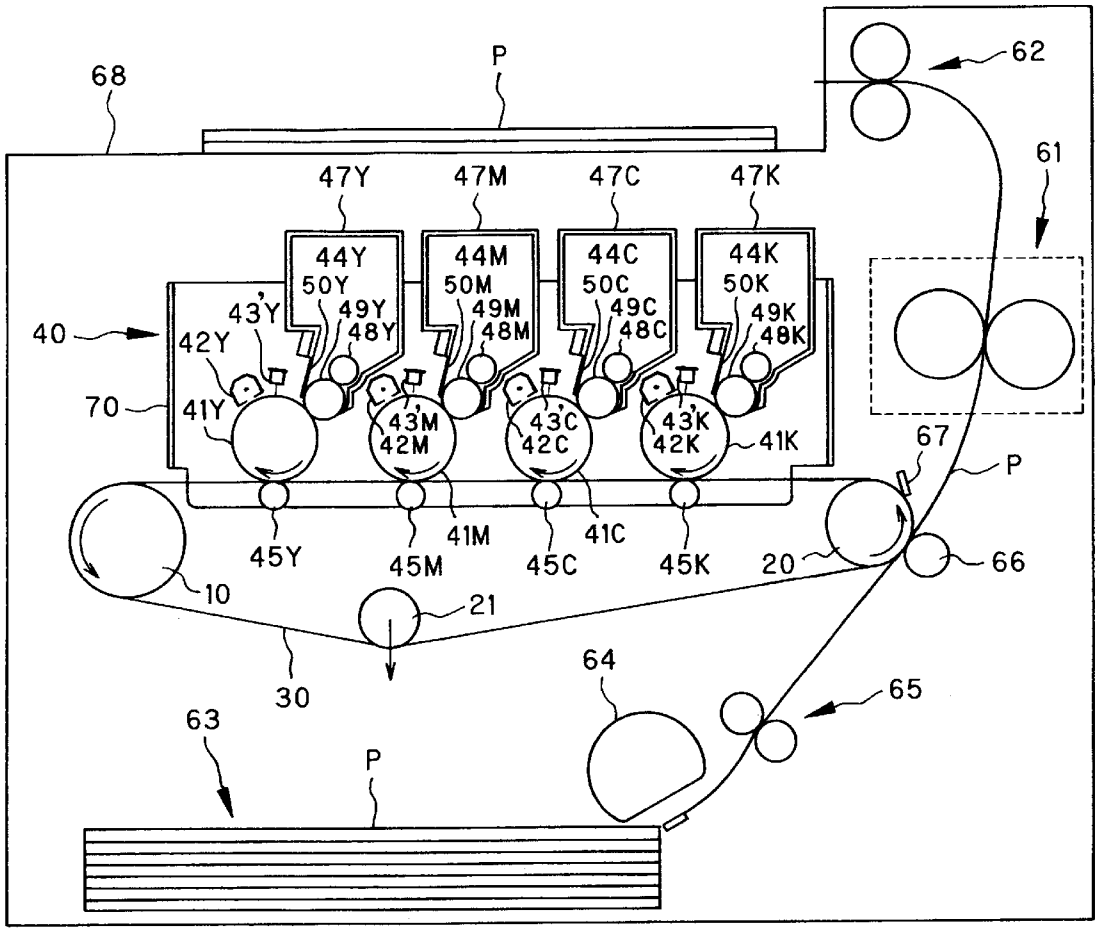
FIG. 24 is a front schematic illustrative of the whole construction of an embodiment of the color image formation system making use of a "cleaner-less" mode.

Referring now to an electrographic system wherein latent images formed on image carriers are toner developed and the resulting toner images are transferred onto transfer media, there is a so-called "cleaner-less" mode wherein the remnants of toner not transferred onto the image carriers are recovered at developing devices without recourse to such cleaning devices as shown in FIG. 15 (for instance, see JP-B 06-77166). This "cleaner-less" mode is embodied as shown in FIG. 24, dispensing with the cleaning devices 46 (K, C, M, Y). The embodiment of FIG. 24 is the same in construction as that of FIG. 15 with the exception of the absence of the cleaning devices 46 (K, C, M, Y); any detailed account of its construction and action is not given. The construction of the photosensitive member cartridge 40 in this embodiment, too, is the same as that of FIGS. 15 and 16 with the exception of the absence of the cleaning devices 46 (K, C, M, Y); four photosensitive members 41K, 41C, 41M and 41Y are integrated with corona chargers 42 (K, C, M, Y) disposed around them and exposure devices 43' (K, C, M, Y).

By use of the mode that dispenses with any cleaning device, it is possible to reduce the size of the photosensitive member cartridge 40 and the system proper. In addition, it is possible to diminish reaction force that may otherwise act on the photosensitive members 41 (K, C, M, Y) through the blades, etc. of cleaning devices, resulting in prevention of color misalignments. This is because the frame 70 is kept from deformation so that any position misalignment between the photosensitive members 41 (K, C, M, Y) can be avoided.

Figure 25:
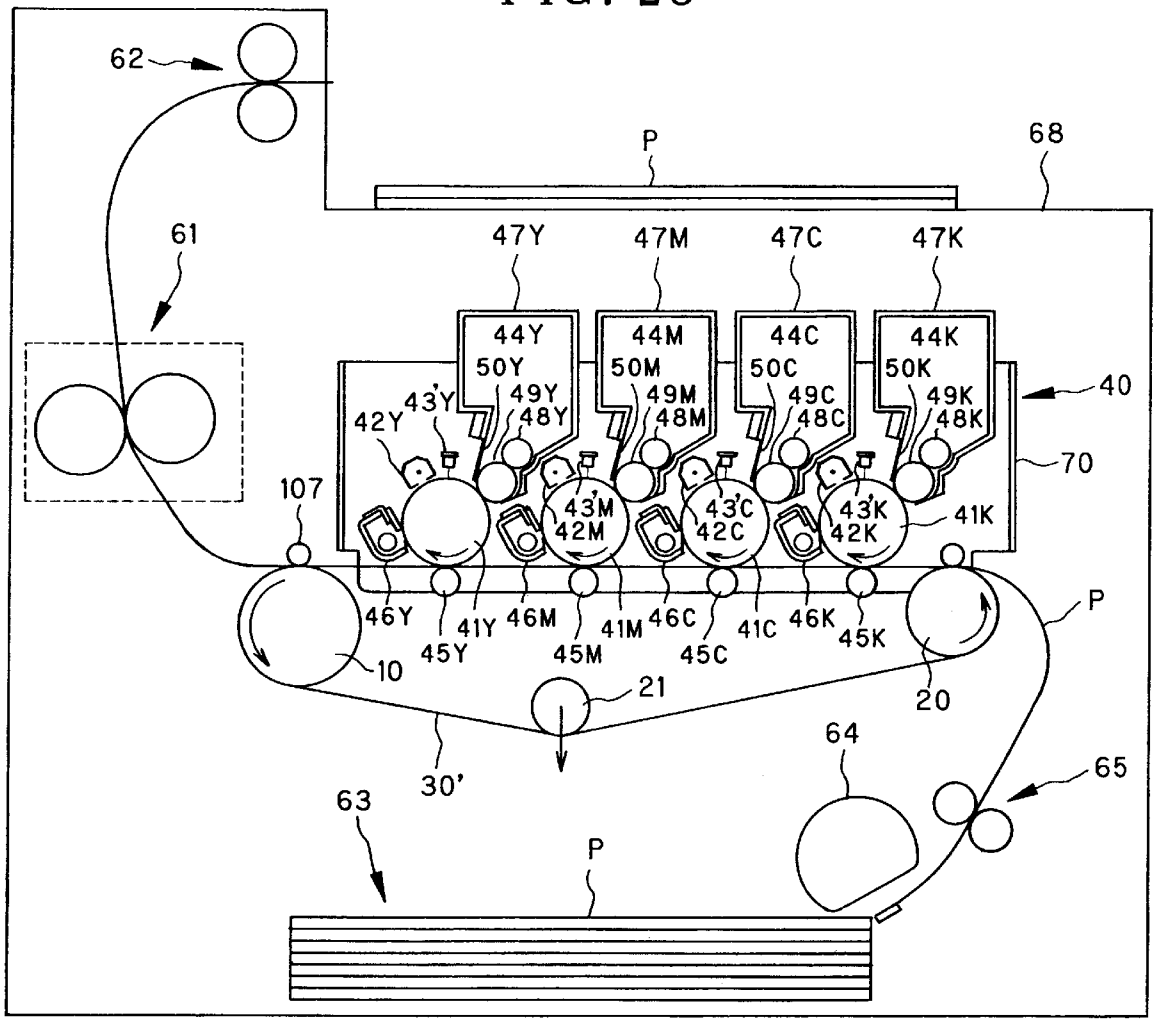
FIG. 25 is a front schematic illustrative of the whole construction of an embodiment of the color image system using a recording medium carrier belt in place of the intermediate transfer belt.

The present invention has been explained with reference to some embodiments applied to the tandem system for forming color images using the intermediate transfer belt 30 (FIG. 15), wherein four photosensitive members 41 (K, C, M, Y) are integrated into the photosensitive member cartridge 40 according to the present invention. It is here noted that instead of the intermediate transfer belt, it is acceptable to use a recording medium carrier belt. In this case, the recording medium carrier belt is used to carry and deliver recording media such as recording sheets. A plurality of monochromatic toner images are successively transferred directly onto a recording sheet, followed by the fixation of toner images of different colors which are superposed one upon another on the recording medium. A typical example of this is shown in FIG. 25. The embodiment of FIG. 25 is the same as that of FIG. 15 with the exception of the following points. Instead of the intermediate transfer belt 30 of FIG. 1, a recording medium carrier belt 30' is used to carry and deliver a recording medium (sheet) P. The recording sheets from a sheet feed cassette 63 are picked up by a pickup roller 64 on a one-by-one basis, and the feed timing of the recording sheet is controlled by a pair of gate rollers 65 in such a way that it is in synchronism with electrostatic latent images formed on the photosensitive members 41 (K, C, M, Y). Toner images formed on the photosensitive members 41 (K, C, M, Y) are successively transferred and superposed onto the recording medium P being delivered under the action of primary transfer rollers 45 (K, C, M, Y). Then, the recording medium P bearing the resulting full-color image thereon is released from the recording medium carrier belt 30' by a release roller 107, and passes between a pair of fixing rollers 61 defining a fixing portion, where the full-color toner image is fixed onto the recording medium P. Finally, the recording medium is ejected via a pair of ejecting rollers 62 onto an output tray 68 mounted on the upper portion of the system. The construction of the photosensitive member cartridge 40 in particular is the same as that of FIG. 1 or the like. To those skilled in the art, it would be apparent that any one of the aforesaid embodiments can be applied to the tandem type of color image formation system where recording media are carried and delivered by such a recording medium carrier belt, not by the intermediate transfer belt, and toner images are transferred onto the recording media.

In the aforesaid embodiments, the LED line head comprising such an LED array as shown in FIG. 22 is used for the exposure device 43' (K, C, M, Y) that are integrally mounted together with the photosensitive member 41 (K, C, M, Y) on the photosensitive member cartridge 40. However, it is acceptable to make use of an organic EL line head comprising an organic EL array such as one proposed by the applicant in Japanese Patent Application No. 2001-208076 or the like or a liquid crystal line head comprising a liquid crystal shutter array.

Figure 26:
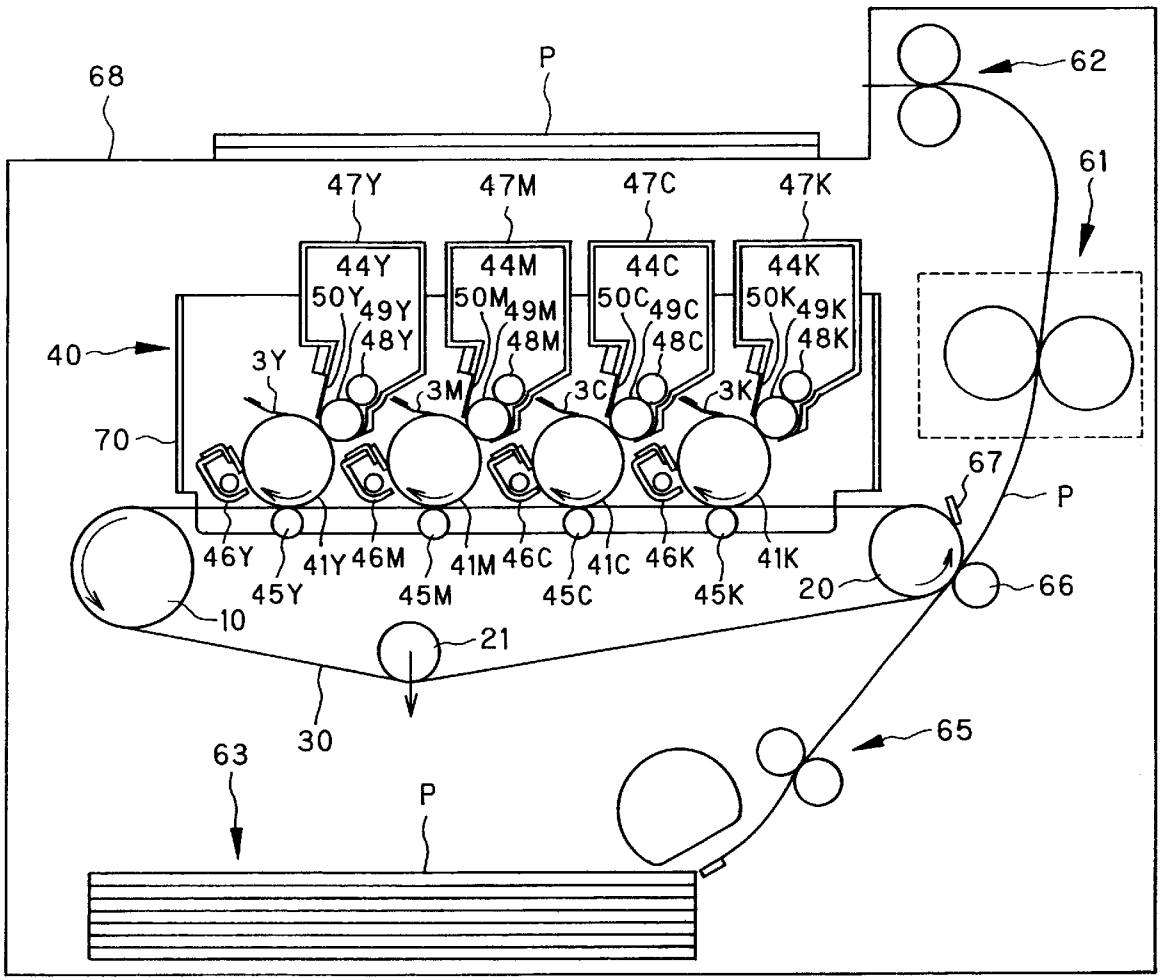
FIG. 26 is a front schematic illustrative of the whole construction of an embodiment of the color image formation system using a charge injection electrode line head as write means.

The write means that are integrally mounted together with the photosensitive members 41 (K, C, M, Y) on the photosensitive member cartridge 40 are not necessarily limited to optical write means. For instance, it is acceptable to make use of write means having recourse to charge transfer such as injection or elimination of charges, for instance, those proposed by the applicant in Japanese Patent Application Nos. 2000-298925 and 2000-298927, etc. FIG. 26 is a front schematic illustrative of the whole construction of a color image formation system wherein charge injection electrode line heads 3 (K, C, M, Y) are used as write means, and FIG. 18 is a perspective schematic illustrative of how the charge injection line heads 3 (K, C, M, Y) are arranged and constructed with respect to photosensitive members 41 (K, C, M, Y). When writing is carried out by the injection of charges, it is not always necessary to use the chargers 42 (K, C, M, Y) of FIG. 15. Accordingly, a photosensitive cartridge 40 of FIG. 26 is constructed without recourse to any charger. Alternatively, instead of the exposure devices 43' (K, C, M, Y), such charge injection electrode line heads 3 (K, C, M, Y) as shown in FIG. 18 are disposed. The charge injection electrode line head 3 (K, C, M, Y) comprises an array of electrodes 3*b* that come in contact with the associated photosensitive member 41 (K, C, M, Y) to create a potential profile therein and so form a latent image. Charges injected into each electrode 3*b* are controlled by a driver IC 119. The construction of FIG. 26 is otherwise the same as that of FIG. 15, and so is not explained.

In accordance with the inventive color image formation system wherein, as explained above, a plurality of photosensitive members 41 (K, C, M, Y) and a plurality of write means 43' (K, C, M, Y) or 3 (K, C, M, Y) are mutually positioned and mounted on a photosensitive member cartridge 40 detachable from and attachable to the system proper and developing devices 44 (K, C, M, Y) are disposed in such a way as to be detachable from and attachable to the photosensitive members 41 (K, C, M, Y) mounted on the photosensitive member cartridge 40, the precision of relative positions between the photosensitive members and the write means is so improved that color misalignments ascribable to misalignments between the photosensitive members or write means and skews thereof can be prevented.

Gears can be associated with the photosensitive members in such phase relations as to reduce speed fluctuations due to the gears that drive the photosensitive member, so that the cartridge 40 can be constructed in an integral form. In addition, color misalignments due to the photosensitive member-driving gears can be considerably reduced (FIG. 7 and so on). Where the photosensitive members are individually mounted on the system proper, it is impossible to make phase adjustments of such gears because the photosensitive members rotate by themselves.

Further, the photosensitive member cartridge 40 can be finished up using photosensitive members of uniform performance singled out at the time of shipping, so that color changes due to variations in the properties of the photosensitive members of different colors can be prevented. In addition, the integrity of maintenance can be improved because a plurality of photosensitive members can be replaced at the same time.

Furthermore, the arrangement wherein the developing devices 44 (K, C, M, Y) are designed as detachable from and attachable to the photosensitive member cartridge 40 ensures that the developing devices 44 (K, C, M, Y) can be replaced independently of the photosensitive member cartridge 40. Therefore, even when the developing devices 44 (K, C, M, Y) are exhausted or used up and so must be replaced with new ones, there is no need of making a replacement for the photosensitive members 41 (K, C, M, Y), so that running cost reductions are achievable.

What is necessary when the developing devices 44 (K, C, M, Y) are used up is only their replacement. There is no need of any color matching operation depending on the positions and configuration of the photosensitive members 41 (K, C, M, Y) and write means 43' (K, C, M, Y) or 3 (K, C, M, Y). It is thus possible to provide an image formation system having improved operating efficiency.

For replacement of the developing devices 44 (K, C, M, Y), only the withdrawal of the photosensitive member cartridge 40 is needed. Then, new developing devices are attached to the photosensitive member cartridge 40. Thus, the operation for replacement of the developing devices 44 (K, C, M, Y) is so facilitated that the integrity of maintenance can be improved.

It is also acceptable to construct a plurality of photosensitive members 41 (K, C, M, Y) in the form of one single replacement and the developing devices 44 (K, C, M, Y) in the form of one single replacement 47 (FIG. 19), so that the integrity of maintenance can be much more improved.

The color image formation system according to the third aspect of the present invention is now explained with reference to some embodiments.

Figure 28:
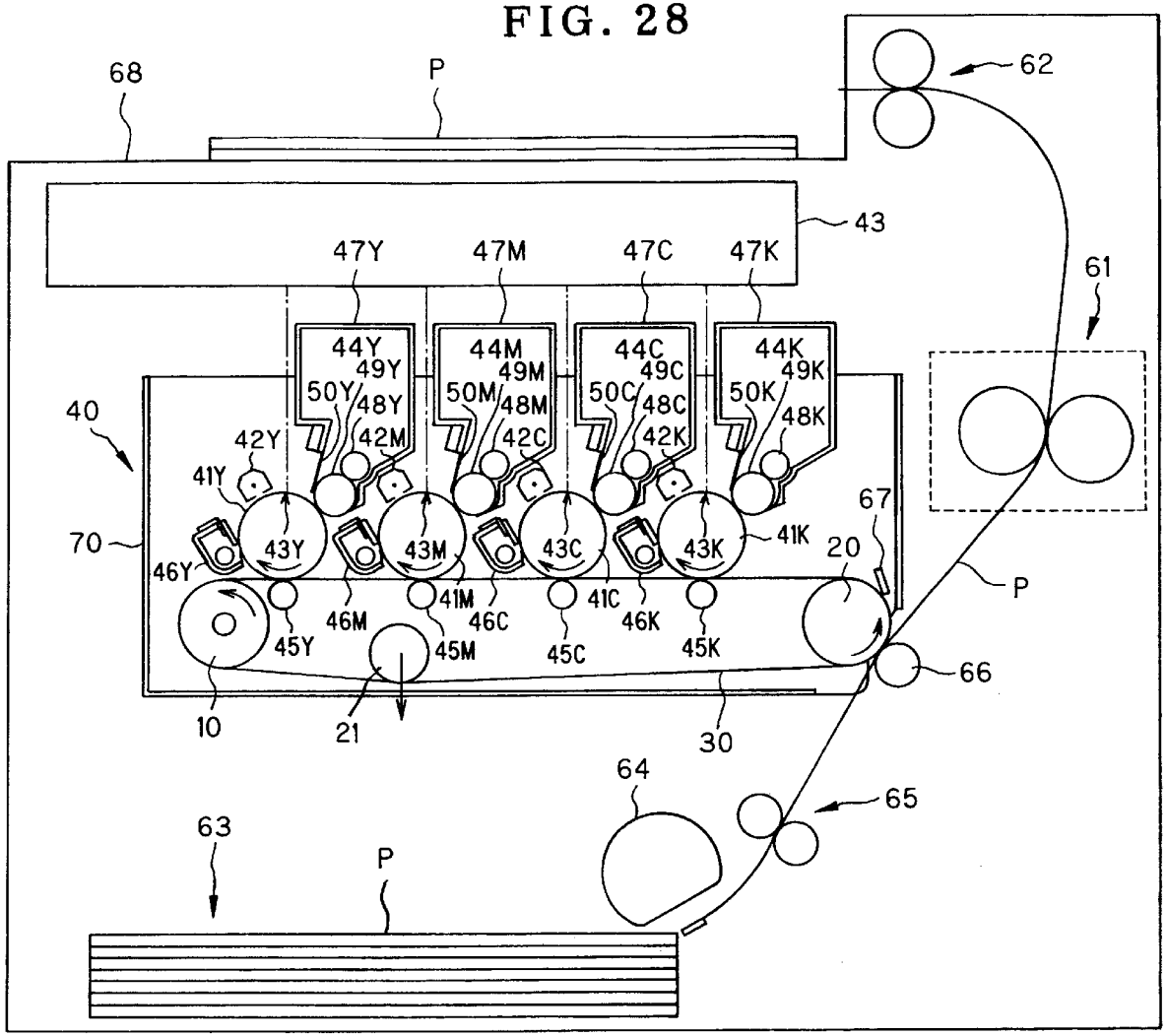
FIG. 28 is a front schematic illustrative of the whole construction of yet another color image formation system to which the invention is applied.

FIG. 28 is a front schematic illustrative of the whole construction of yet another color image formation system to which the invention is applied. As shown in FIG. 28, this image formation system comprises an intermediate transfer belt 30 that is spanned in place with tensions applied thereon by a driving roller 10, a follower roller 20 and a tension roller 21, and driven endlessly in the (counterclockwise) direction shown by an arrow. Four photosensitive members (drums) 41K, 41C, 41M and 41Y having photosensitive layers on their outer surfaces, i.e., image carriers, are arranged at a given interval with respect to the intermediate transfer belt 30. The capital letters K, C, M and Y added to the numeral reference mean black, cyan, magenta and yellow, indicating the photosensitive members for black, cyan, magenta and yellow, respectively. The same holds true for other members. The photosensitive members 41K, 41C, 41M and 41Y are rotationally driven in synchronism with the intermediate transfer belt 30 in the (clockwise) direction indicated by an arrow. Around each photosensitive member 41 (K, C, M, Y), there is located a corona charger 42 (K, C, M, Y) comprising Scorotron acting as means for uniformly charging the outer surface of the photosensitive member 41 (K, C, M, Y), an exposure site 43 (K, C, M, Y) for selectively exposing the outer surface of the member 41 uniformly charged by the corona charger 42 (K, C, M, Y) to exposure light from an exposure unit 43 for each color, thereby forming an electrostatic latent image, a developing device 44 (K, C, M, Y) for imparting a developing agent that is a toner to the electrostatic latent image formed at this exposure site 43 (K, C, M, Y) to make a visible (toner) image, a primary transfer roller 45 (K, C, M, Y) for successively transferring toner images developed at this developing device 44 (K, C, M, Y) onto the intermediate transfer belt 30 for primary transfer purposes, and a cleaning device 46 (K, C, M, Y) working as cleaning means for removing the remnants of toner on the surface of the photosensitive member 41 (K, C, M, Y) after transfer.

Figure 31:
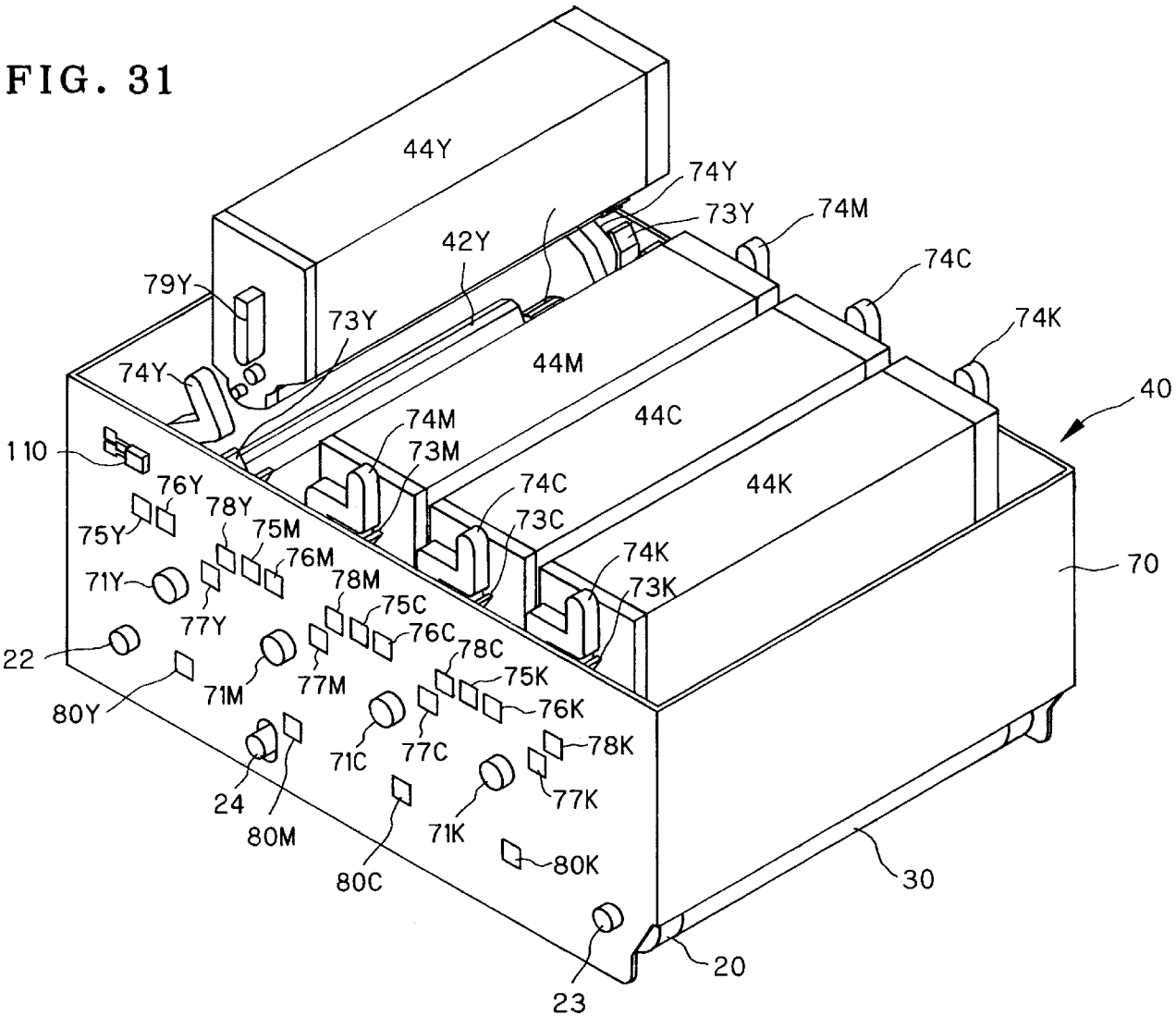
FIG. 31 a perspective view illustrative of how one of a plurality of developing devices is detached from or attached to the photosensitive member cartridge with the rest remaining mounted thereon.

Typically using a non-magnetic mono-component toner as the developing agent, the developing device 44 (K, C, M, Y) is constructed in the form of a developing cartridge 47 (K, C, M, Y) (see FIG. 31). Such a mono-component toner stored in the cartridge 47 is delivered to a developing roller 49 (K, C, M, Y) by way of a feed roller 48 (K, C, M, Y). The thickness of a developing agent film deposited onto the surface of the developing roller 49 (K, C, M, Y) is controlled by a control blade 50 (K, C, M, Y). Then, the developing roller 49 (K, C, M, Y) is brought into contact or engagement with the photosensitive member 41 (K, C, M, Y) so that the developing agent is deposited onto the photosensitive member 41 (K, C, M, Y) depending on the potential level of the photosensitive member, thereby developing the latent image in the form of a toner image.

The black, cyan, magenta and yellow toner images formed at four such monochromatic toner image-formation stations are successively primary transferred onto the intermediate transfer belt 30 by primary transfer biases applied on the primary transfer roller 45 (K, C, M, Y), so that they are superposed successively one upon another on the intermediate transfer belt 30, yielding a full-color toner image. Then, the full-color toner image is secondary transferred onto a recording medium P such as a recording sheet at a secondary transfer roller 66, passing between a pair of fixing rollers 61 that are fixing means so that the toner image is fixed on the recording medium P. Finally, the recording medium is ejected by way of a pair of ejecting rollers 62 on an output tray 68 mounted on the top of the system.

In FIG. 28, it is noted that reference numeral 63 is a sheet feed cassette for storing a multiplicity of recording media P in a superposed fashion, 64 a pickup roller for feeding recording media P from the sheet feed cassette 63 one by one, 65 is a pair of gate rollers for controlling the timing of when the recording medium P is to be fed to a secondary transfer site of the secondary transfer roller 66, 66 the secondary transfer roller behaving as secondary transfer means for defining the secondary transfer site between it and the intermediate transfer belt 39, and 67 a cleaning blade working as cleaning means for removal of the remnants of toner on the surface of the intermediate transfer belt 30 after secondary transfer.

It is here noted that the reasons why the black developing device 44K is located on the uppermost stream side of the intermediate transfer belt 30 in its endless direction and the yellow developing device 44Y is positioned on the lowermost stream side are that when the toner image is transferred onto the recording medium P, black causes the most noticeable fogging whereas yellow causes the least noticeable fogging. In the case of reversal development or the like, fogging is caused by toner particles that are allowed to bear charges of polarity opposite to normal polarity at the developing device. However, black toner particles showing the most noticeable fogging are first transferred onto the intermediate transfer belt 30 as the lowermost layer. Of the black toner particles, fogging-prone toner particles remain firmly deposited onto the intermediate transfer belt 30 by means of image force or the like, so that they are less likely to be transferred onto the recording medium P at the secondary transfer site. On the other hand, toner particles that cause the least noticeable yellow fogging are deposited onto the intermediate transfer belt 30 as the uppermost layer. Although they are easily passed onto the recording medium P, yet they are less noticeable. Such an arrangement as explained above ensures that fogging is generally less noticeable because the black toner particles leading to the most noticeable fogging are relatively less likely to be passed onto the recording medium P whereas the yellow toner particles leading to the least noticeable fogging are passed onto the recording medium P with relative ease.

Since a mono-component developing agent such as a non-magnetic mono-component toner is used, there is no need of using a carrier such as a two-component developing agent. Accordingly, it is possible to reduce the volume of each developing device 44 (K, C, M, Y) and so achieve a color image formation system of small size.

Figure 29:
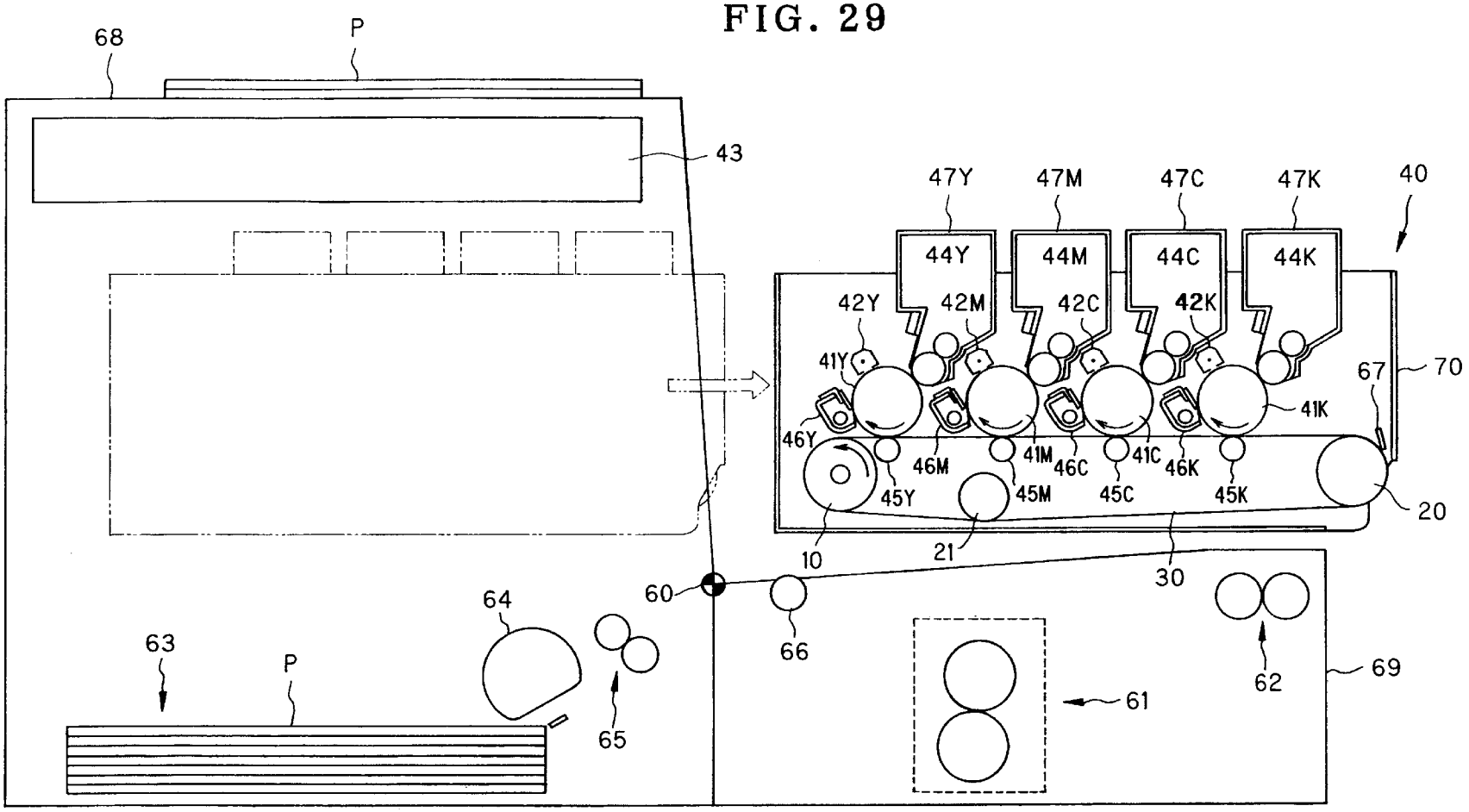
FIG. 29 is illustrative of the system of FIG. 28, from which the photosensitive member cartridge is withdrawn.

In such a color image formation system as constructed as explained above according to the present invention, the four photosensitive members 41K, 41C, 41M and 41Y, the corona charger 42 (K, C, M, Y) and cleaning devices 46 (K, C, M, Y) disposed around the members, the intermediate transfer belt 30, the driving roller 10, follower roller 20 and tension roller 21 over which the intermediate transfer belt 30 are spanned, the primary transfer rollers 45 (K, C, M, Y) for bringing the intermediate transfer roll 30 in contact with the photosensitive members 41 (K, C, M, Y) and the cleaning blade 67 are all constructed in the form of the integral photosensitive member cartridge 40 that can be detached from or attached to the system proper, as shown in FIGS. 28 and 29. In this case, the developing devices 44K, 44C, 44M and 44Y that are appendixes to the photosensitive members 41K, 41C, 41M and 41Y are detachable from and attachable to the photosensitive member cartridge 40.

Referring to FIG. 29, the photosensitive member cartridge 40 is provided on its frame 70 with the four photosensitive members 41K, 41C, 41M and 41Y and their appendixes, i.e., the corona chargers 42 (K, C, M, Y) and cleaning devices 46 (K, C, M, Y) while they are relatively positioned with respect to one another. The intermediate transfer belt 30 spanned over the driving roller 10, follower roller 20 and tension roller 21 and cleaned by the cleaning blade 67 is mounted together with these means on the frame 70 of the photosensitive member cartridge 40 in such a way that it comes in contact with the photosensitive members 41 (K, C, M, Y) via the primary transfer rollers 45 (K, C, M, Y). These members can be slid out of the system proper as shown by a double arrow. To this end, the pair of fixing rollers 61, the pair of ejecting rollers 62 and the secondary transfer rollers 66 are mounted on a side plate 69 that can pivot on a rotary shaft 60. The pair of fixing rollers 61, the pair of ejecting rollers 62 and the secondary transfer rollers 66 are retracted, thereby defining an opening through which the photosensitive cartridge 40 is withdrawn out of the system. In the state where the photosensitive member cartridge 40 has been withdrawn out of the system proper, the photosensitive member cartridge 40 can be detached from the system and replaced by a new photosensitive member cartridge 40.

Figure 30:
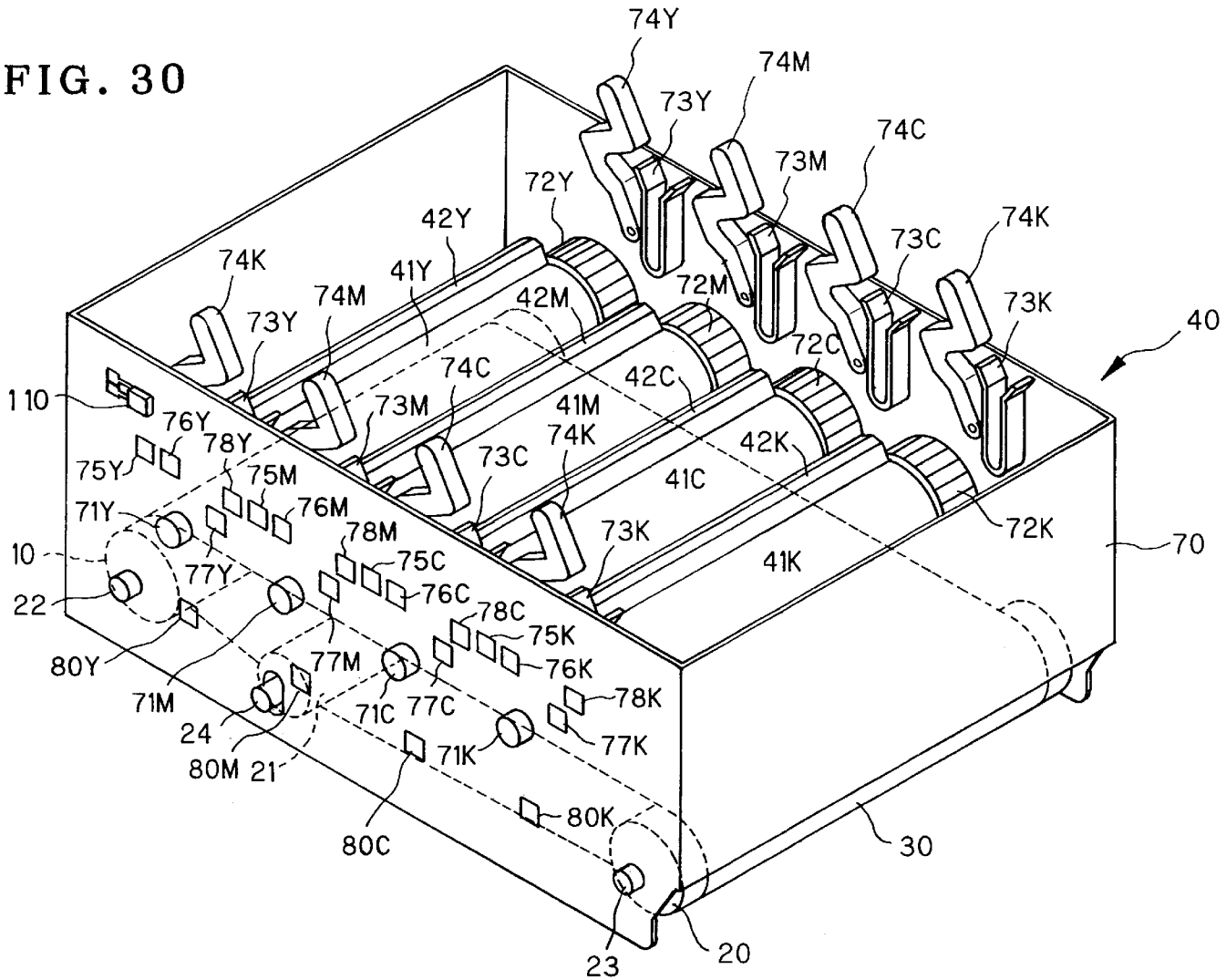
FIG. 30 is a perspective view of the photosensitive member cartridge from which the developing devices are removed.

FIG. 30 is a perspective view of the photosensitive cartridge 40 from which the developing devices 44K, 44C, 44M and 44Y are removed, and FIG. 31 is a perspective view illustrative of how the developing device 44Y is detached from or attached to the photosensitive member cartridge 40 with the developing devices 44K, 44C and 44M remaining mounted thereon. The frame 70 is in a rectangular box form, between both sides plates of which there are four photosensitive members 41K, 41C, 41M and 41Y that are positioned at a given interval and parallel with one another for rotation on their shafts 71K, 71C, 71M and 71Y. The shaft 71 (K, C, M, Y) of each photosensitive member 41 (K, C, M, Y) is provided at its one end with a gear 72 (K, C, M, Y). By way of the gear train to be referred to later, the photosensitive members 41 (K, C, M, Y) are rotatable in the (clockwise) direction indicated by the arrow in FIG. 28 at the same speed and in synchronism with one another.

Between the same two side plates of the frame 70, the corona chargers 42 (K, C, M, Y) and cleaning devices 46 (K, C, M, Y) (which, in FIG. 30, are invisible because of being concealed by the photosensitive members 41 (K, C, M, Y) and frame 70), all appendixes to the photosensitive members 41 (K, C, M, Y), are mounted at given positions. On one side of the side plate of the frame 70 there are provided electrodes 75 (K, C, M, Y) for applying high voltages on the discharge wires of the corona chargers or Scorotrons 42 (K, C, M, Y) and electrodes 76 (K, C, M, Y) for applying high voltages on the grits of the Scorotrons. On the same one side of the side plate of the frame 70 there are also provided electrodes 77 (K, C, M, Y) for applying developing bias voltages on the developing rollers 49 (K, C, M, Y) of the developing devices 44 (K, C, M, Y) in the state where the developing devices 44 (K, C, M, Y) are mounted on the photosensitive member cartridge 40 and electrodes 78 (K, C, M, Y) for applying developing feed bias voltages on the feed rollers 48 (K, C, M, Y) in the same state.

Between the side plates of the frame 70, the driving roller 10, follower roller 20 and tension roller 21, over which the intermediate transfer roll 30 is spanned, are mounted parallel with one another at a given interval in such a manner that they are rotatable on shafts 22, 23 and 24, and the primary transfer rollers 45 (K, C, M, Y), appendixes to the photosensitive members 41 (K, C, M, Y), are mounted at given positions (although not shown in FIGS. 30 and 31). On the same side of the side plate of the frame 70 there are mounted electrodes 80 (K, C, M, Y) for applying primary transfer voltages on the primary transfer roller 45 (K, C, M, Y).

On the same side plate, there is further provided an IC 110 as memory means for storing information about the fabrication and use of the photosensitive member cartridge 40, color misalignments, etc. Upon the photosensitive member cartridge 40 mounted on the system proper, the electrodes 75 (K, C, M, Y), electrodes 76 (K, C, M, Y), electrodes 77 (K, C, M, Y), electrodes 78 (K, C, M, Y), electrodes 80 (K, C, M, Y) and IC 110 are automatically connected to the power source circuit and control circuit of the system proper. In this state, the shafts 71 (K, C, M, Y) of the photosensitive members 41 (K, C, M, Y) are also automatically connected to ground for earth purposes.

At the inner upper sides of the same two side plates of the frame 70, there are provided guide grooves 73 (K, C, M, Y) for receiving the developing devices 44 (K, C, M, Y) at constant positions corresponding to the photosensitive members 41 (K, C, M, Y). To fix the developing devices 44 (K, C, M, Y) received along the guide grooves 73 (K, C, M, Y), fixing levers 74 (K, C, M, Y) are pivotally provided. On both sides of the developing cartridge 47 (K, C, M, Y) of each developing device 44 (K, C, M, Y), there are guide ridges 79 (K, C, M, Y) that are to be inserted in the associated guide grooves 73 (K, C, M, Y) from the upper open ends thereof (see FIG. 31 where only one guide ridge 79Y of the developing cartridge 47Y is visible). To mount the developing devices 44 (K, C, M, Y) on the associated photosensitive members 41 (K, C, M, Y), the guide ridges 79 (K, C, M, Y) are inserted from above into the associated guide grooves 73 (K, C, M, Y) and the fixing levers 74 (K, C, M, Y) are then pivoted to fix the developing devices in place. To remove the developing cartridges 47 (K, C, M, Y) for replacement or other purposes, the fixing levers 74 (K, C, M, Y) are pivoted back to guide the developing cartridges 47 (K, C, M, Y) upward along the guide grooves 73 (K, C, M, Y).

According to the embodiment of FIG. 31, the developing cartridges 47 (K, C, M, Y) forming part of the individual developing devices 44 (K, C, M, Y) can separately be attached to or detached from the associated photosensitive members 41 (K, C, M, Y); of the developing devices 44 (K, C, M, Y), only an exhausted or dead developing device(s) can be replaced with no wasteful replacement of the rest, so that running cost reductions are achievable.

Figure 32:
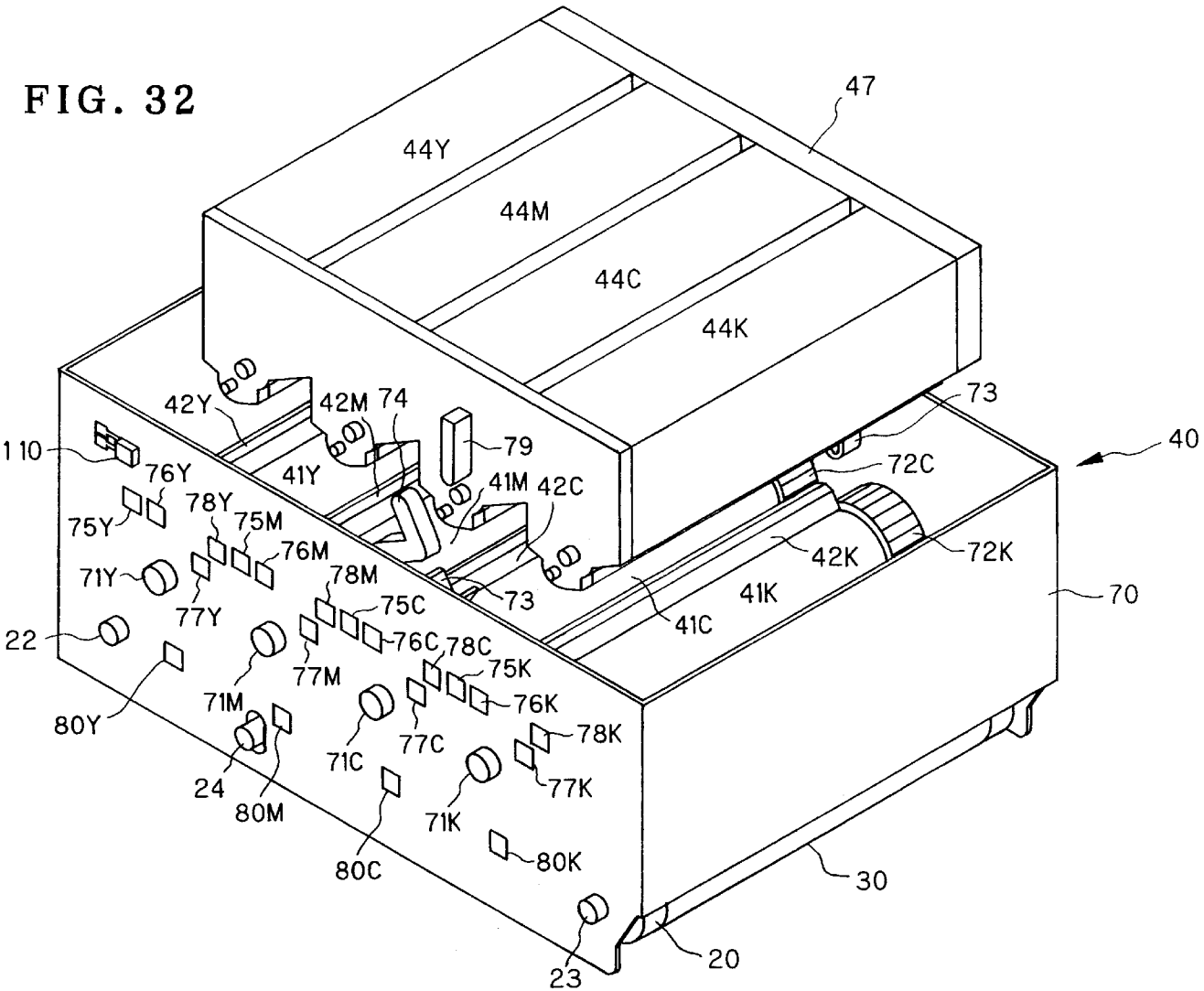
FIG. 32 is a perspective view illustrative of the attachment/detachment mechanism for one embodiment where all developing devices are constructed in the form of an integral developing cartridge.

FIG. 32 is a perspective view illustrative of the attachment/detachment mechanism for an embodiment of the invention wherein four or black, cyan, magenta and yellow developing devices 44 (K, C, M, Y) are constructed in the form of an integral development cartridge 47 for such a photosensitive member cartridge 40 as described above. In this embodiment, only one pair of guide grooves 73 are provided at the inner upper sites of both side plates of the frame 70 of the photosensitive member cartridge 40, spanning between both side plates. Accordingly, only one pair of pivotal fixing levers 74 are provided. On the other hand, the four developing devices 44 (K, C, M, Y) are constructed in the form of an integrated single developing cartridge 47. On each side of the developing cartridge 47 there is mounted a guide ridge 79 that is to be inserted into the associated guide groove 73 from the upper open end thereof (in FIG. 32, one guide ridge 79 alone is visible). To mount the developing cartridge 47 on the photosensitive member cartridge 40, the guide ridges 79 are inserted from above into the guide grooves 73 and the fixing levers 74 are then pivoted to fix the developing cartridge in place. To remove the developing cartridge 47 for replacement or other purposes, the fixing levers 47 are pivoted back so that the developing cartridge 47 can be guided upward along the guide grooves 73.

The embodiment of FIG. 32, wherein the four or black, cyan, magenta and yellow developing devices 44 (K, C, M, Y) are designed as the integral developing cartridge 47, has the merit of reducing the number of consumable parts, thereby improving the integrity of maintenance and avoiding a risk of anything wrong happening upon mounting.

Figure 33:
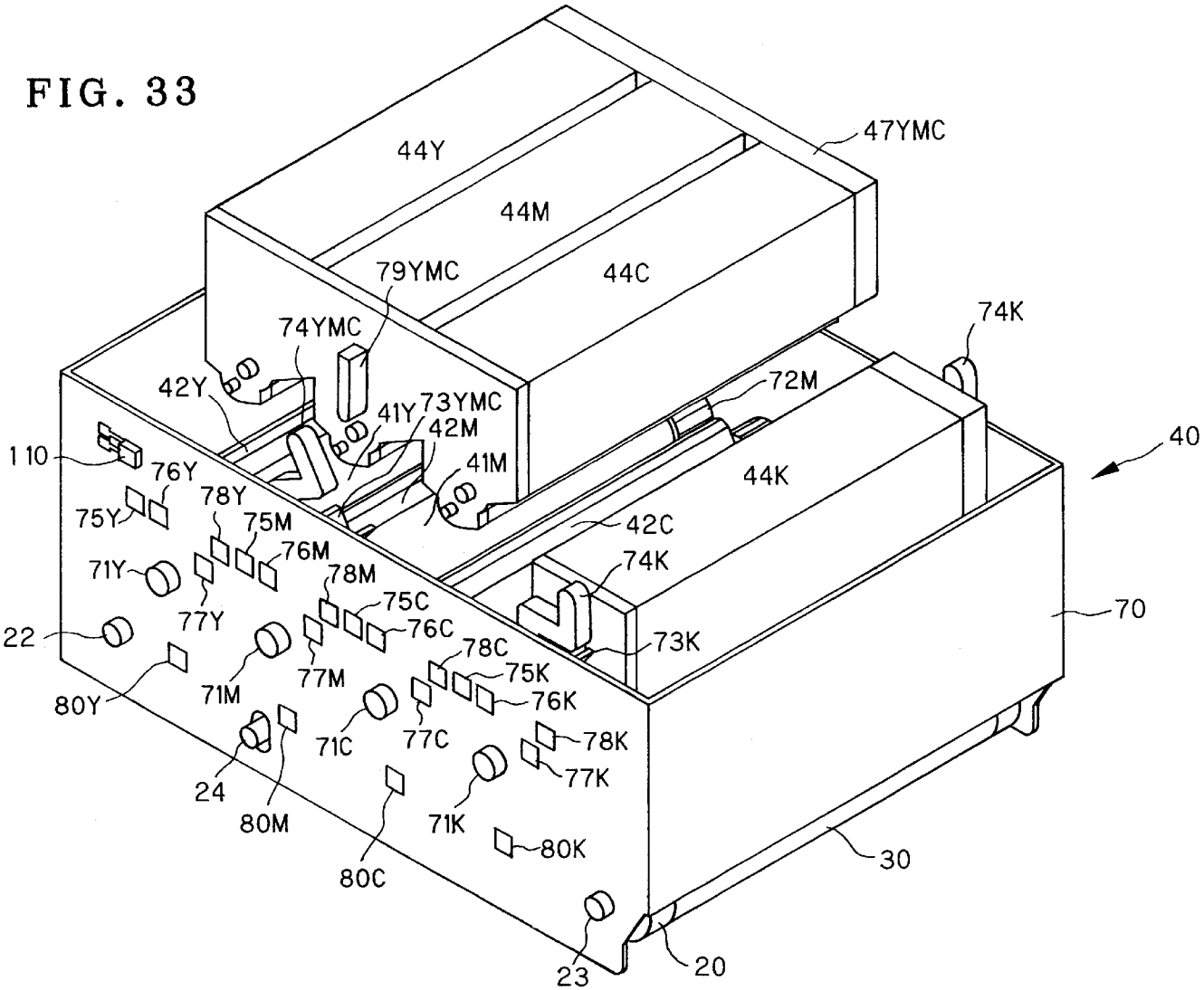
FIG. 33 is a perspective view illustrative of the attachment/detachment mechanism for an embodiment of the invention, wherein the black developing device is constructed in the form of a single developing cartridge and the remaining developing devices are constructed in the form of an integral developing cartridge.

FIG. 33 is a perspective view illustrative of the attachment/detachment mechanism for such a photosensitive member cartridge 40 as described above, wherein a black developing device 44K is constructed in the form of one single developing cartridge 47K that is detachable from or attachable to a black photosensitive member 41K as is the case with FIG. 30 or FIG. 31, and three or cyan, magenta and yellow developing devices 44 (C, M, Y) are constructed in the form of an integral developing cartridge 47YMC. At the inner upper sites of both side plates of a frame 70 of the photosensitive member cartridge 40 there are provided guide grooves 73K for receiving the developing cartridge 47K between both side plates and guide grooves 73YMC for receiving the developing cartridge 47YMC, and there are provided pivotal fixing levers 74K and 74YMC, accordingly. On the other hand, the black photosensitive member cartridge 40 is provided on both its sides with guide ridges 79K and the three-color developing cartridge 47YMC is provided on both its sides with guide ridges 79YMC (in FIG. 33, only one guide ridge 79YMC is visible on the developing cartridge 47YMC). To mount the developing cartridge 47K or 47YMC on the photosensitive member cartridge 40, the guide ridges 79K or 79YMC are inserted from above into the guide grooves 73K or 73YMC, whereupon the fixing levers 74K or 74YMC are pivoted to fix the developing cartridge in place. To remove the developing cartridge 47K or 47YMC for replacement or other purposes, the fixing levers 74K or 74YMC are pivoted back so that the developing cartridge 47K or 47YMC can be guided upward along the guide grooves 73K or 73YMC.

The embodiment of FIG. 33, wherein the three-color or cyan, magenta and yellow developing devices 44 (C, M, Y) are constructed in the form of the integral developing cartridge 47YMC, has the merit of removing the number of consumable parts, thereby improving the integrity of maintenance and avoiding a risk of anything wrong happening upon mounting. This embodiment has another merit of preventing the three-color or cyan, magenta and Y developing devices 44 (C, M, Y) from going to waste, because the black developing device 44K most frequently used in general can be replaced in the form of the independent developing cartridge 47K.

Figure 34:
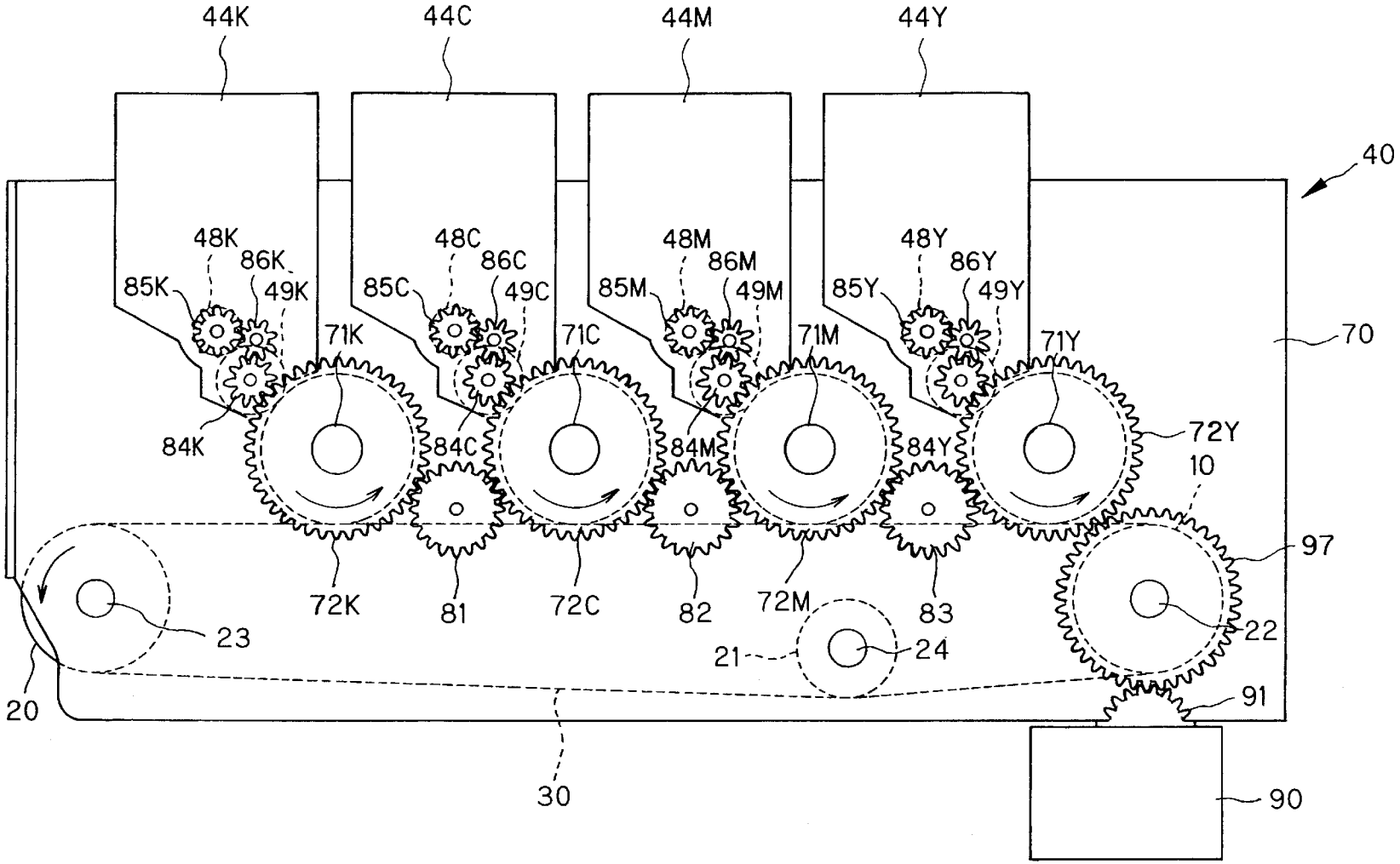
FIG. 34 is illustrative of the construction of one embodiment wherein the photosensitive members and intermediate transfer belts in the photosensitive member cartridge are rotated in synchronism with each other.

Next, an account is given of the mechanism of, upon the photosensitive member cartridge 40 mounted on the system proper, rotating the photosensitive members 41K, 41C, 41M and 41Y in the cartridge 40 in synchronism with one another, thereby preventing any color misalignment. FIG. 34 is illustrative of one construction for achieving this. As already mentioned, the shafts 71 (K, C, M, Y) of the photosensitive members 41 (K, C, M, Y) are mounted at their one ends with gears 72K, 72C, 72M and 72Y, respectively, which are molded using the same mold. An idle gear 81 is interposed between the gears 71K and 72C, an idle gear 82 between the gears 72C and 72M, and an idle gear 83 between the gears 72M and 72Y, forming a gear train. The driving roller 10 is provided at its one end with a gear 97 rotating around a shaft 22, and the gear 97 meshes with the gear 72Y for rotating the photosensitive member 41Y. The gears 72K, 81, 72C, 82, 72M, 83, 72Y and 97 thus form a series of gear train. A driving gear 91 in mesh with one gear in this gear train, for instance, gear 97, is disposed at a driving source 90 on the side of the system proper, so that upon the photosensitive cartridge 40 mounted at a given position of the system proper, the driving gear 91 meshes with the gear 97.

On the other hand, the shaft of the developing roller 49 (K, C, M, Y) of the developing device 44 (K, C, M, Y) is fixedly provided at its one end with a developing roller gear 84 (K, C, M, Y), and the shaft of the feed roller 48 (K, C, M, Y) is fixedly provided at its one end with a feed roller gear 85 (K, C, M, Y). An idle roller 86 (K, C, M, Y) is interposed between the developing roller gear 84 (K, C, M, Y) and the feed roller gear 85 (K, C, M, Y). The developing roller gear 84 (K, C, M, Y) meshes with the gear 72 (K, C, M, Y) of the photosensitive member 41 (K, C, M, Y), so that the developing roller 49 (K, C, M, Y) and feed roller 48 (K, C, M, Y) of the developing device 44 (K, C, M, Y), too, can be rotationally driven in synchronism with the rotation of the photosensitive member 41 (K, C, M, Y).

By rotating the driving gear 91 of the driving source at one site on the side of the system proper according to this arrangement, it is possible to rotationally drive the four photosensitive members 41 (K, C, M, Y) and the appendixes thereto, i.e., the developing rollers 49 (K, C, M, Y) and feed rollers 48 (K, C, M, Y) of the developing devices 44 (K, C, M, Y), all in synchronism with one another.

It is here desired that the diameter of the driving roller 10 be set in such a way to give a speed difference of 1 to 5% between the delivery speed of the intermediate transfer belt 30 by the driving roller 10 and the peripheral speed of the photosensitive member 41 (K, C, M, Y). With such a speed difference between the photosensitive member 41 (K, C, M, Y) and the intermediate transfer belt 30, it is possible to increase the efficiency of transfer because the toner can be mechanically moved upon the primary transfer of the toner image.

When only the image carriers (photosensitive members) are replaced as is the case with the prior art, there is a fluctuation of the periphery speed of the image carriers with errors in image carrier shape, which in turn results in a change in the speed difference with the intermediate transfer belt. The fluctuations in the speed difference offer some problems; too small a speed difference renders the efficiency of transfer low whereas too large a speed difference causes deterioration in image quality. Therefore, if the photosensitive members 41 (K, C, M, Y) and intermediate transfer belt 30 are integrated with the photosensitive member cartridge 40 as contemplated herein, it is then possible to reduce the fluctuations in the speed difference between the photosensitive members 41 (K, C, M, Y) and the intermediate transfer belt 30 as by determining the shape of the driving roll 10 in conformity with the shape of the photosensitive member 41 (K, C, M, Y). It is thus possible to provide an imaging system with improved transfer efficiency and with no deterioration in image quality.

This embodiment ensures that the operating efficiency of attachment/detachment of the photosensitive member cartridge 40 is improved because the point of meshing of the gears for transmission of driving force upon attachment/detachment of the photosensitive member cartridge 40 is limited to one. Since the positioning criterion for the photosensitive member cartridge 40 is defined by this driving force transmission gear 91, it is also possible to improve the precision of meshing and, hence, provide a system for forming high-quality images that are substantially free from any color misalignment or any banding (variations in densities, etc. at right angles with the feed direction).

It is understood that the mechanism for synchronized transmission of rotational force for the photosensitive members 41K, 41C, 41M and 41Y is not limited to such a gear train as shown, and so may be constructed using a belt or chain, for instance.

Figure 35:
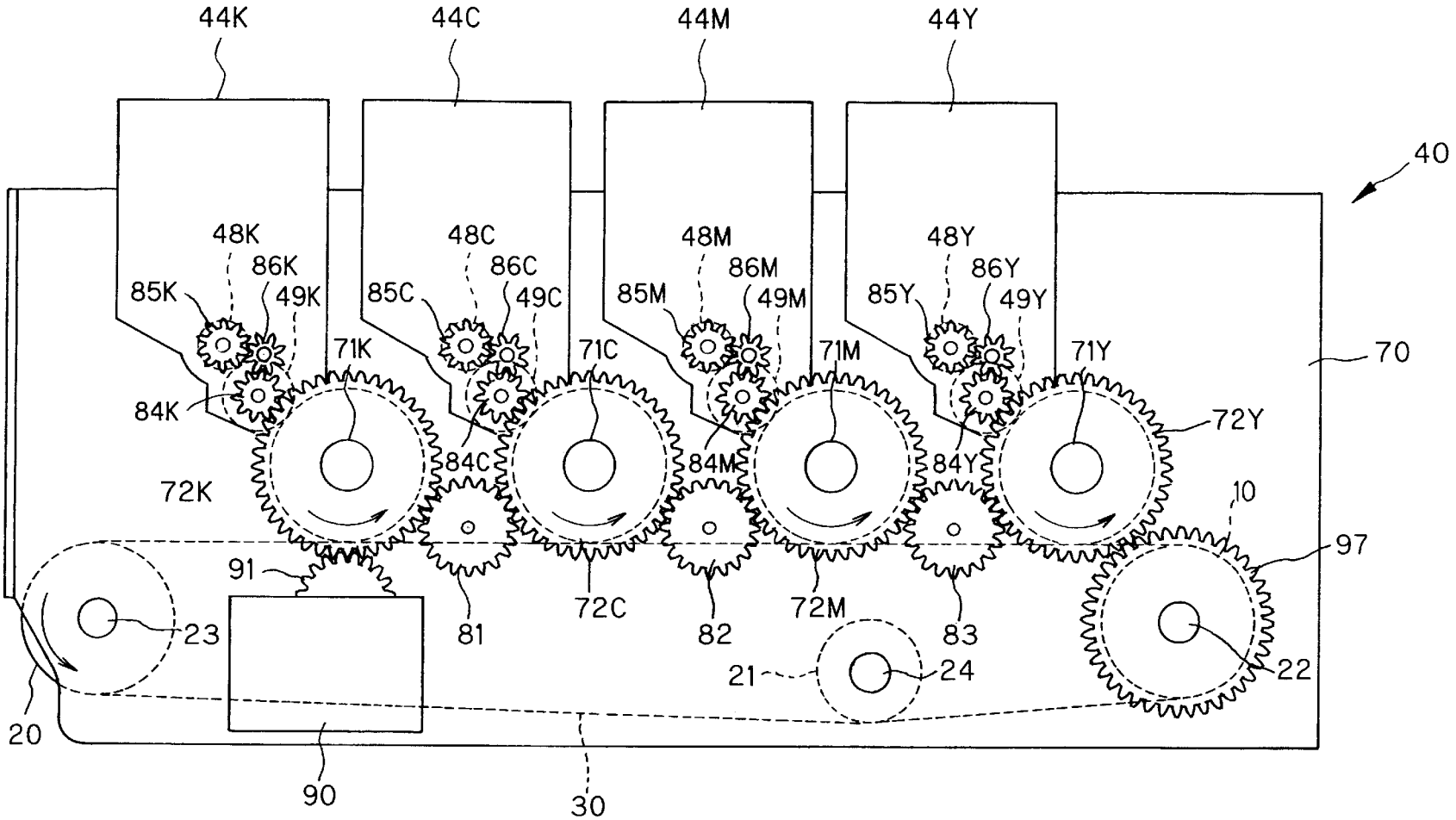
FIG. 35 is illustrative of the construction of one modification to FIG. 34.

FIG. 35 is illustrative of one modification to the embodiment of FIG. 34. In this modification, the driving gear 91 of the driving source 90 (FIG. 34) on the side of the system proper is designed to mesh with the gear 72K in the gear train comprising the gears 72K, 81, 72C, 82, 72M, 83, 72Y and 97, so that the intermediate transfer belt 30 as well as the four photosensitive members 41 (K, C, M, Y) and their appendixes, i.e., the developing rollers 49 (K, C, M, Y) and feed rollers 48 (K, C, M, Y) of the developing devices 44 (K, C, M, Y) are all rotationally driven. Otherwise, the construction of FIG. 35 is the same as that of FIG. 34.

Figure 36:
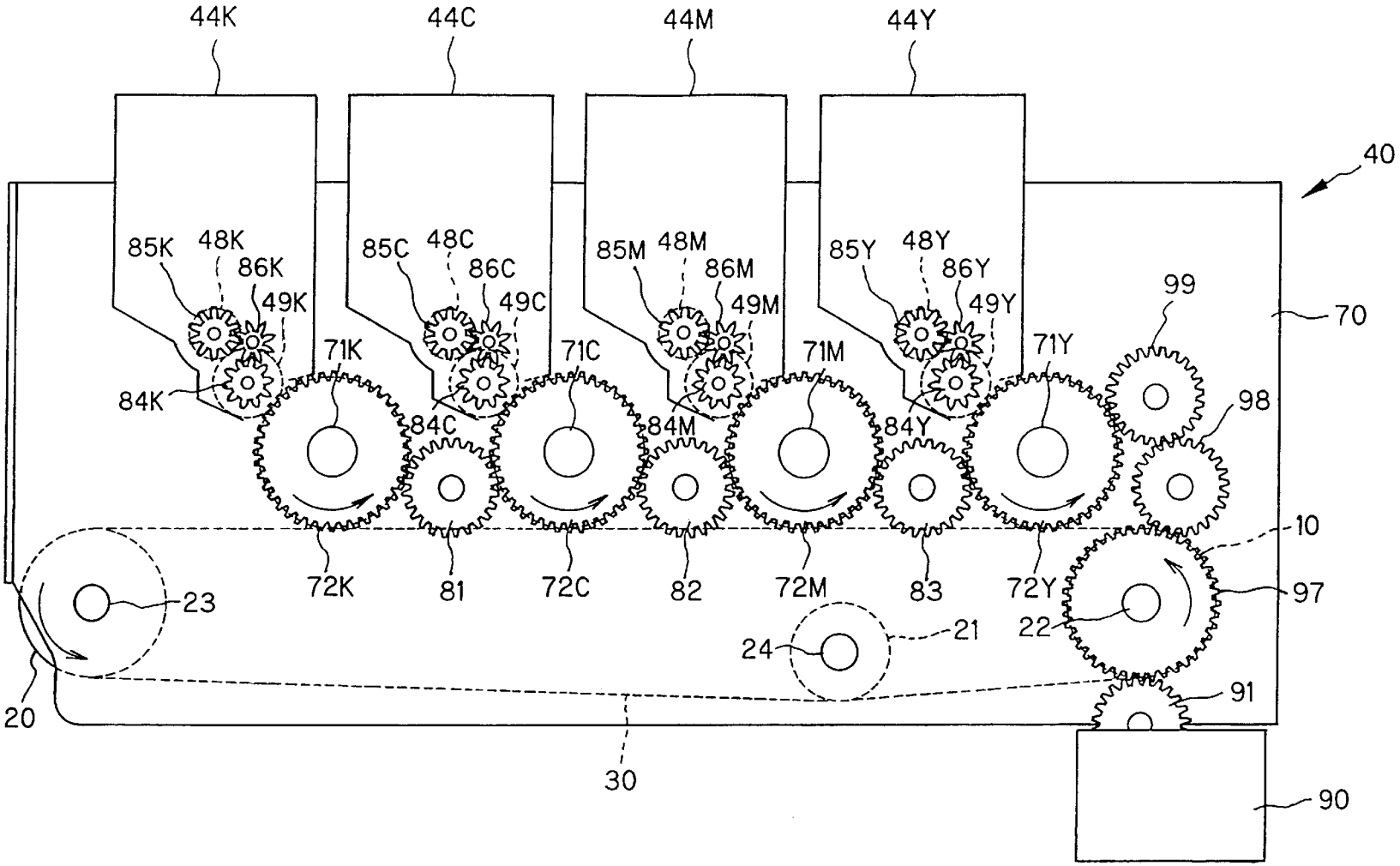
FIG. 36 is illustrative of the construction of the mechanism for synchronized rotation of the photosensitive members in an embodiment of the invention, wherein the photosensitive member cartridge is mounted on the system proper, and the photosensitive members and developing devices are driven by means of separate driving sources.
Figure 37:
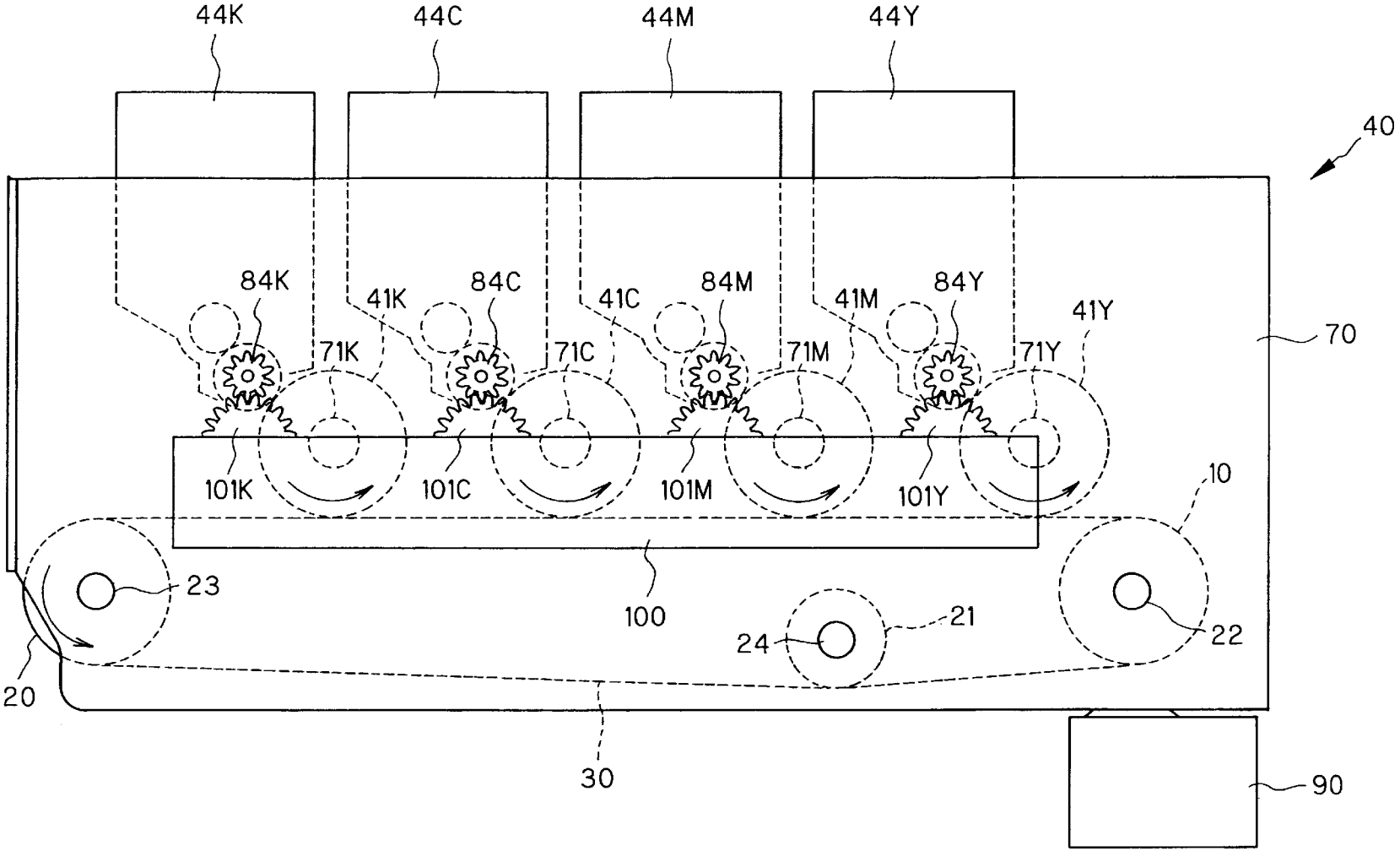
FIG. 37 is illustrative of the construction of the mechanism for rotating the developing devices in the embodiment of FIG. 36.

FIGS. 36 and 37 are illustrative of an embodiment of the invention, wherein the photosensitive member cartridge 40 is mounted on the system proper and the photosensitive members 41 (K, C, M, Y) of the photosensitive member cartridge 40, the intermediate transfer belt 30 and the developing devices 44 (K, C, M, Y) are driven by means of separate driving sources. FIG. 36 is similar to FIG. 34. In this embodiment, the developing roller gears 84 (K, C, M, Y) of the developing devices 44 (K, C, M, Y) are not in mesh with the gears 72 (K, C, M, Y) of the photosensitive members 41 (K, C, M, Y) or separated therefrom, as can be seen from FIG. 36. The embodiment of FIG. 36 is different from that of FIG. 34 only in terms of the gear train of the photosensitive member cartridge 40. It is here understood that the gear 97 for rotating the driving roller 10 is in no direct mesh with the gear 72Y for rotating the photosensitive member 41Y; they are jointed to each other via two gears 98 and 99. By rotating the driving gear 91 of the driving source 90 on the side of the system proper, the intermediate transfer belt 30 and the four photosensitive members 41 (K, C, M, Y) can thus be rotationally driven in synchronism, as can be see from FIG. 36.

Although depending on the driving force of that driving source 90, however, the developing roller 49 (K, C, M, Y) and feed roller 48 (K, C, M, Y) of the developing device 44 (K, C, M, Y) are kept from rotation. In this embodiment, there is another driving source 100 at another site on the side of the system proper, as shown in FIG. 37. When the photosensitive member cartridge 40 is mounted at a given position of the system proper, four gears 101 (K, C, M, Y) of the separate driving source 100, designed to rotate in synchronism and in the same direction, are positioned in such a way that they mesh with the developing roller gears 84 (K, C, M, Y) fixed at one ends of the shafts of the developing rollers 49 (K, C, M, Y) of the developing devices 44 (K, C, M, Y) mounted on the photosensitive member cartridge 40. Thus, the developing devices 44 (K, C, M, Y) are rotationally driven by the driving source 100 that is separate from that for the photosensitive members 41 (K, C, M, Y).

In such an arrangement as shown in FIG. 28, color misalignments and image banding are largely dependent on the precision of rotation of the image carriers and intermediate transfer belt; however, they are less dependent on the precision of rotation of the developing rollers. Therefore, if the driving source 90 for the intermediate transfer belt 30 and the photosensitive members 41 (K, C, M, Y) of the photosensitive member cartridge 40 is made separate from the driving source 100 for the developing devices 44 (K, C, M, Y) as shown in FIGS. 36 and 37, it is then possible to prevent rotation variations caused as by fluctuations in the torque of developing means from having influences on the rotation of the image carriers and, hence, provide a system for forming high-quality images with neither color misalignments nor image banding.

In the construction of FIGS. 36 and 37, too, it is acceptable to engage the driving gear 91 of the driving source 90 on the side of the system proper with the gear 72K in the gear train comprising the gears 72K, 81, 72C, 82, 72M, 83, 72Y and 97 as shown in FIG. 35, thereby rotationally driving the intermediate transfer belt 30 and the four photosensitive members 41 (K, C, M, Y) in synchronism with one another.

Figure 38:
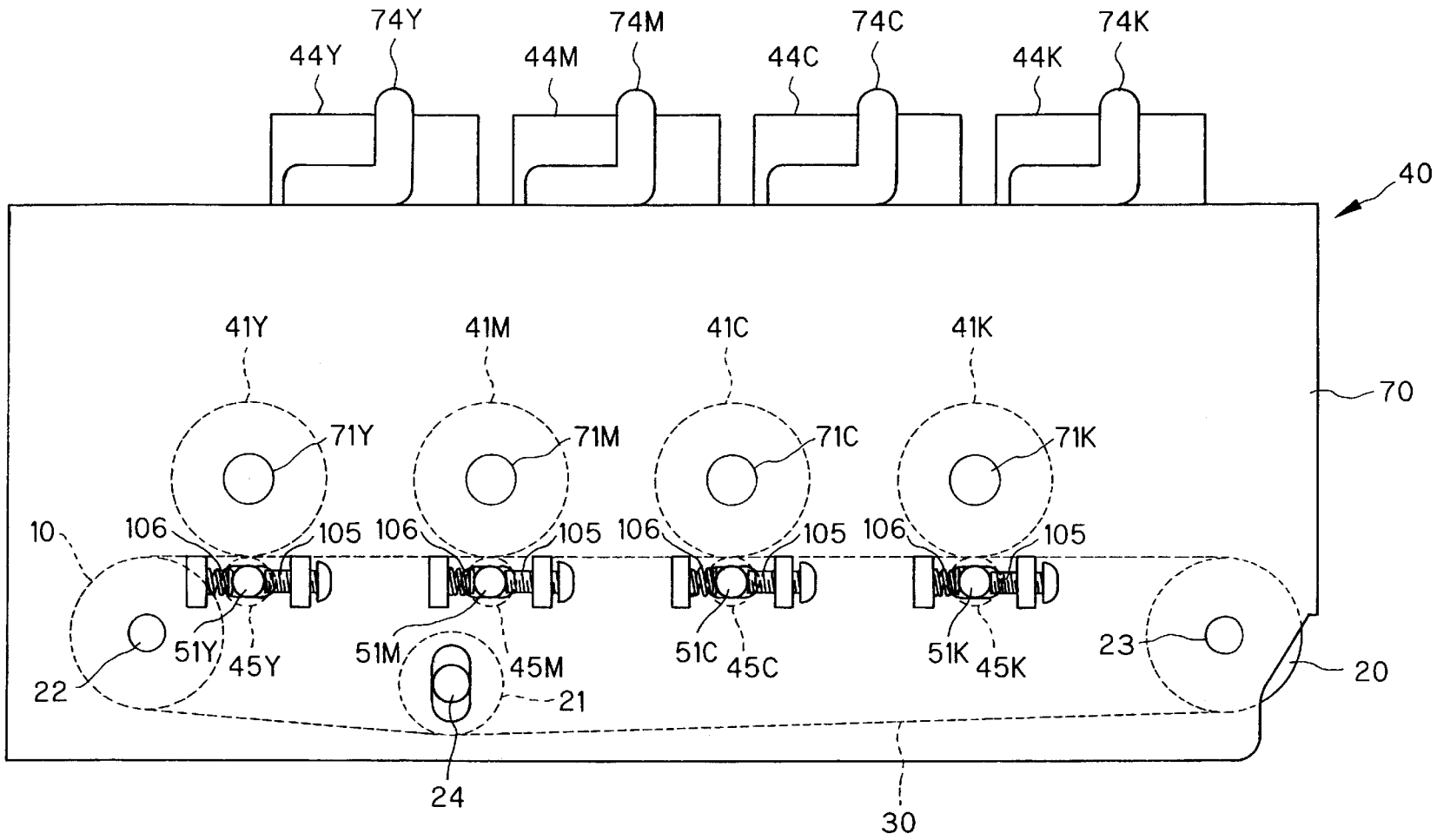
FIG. 38 is illustrative of one embodiment of the mechanism for adjusting the photosensitive member cartridge for color misalignments.

FIG. 38 is illustrative of one embodiment of the mechanism for adjusting color misalignments occurring due to position misalignments between the photosensitive members 41K, 41C, 41M and 41Y in such a photosensitive member cartridge 40 as described above, especially skews in parallelism, when four different monochromatic toner images are transferred onto the intermediate transfer belt 30 in a superposed fashion. As shown in FIG. 38, while the shaft 51 (K, C, M, Y) of each primary transfer roller 45 (K, C, M, Y) extending from one side plate of the frame 70 is sandwiched between an adjustment screw 105 and the leading end of an extensible spring 106, the other end of the extensible spring 106 is fixed to the side plate 70. In this state, if the leading end of the adjustment screw 105 is adjustable in the direction opposite to the direction of extension of the extensible spring 106 to adjust the position of one end of the shaft 51 (K, C, M, Y), there are then changes in the primary transfer positions of the primary transfer rollers 45K, 45C, 45M and 45Y. Since there is such a speed difference as mentioned above between the intermediate transfer belt 30 and the photosensitive members 41 (K, C, M, Y), changes in the primary transfer positions cause changes in the transfer positions on the intermediate transfer belt 30 for the toner images of the corresponding colors; that is, color misalignments can be regulated. It is not always required to provide all the four photosensitive members 41K, 41C, 41M and 41Y with such color misalignment adjustment mechanisms. It is noted that it is acceptable to provide the opposite ends of the shafts 51 (K, C, M, Y) with such color misalignment adjustment mechanisms. However, this is not always necessary because misalignments can be electrically eliminated by controlling the timing of when color latent images formed on the photosensitive members 41 (K, C, M, Y) are to be written, as long as given parallelism is maintained between the photosensitive members 41 (K, C, M, Y).

It is here understood that color misalignments may also be regulated by providing similar adjustment mechanisms on the respective shafts 71 (K, C, M, Y) of the photosensitive members 41 (K, C, M, Y).

By providing the photosensitive member cartridge 40 with the position alignment mechanism for the primary transfer rollers 45 (K, C, M, Y) or the photosensitive members 41 (K, C, M, Y) in this way, it is possible to make fine adjustments of the positions of the photosensitive members 41 (K, C, M, Y) onto which latent images are to be written and transferred, thereby reducing color misalignments. It is here noted that the color misalignment adjustment by this color (position) misalignment adjustment mechanism may be made upon shipment of the photosensitive member cartridge 40 or anytime after its attachment to the system proper.

Figure 39:
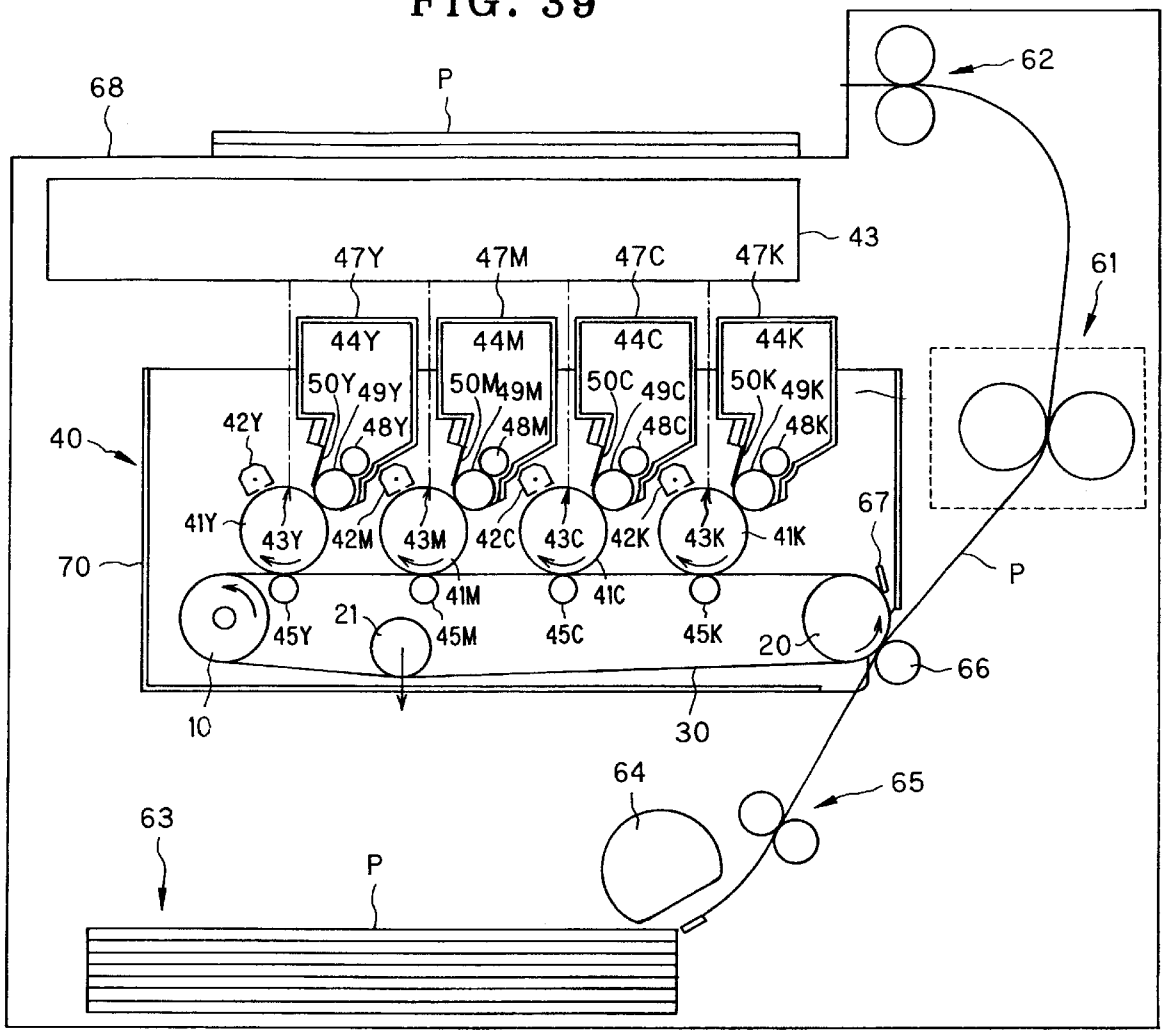
FIG. 39 is a front schematic illustrative of the whole construction of an embodiment of the color image formation system using a "cleaner-less" mode.

Referring now to an electrographic system wherein latent images formed on image carriers are toner developed and the resulting toner images are transferred onto transfer media, there is a so-called "cleaner-less" mode wherein the remnants of toner not transferred onto the image carriers are recovered at developing devices without recourse to such cleaning devices as shown in FIG. 28 (for instance, see JP-B 06-77166). This "cleaner-less" mode is embodied as shown in FIG. 39, dispensing with the cleaning devices 46 (K, C, M, Y) of FIG. 28. The embodiment of FIG. 29 is the same in construction as that of FIG. 28 with the exception of the absence of the cleaning devices 46 (K, C, M, Y); any detailed account of its construction and action is not given. The construction of the photosensitive member cartridge 40 in this embodiment, too, is the same as that of FIGS. 28 and 29 with the exception of the absence of the cleaning devices 46 (K, C, M, Y); four photosensitive members 41K, 41C, 41M and 41Y, corona chargers 42 (K, C, M, Y) disposed around the same and an intermediate transfer belt 30 are constructed in an integral form.

By use of the mode that dispenses with any cleaning device, it is possible to reduce the size of the photosensitive member cartridge 40 and the system proper. In addition, it is possible to diminish reaction force that may otherwise act on the photosensitive members 41 (K, C, M, Y) through the blades, etc. of cleaning devices, resulting in prevention of color misalignments. This is because the frame 70 is kept from deformation so that any position misalignment between the photosensitive members 41 (K, C, M, Y) can be avoided.

Figure 40:
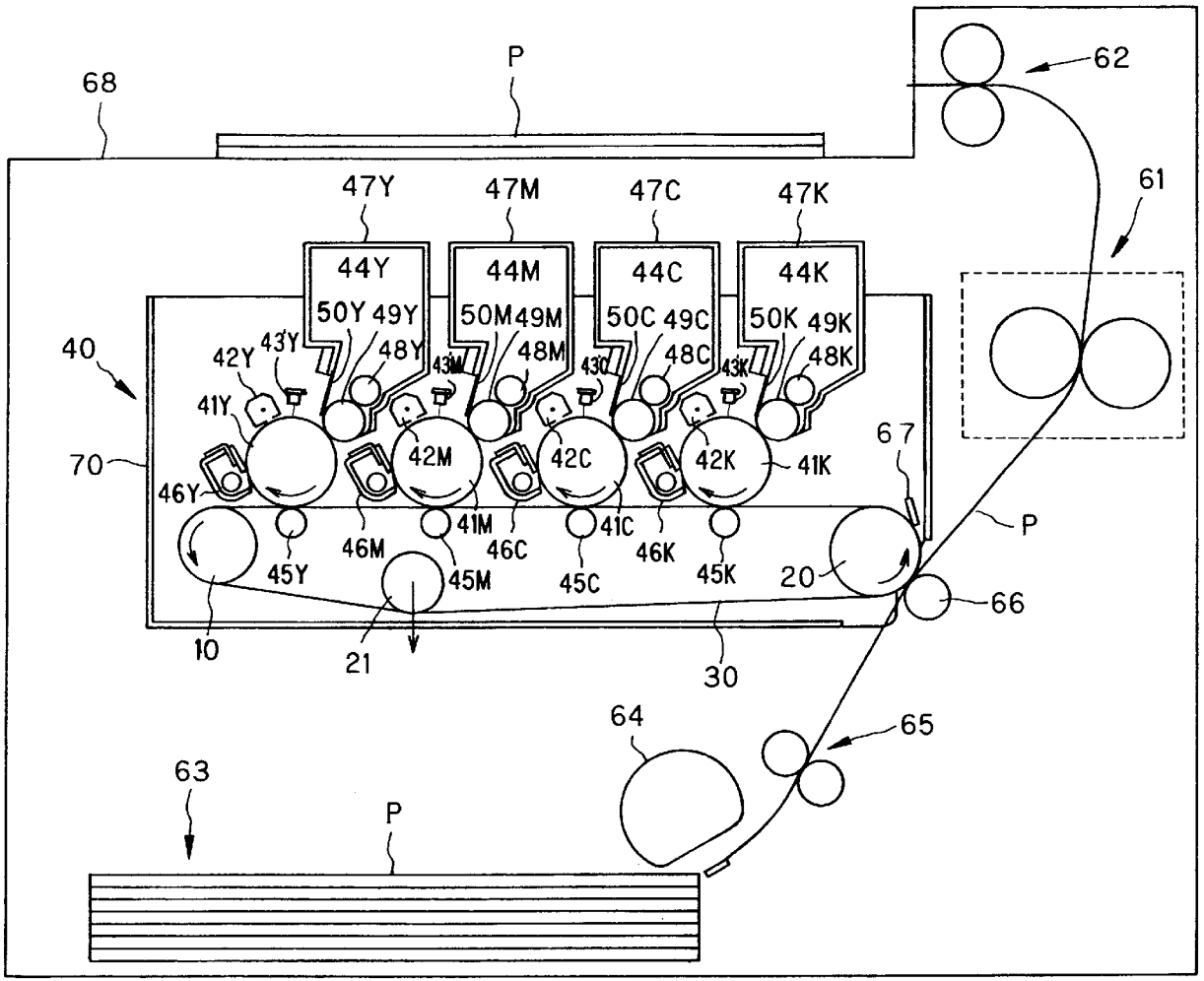
FIG. 40 is similar to FIG. 28, showing an embodiment of the invention wherein the exposure devices are integrated with the photosensitive member cartridge.
Figure 41:
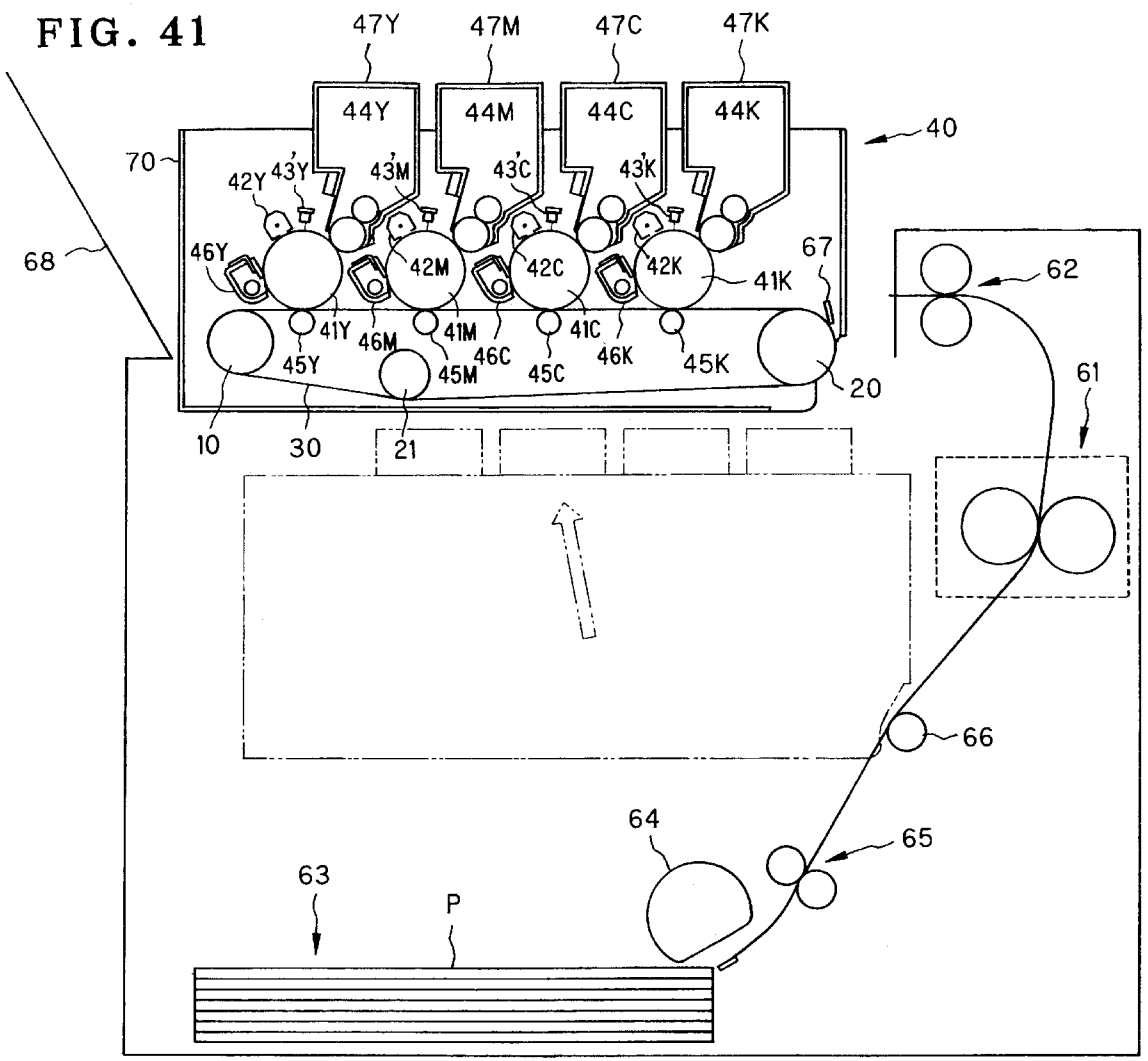
FIG. 41 is similar to FIG. 29, showing an embodiment of the invention wherein the exposure devices are integrated with the photosensitive member cartridge.

FIGS. 40 and 41 are views similar to FIGS. 28 and 29, showing another embodiment of the invention. In this embodiment, no single exposure unit 43 is used unlike the embodiment of FIG. 28. An exposure device 43' (K, C, M, Y) for performing selective exposure per color, corresponding to each photosensitive member 41 (K, C, M, Y), is integrated with a photosensitive member cartridge 40 between a corona charger 42 (K, C, M, Y) and a developing device 44 (K, C, M, Y). In accordance with this embodiment, the photosensitive member cartridge 40 is provided at its frame 70 with four photosensitive members 41K, 41C, 41M and 41Y and their appendixes, i.e., corona chargers 42 (K, C, M, Y), exposure devices 43' (K, C, M, Y) and cleaning devices 45 (K, C, M, Y) while they are relatively positioned. An intermediate transfer belt 30 spanned over a driving roller 10, a follower roller 20 and a tension roller 21 and cleaned by a cleaning blade 67 is attached together with these means to the frame 70 of the photosensitive member cartridge 40 in such a way that it comes into contact with the respective photosensitive members 41 (K, C, M, Y) through primary transfer rollers 45 (K, C, M, Y).

In this embodiment, the exposure unit 43 is dispensed with. Thus, as shown by a double arrow in FIG. 41, the photosensitive member cartridge 40 can be withdrawn from the system proper by lifting it substantially upward. To this end, the output tray 68 is mounted at its one end on the system proper in such a way that it can turn upwardly. The output tray 68 is retracted, thereby defining an opening through which the photosensitive cartridge 40 is withdrawn out of the system. In the state where the photosensitive member cartridge 40 has been withdrawn out of the system, the photosensitive member cartridge 40 can be detached from the system and replaced by a new photosensitive member cartridge 40.

With such an arrangement wherein the exposure devices 43' (K, C, M, Y), photosensitive members 41 (K, C, M, Y), intermediate transfer belt 30 and primary transfer rollers 45 (K, C, M, Y) are constructed in the form of the integral photosensitive cartridge 40, it is possible to adjust nearly all of color misalignment factors at its production stage, thereby providing a system for the formation of images of high quality.

Figure 42:
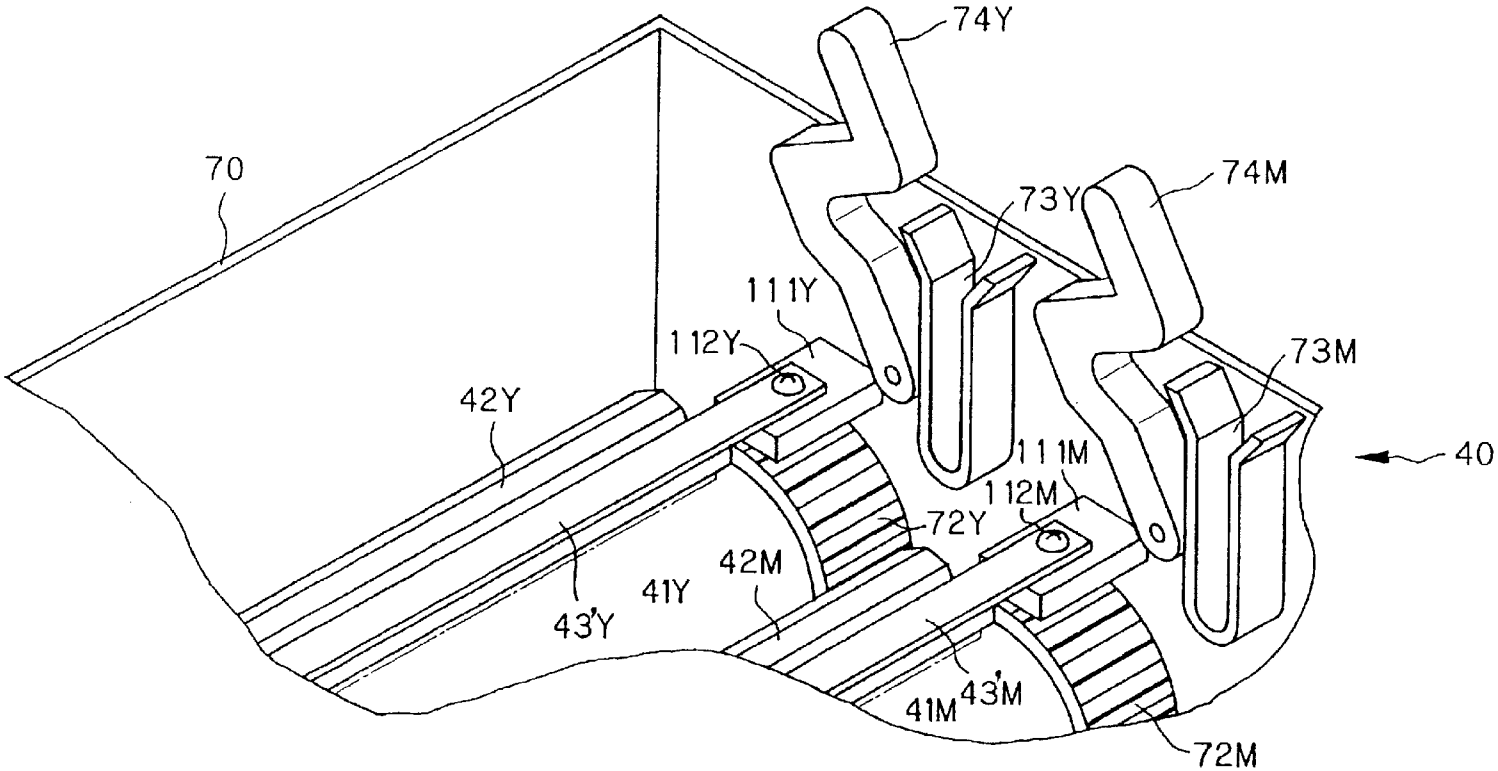
FIG. 42 is a partially enlarged perspective view of one embodiment of how the exposure devices are attached to the frame of the photosensitive member cartridge.

In the embodiment of FIGS. 40 and 41, the frame 70 of the photosensitive member cartridge 40 is provided with the four photosensitive members 41K, 41C, 41M and 41Y and the appendixes thereto, i.e., the corona chargers 42 (K, C, M, Y), the exposure devices 43' (K, C, M, Y), the intermediate transfer belt 30, the driving roller 10, follower roller 20 and tension roller 21 over which the intermediate transfer belt 30 is spanned, the primary transfer rollers 45 (K, C, M, Y) for bringing the intermediate transfer belt 30 in contact with the photosensitive members 41 (K, C, M, Y) and the cleaning blade 67 for cleaning the intermediate transfer belt 30 while they are relatively positioned. FIG. 42 is illustrative of one embodiment of how the exposure devices 43' (K, C, M, Y) are attached to the frame 70 of the photosensitive member cartridge 40. To be specific, FIG. 42 is a partly enlarged perspective view of only one end portions of the photosensitive members 41Y and 41M in the photosensitive member cartridge 40. To mount the exposure devices 43' (K, C, M, Y) at precisely located positions on the associated photosensitive members 41 (K, C, M, Y) and parallel therewith, mounting struts 111 (K, C, M, Y) are integrally provided, extending from the inside surfaces of both side plates of the frame 70 and opposing to each other. Each strut 111 (K, C, Y, M) is provided with locating holes for receiving locating pins and threaded holes, both holes not shown. Locating pins 115 provided at both ends of a long-length substrate 113 (FIG. 22) of each exposure device 43' (K, C, M, Y) are inserted into the locating holes in the associated mounting strut 111 (K, C, M, Y) while fixing screws 112 (K, C, M, Y) are fixedly screwed into the threaded holes in the mounting strut 111 (K, C, M, Y) through screw-insertion holes in both ends of the long-length substrate 113 (FIG. 22), so that the each exposure device 43' (K, C, M, Y) is fixed in place.

FIG. 22 is a perspective schematic of each exposure device 43' (K, C, M, Y) constructed in the form of an LED line head comprising an LED array 116. As mentioned above, each exposure device 43' (K, C, M, Y) is mounted on the long-length substrate 113, spanning between both side plates of the frame 70. The LED array 116 for forming a line image on the photosensitive member 41 (K, C, M, Y) and parallel with its axis is mounted on the long-length substrate 113, with each LED connected to a driver IC 117 for controlling light emission. The long-length substrate 113 is provided at each end with a locating pin 115 for the determination of a mounting position and a hole 114 for the insertion of a mounting screw. Thus, each exposure device is fixed at a precise position for the associated photosensitive member 41 (K, C, M, Y). In front of the LED array 116 there is integrally fixed a gradient index type rod lens array 118 having an image-formation action, by which a train of light emission points defined by the LED array 116 is allowed to form an image on the photosensitive surface of the associated photosensitive member 41 (K, C, M, Y).

Figure 43:
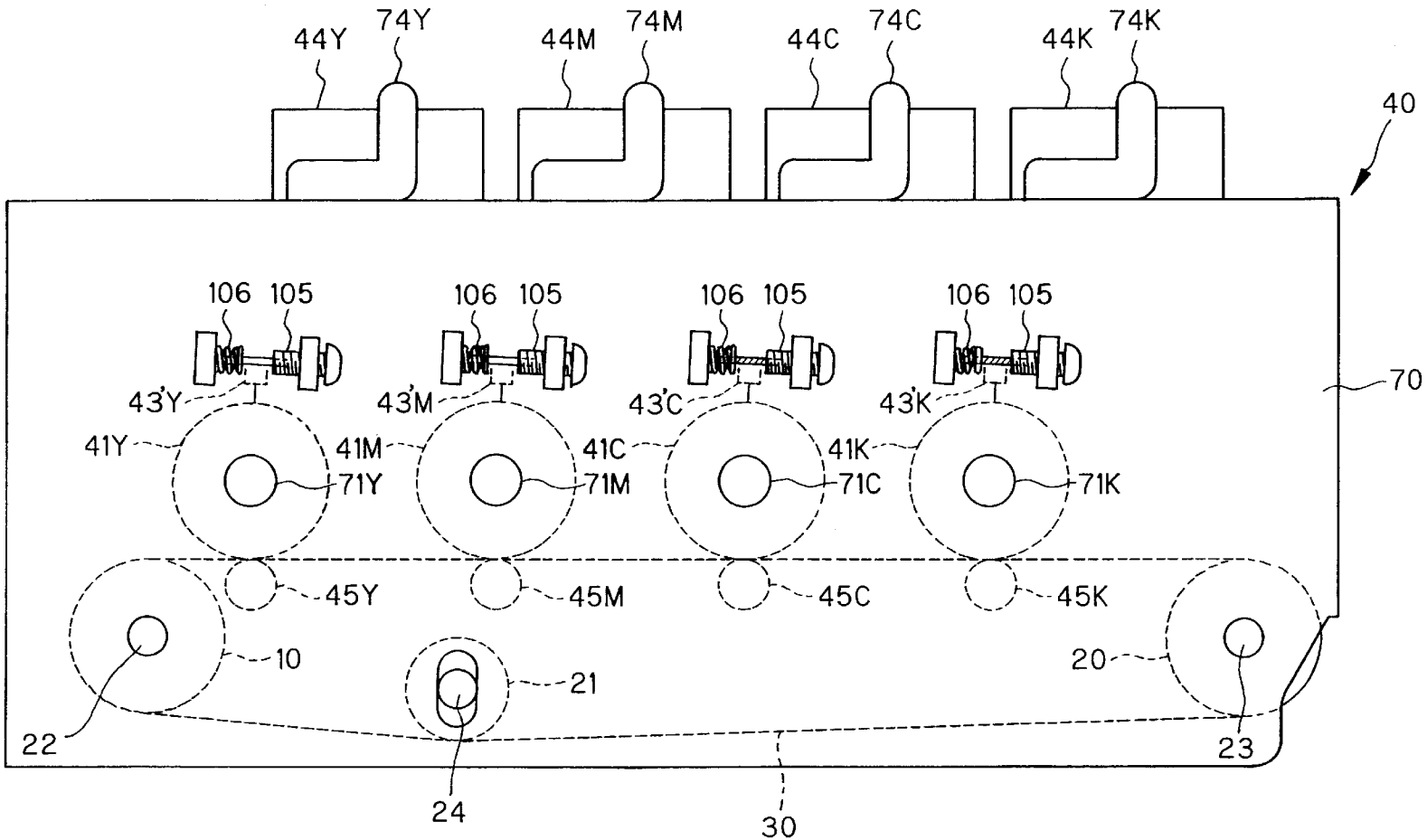
FIG. 43 is illustrative of another embodiment of the mechanism for adjusting the photosensitive member cartridge for color misalignments.

FIG. 43 is illustrative of one embodiment of the mechanism for adjusting color misalignments occurring due to relative position misalignments between the exposure devices 43'K, 43'C, 43'M and 43'Y positioned and mounted on the photosensitive members 41 (K, C, M, Y) of the photosensitive member cartridge 40 of FIGS. 40 and 41, especially skews in parallelism, when four different monochromatic toner images are transferred onto the intermediate transfer belt 30 in a superposed fashion. As shown in FIG. 43, while the mounting ridge 111 (K, C, M, Y) of each exposure device 43' (K, C, M, Y) extending from one side plate of the frame 70 or a long-length substrate 113 is sandwiched between an adjustment screw 105 and the leading end of an extensible spring 106, the other end of the extensible spring 106 is fixed to the side plate 70. In this state, if the leading end of the adjustment screw 105 is adjustable in the direction opposite to the direction of extension of the extensible spring 106 to adjust the position of one end of the exposure device 43' (K, C, M, Y), it is then possible to adjust skews in parallelism between the exposure devices 43'K, 43'C, 43'M and 43'Y. It is not always required to provide all the four exposure devices 43'K, 43'C, 43'M and 43'Y with such color misalignment adjustment mechanisms. It is noted that it is acceptable to provide the opposite ends of the exposure devices 43' (K, C, M, Y) with such color misalignment adjustment mechanisms. However, this is not always necessary because misalignments can be electrically eliminated by controlling the timing of when color latent images formed at the exposure devices 43' (K, C, M, Y) are to be written, as long as given parallelism is maintained between the exposure devices 43' (K, C, M, Y).

By providing the photosensitive member cartridge 40 with the position alignment mechanism for the exposure devices 43' (K, C, M, Y) in this way, it is possible to make fine adjustments of the positions of the photosensitive members 41 (K, C, M, Y) onto which latent images are to be written and transferred, thereby reducing color misalignments. It is here noted that the color misalignment adjustment by this color (position) misalignment adjustment mechanism may be made upon shipment of the photosensitive member cartridge 40 or anytime after its attachment to the system proper.

Figure 27:
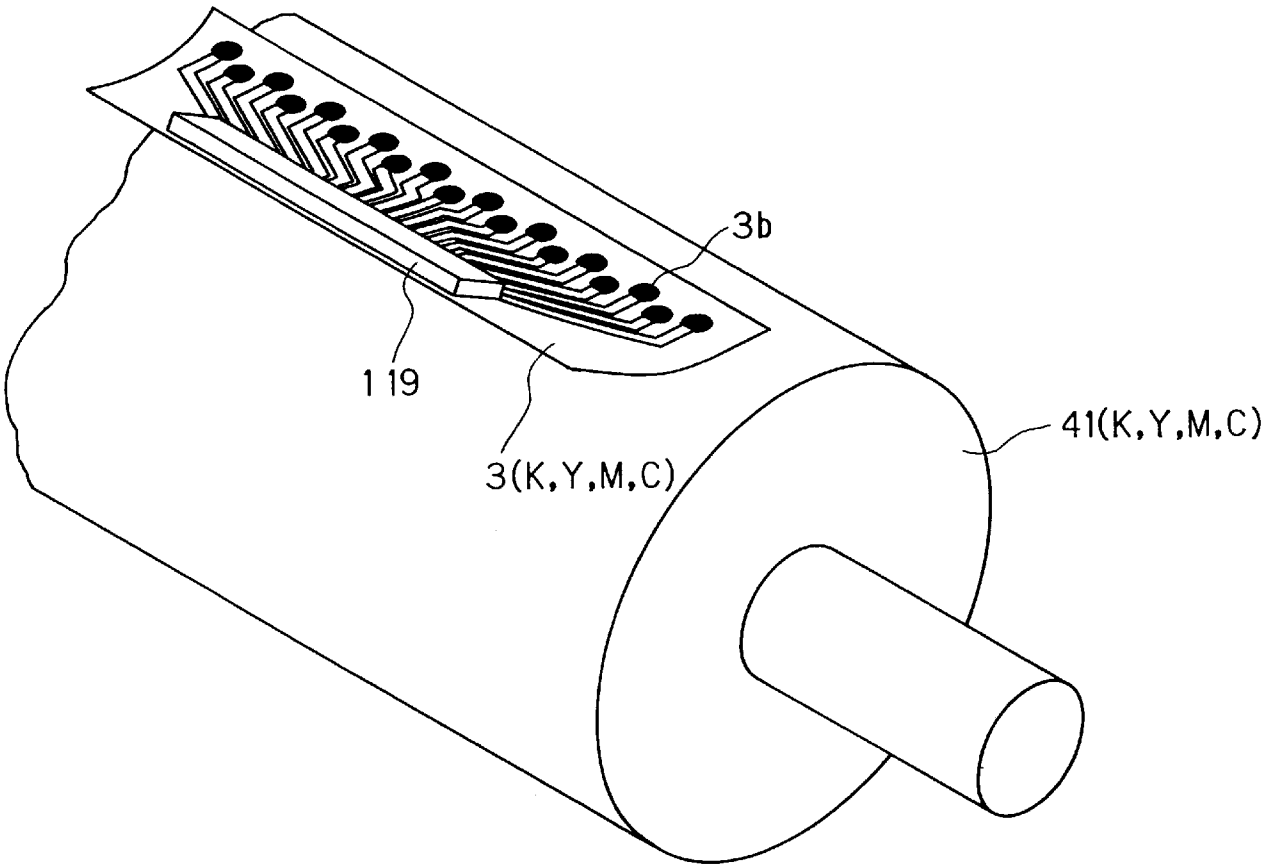
FIG. 27 is a perspective schematic illustrative of how the charge injection electrode line head of FIG. 26 is positioned and constructed with respect to the photosensitive member.

In the embodiment of FIGS. 40 and 41, the write means that are integrally mounted together with the photosensitive members 41 (K, C, M, Y) on the photosensitive member cartridge 40 are not necessarily limited to such optical write means as shown in FIG. 22. For instance, it is acceptable to make use of write means having recourse to charge transfer such as injection or elimination of charges, for instance, those proposed by the applicant in Japanese Patent Application Nos. 2000-298925 and 2000-298927, etc. FIG. 27 is a front schematic illustrative of the whole construction of a color image formation system wherein charge injection electrode line heads 3 (K, C, M, Y) are used as write means, and FIG. 27 is a perspective schematic illustrative of how the charge injection electrode line heads 3 (K, C, M, Y) are arranged and constructed with respect to photosensitive members 41 (K, C, M, Y). When writing is carried out by the injection of charges, it is not always necessary to use the chargers 42 (K, C, M, Y) of FIG. 40. The charge injection electrode line head 3 (K, C, M, Y) comprises an array of electrodes 3*b* that come in contact with the associated photosensitive member 41 (K, C, M, Y) to create a potential profile therein and so form a latent image. Charges injected into each electrode 3*b* are controlled by a driver IC119.

In accordance with the inventive color image formation system wherein, as explained above, a plurality of photosensitive members 41 (K, C, M, Y) and the intermediate transfer belt 30 are mutually positioned and mounted on a photosensitive member cartridge 40 detachable from and attachable to the system proper and developing devices 44 (K, C, M, Y) are disposed in such a way as to be detachable from and attachable to the photosensitive members 41 (K, C, M, Y) mounted on the photosensitive member cartridge 40, the precision of relative positions between the photosensitive members is so improved that color misalignments ascribable to misalignments between the photosensitive members and skews thereof can be prevented.

Gears can be associated with the photosensitive members in such phase relations as to reduce speed fluctuations due to the gears that drive the photosensitive member, so that the cartridge 40 can be constructed in an integral form. In addition, color misalignments due to the photosensitive member-driving gears can be considerably reduced (FIG. 34 and so on). Where the photosensitive members are individually mounted on the system proper, it is impossible to make phase adjustments of such gears because the photosensitive members rotate by themselves.

Further, the photosensitive member cartridge 40 can be finished up using photosensitive members of uniform performance singled out at the time of shipping, so that color changes due to variations in the properties of the photosensitive members of different colors can be prevented. In addition, the integrity of maintenance can be improved because a plurality of photosensitive members can be replaced at the same time.

Furthermore, the arrangement wherein the developing devices 44 (K, C, M, Y) are designed as detachable from and attachable to the photosensitive member cartridge 40 ensures that the developing devices 44 (K, C, M, Y) can be replaced independently of the photosensitive member cartridge 40. Therefore, even when the developing devices 44 (K, C, M, Y) are exhausted or used up and so must be replaced with new ones, there is no need of making a replacement for the photosensitive members 41 (K, C, M, Y), so that running cost reductions are achievable.

What is necessary when the developing devices 44 (K, C, M, Y) are used up is only their replacement. There is no need of any color matching operation depending on the positions and configuration of the photosensitive members 41 (K, C, M, Y. It is thus possible to provide an image formation system having improved operating efficiency.

For replacement of the developing devices 44 (K, C, M, Y), only the withdrawal of the photosensitive member cartridge 40 is needed. Then, new developing devices are attached to the photosensitive member cartridge 40. Thus, the operation for replacement of the developing devices 44 (K, C, M, Y) is so facilitated that the integrity of maintenance can be improved.

It is also acceptable to construct a plurality of photosensitive members 41 (K, C, M, Y) and the intermediate transfer belt 30 in the form of one single replacement and the developing devices 44 (K, C, M, Y) in the form of one single replacement 47 (FIG. 32), so that the integrity of maintenance can be much more improved.

The fourth aspect of the color image formation system according to the present invention is now explained with reference to some embodiments.

The color image formation system according to the third aspect of the present invention is now explained with reference to some embodiments.

Figure 44:
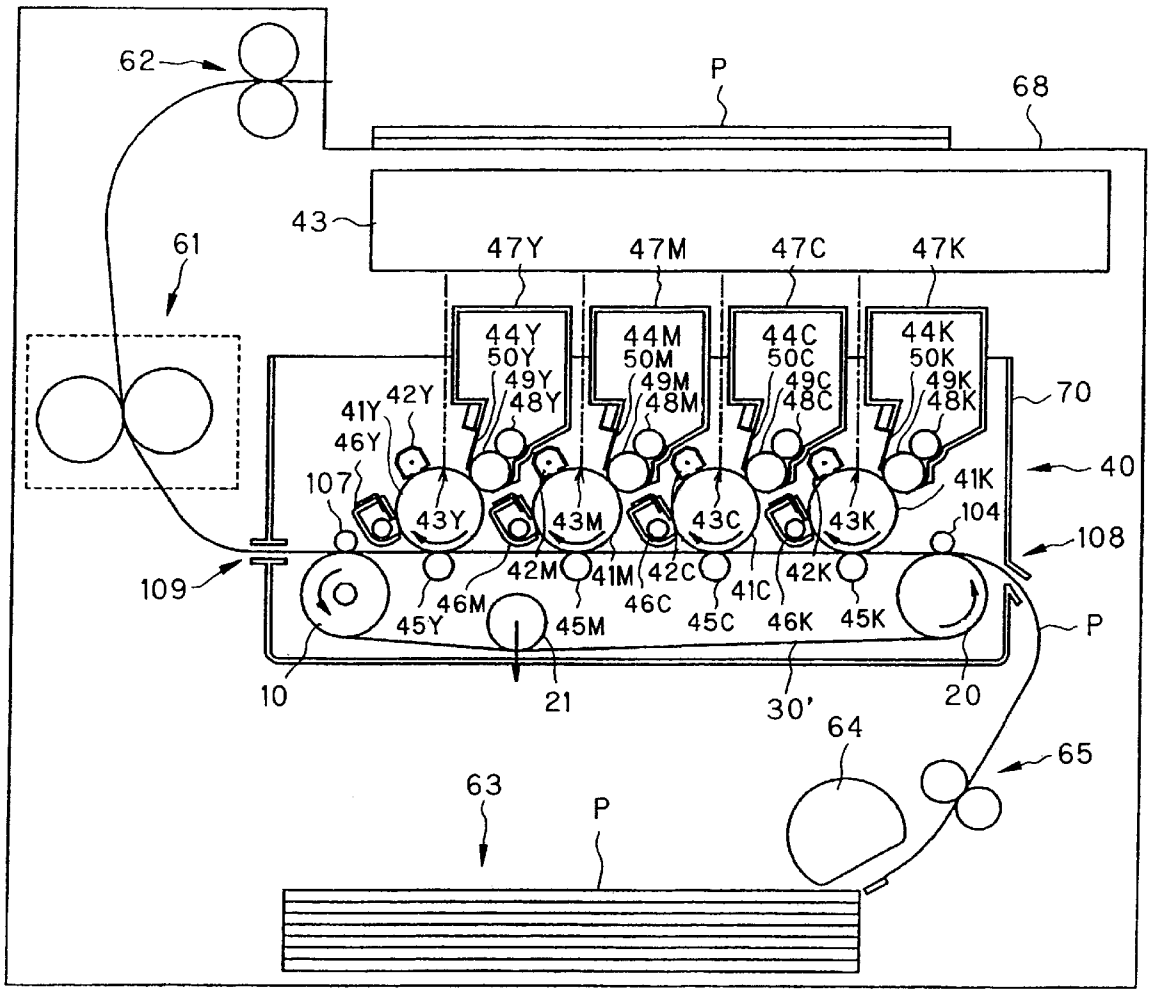
FIG. 44 is a front schematic illustrative of the whole construction of a further color image formation system to which the invention is applied.

FIG. 44 is a front schematic illustrative of the whole construction of a further color image formation system to which the invention is applied. As shown in FIG. 44, this image formation system comprises a recording medium carrier belt 30' that is spanned in place with tensions applied thereon by a driving roller 10, a follower roller 20 and a tension roller 21, and driven endlessly in the (counterclockwise) direction shown by an arrow. Four photosensitive members (drums) 41K, 41C, 41M and 41Y having photosensitive layers on their outer surfaces, i.e., image carriers, are arranged at a given interval with respect to the recording medium carrier belt 30'. The capital letters K, C, M and Y added to the numeral reference mean black, cyan, magenta and yellow, indicating the photosensitive members for black, cyan, magenta and yellow, respectively. The same holds true for other members. The photosensitive members 41K, 41C, 41M and 41Y are rotationally driven in synchronism with the recording medium carrier belt 30' in the (clockwise) direction indicated by an arrow. Around each photosensitive member 41 (K, C, M, Y), there is located a corona charger 42 (K, C, M, Y) comprising Scorotron acting as means for uniformly charging the outer surface of the photosensitive member 41 (K, C, M, Y), an exposure site 43 (K, C, M, Y) for selectively exposing the outer surface of the member 41 uniformly charged by the corona charger 42 (K, C, M, Y) to exposure light from an exposure unit 43 for each color, thereby forming an electrostatic latent image, a developing device 44 (K, C, M, Y) for imparting a developing agent that is a toner to the electrostatic latent image formed at this exposure site 43 (K, C, M, Y) to make a visible (toner) image, a transfer roller 45 (K, C, M, Y) for successively transferring toner images developed at this developing device 44 (K, C, M, Y) onto a recording medium P carried by the recording medium carrier belt 30' for transfer purposes, and a cleaning device 46 (K, C, M, Y) working as cleaning means for removing the remnants of toner on the surface of the photosensitive member 41 (K, C, M, Y) after transfer.

Figure 47:
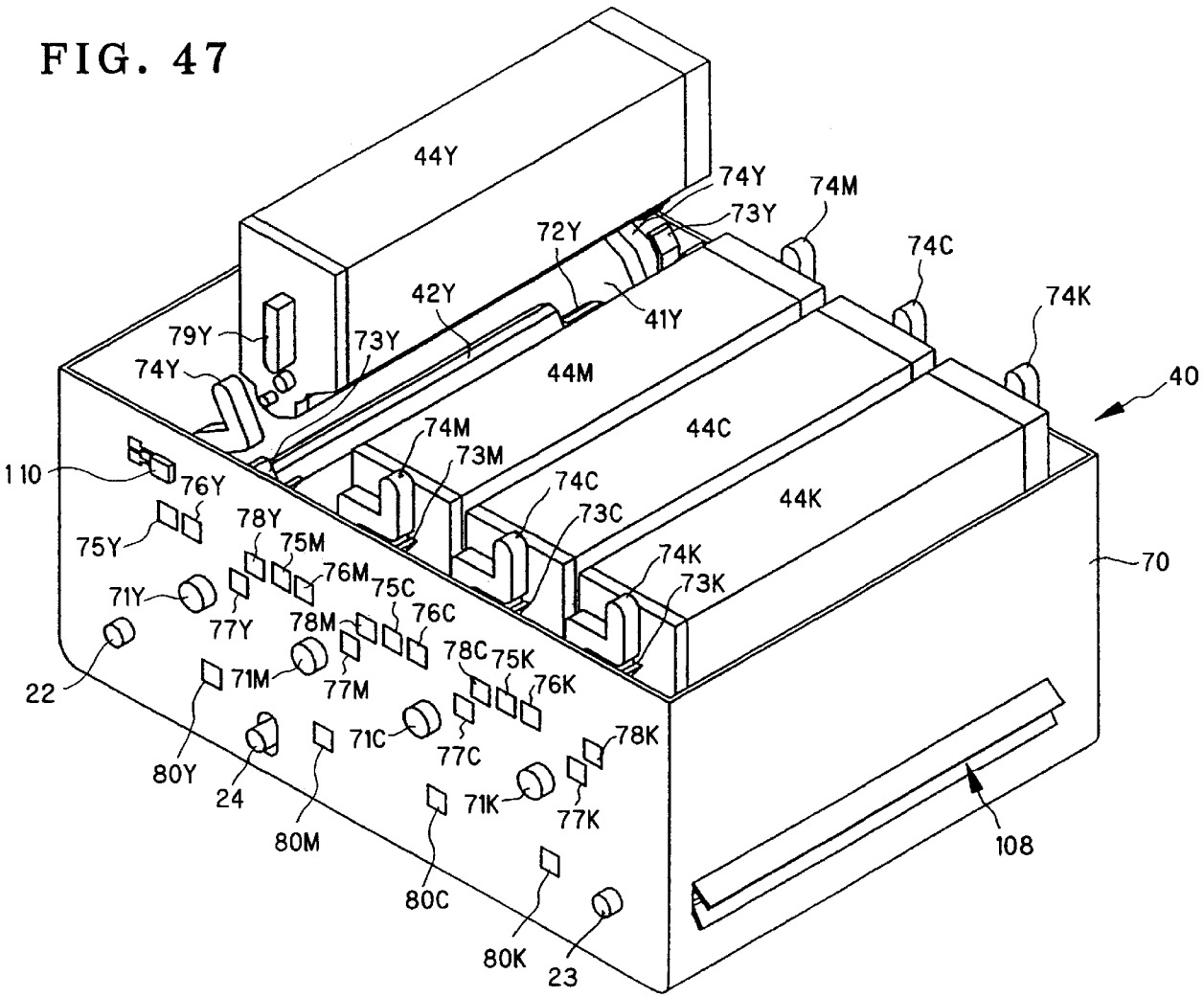
FIG. 47 is a perspective view illustrative of how one of a plurality of developing devices is detached from or attached to the photosensitive member cartridge with the rest remaining mounted thereon.

Typically using a non-magnetic mono-component toner as the developing agent, the developing device 44 (K, C, M, Y) is constructed in the form of a developing cartridge 47 (K, C, M, Y) (see FIG. 47). Such a mono-component toner stored in the cartridge 47 is delivered to a developing roller 49 (K, C, M, Y) by way of a feed roller 48 (K, C, M, Y). The thickness of a developing agent film deposited onto the surface of the developing roller 49 (K, C, M, Y) is controlled by a control blade 50 (K, C, M, Y). Then, the developing roller 49 (K, C, M, Y) is brought into contact or engagement with the photosensitive member 41 (K, C, M, Y) so that the developing agent is deposited onto the photosensitive member 41 (K, C, M, Y) depending on the potential level of the photosensitive member, thereby developing the latent image in the form of a toner image.

The black, cyan, magenta and yellow toner images formed at four such different monochromatic toner image-formation stations are successively transferred onto the recording medium P carried by transfer biases applied on the transfer rollers 45 (K, C, M, Y), so that they are superposed successively one upon another on the recording medium P, yielding a full-color toner image thereon. Then, the recording medium P with the full-color toner image carried thereon is released from the recording medium carrier belt 30' by a release roller 107, passing between a pair of fixing rollers 61 that are fixing means so that the toner image is fixed on the recording medium P. Finally, the recording medium is ejected by way of a pair of ejecting rollers 62 on an output tray 68 mounted on the top of the system.

In FIG. 44, it is noted that reference numeral 63 is a sheet feed cassette for storing a multiplicity of recording media P in a superposed fashion, 64 a pickup roller for feeding recording media P from the sheet feed cassette 63 one by one, 65 is a pair of gate rollers for controlling the timing of when the recording medium P is to be fed to a transfer site of the transfer roller 45 (K, C, M, Y), and 104 a sheet absorption roller for absorbing the recording medium P carried by the pickup roller 64 onto the recording medium carrier belt 30'.

Since a mono-component developing agent such as a non-magnetic mono-component toner is used, there is no need of using a carrier such as a two-component developing agent. Accordingly, it is possible to reduce the volume of each developing device 44 (K, C, M, Y) and so achieve a color image formation system of small size.

Figure 45:
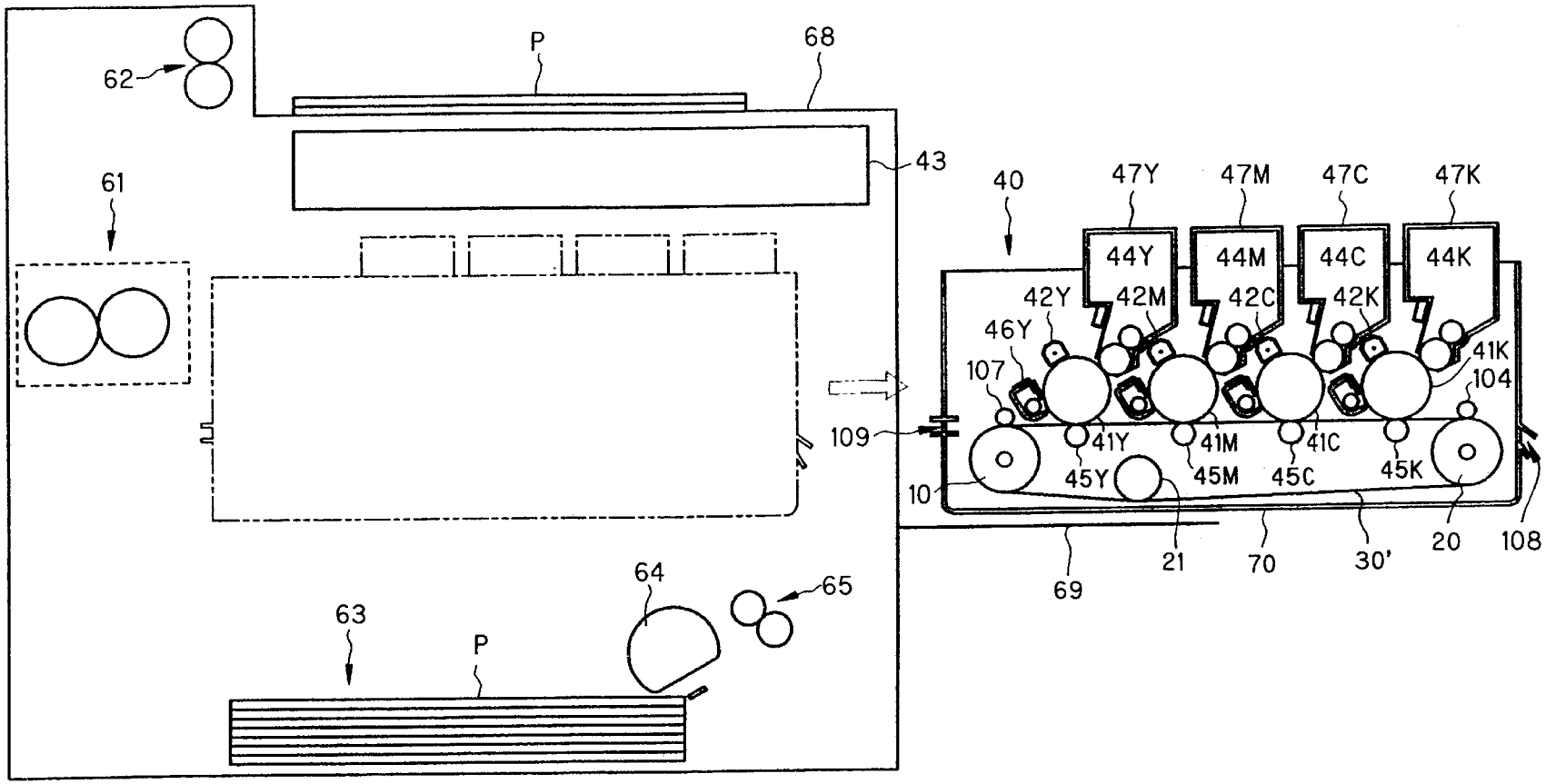
FIG. 45 is illustrative of the system of FIG. 44, from which the photosensitive member cartridge is withdrawn.

In such a color image formation system as constructed as explained above according to the present invention, the four photosensitive members 41K, 41C, 41M and 41Y, the corona chargers 42 (K, C, M, Y, the cleaning devices 46 (K, C, M, Y), the recording medium carrier belt 30', the driving roller 10, follower roller 20 and tension roller 21 over which the recording medium carrier belt 30'are spanned, the transfer rollers 45 (K, C, M, Y) for bringing the recording medium carrier belt 30' in contact with the photosensitive members 41 (K, C, M, Y), the sheet absorption roller 104 for absorbing the recording medium P onto the recording medium carrier belt 30' and the release roll 107 for releasing the recording medium P with a toner image carried thereon from the recording medium carrier belt 30' are all constructed in the form of the integral photosensitive member cartridge 40 that can be detached from or attached to the system proper, as shown in FIGS. 44 and 45. In this case, the developing devices 44K, 44C, 44M and 44Y that are appendixes to the photosensitive members 41K, 41C, 41M and 41Y are detachable from and attachable to the photosensitive member cartridge 40.

Referring to FIG. 45, the photosensitive member cartridge 40 is provided on its frame 70 with the four photosensitive members 41K, 41C, 41M and 41Y and their appendixes, i.e., the corona chargers 42 (K, C, M, Y) and cleaning devices 46 (K, C, M, Y) while they are relatively positioned with respect to one another. The recording medium carrier belt 30', which is spanned over the driving roller 10, follower roller 20 and tension roller 21 and from which the recording medium P with a toner image carried thereon, is mounted together with these means on the frame 70 of the photosensitive member cartridge 40 in such a way that it comes in contact with the photosensitive members 41 (K, C, M, Y) via the transfer rollers 45 (K, C, M, Y). These members can be slid out of the system proper as shown by a double arrow. To this end, for instance, the side plate 69 of the system proper is opened outwardly, thereby defining an opening through which the photosensitive cartridge 40 is withdrawn out of the system. In the state where the photosensitive member cartridge 40 has been withdrawn out of the system proper, the photosensitive member cartridge 40 can be detached from the system and replaced by a new photosensitive member cartridge 40. It is here noted that one side plate of the frame 70 of the photosensitive member cartridge 40 is provided with a sheet inlet 108 for feeding the recording medium P supplied by the pickup roller 64 onto the recording medium carrier belt 30' and the other side plate of the frame 70 is provided with a sheet port 109 for ejecting the recording medium P with a toner image carried thereon, which is released by the release roller 107 from the recording medium carrier belt 30'.

Figure 46:
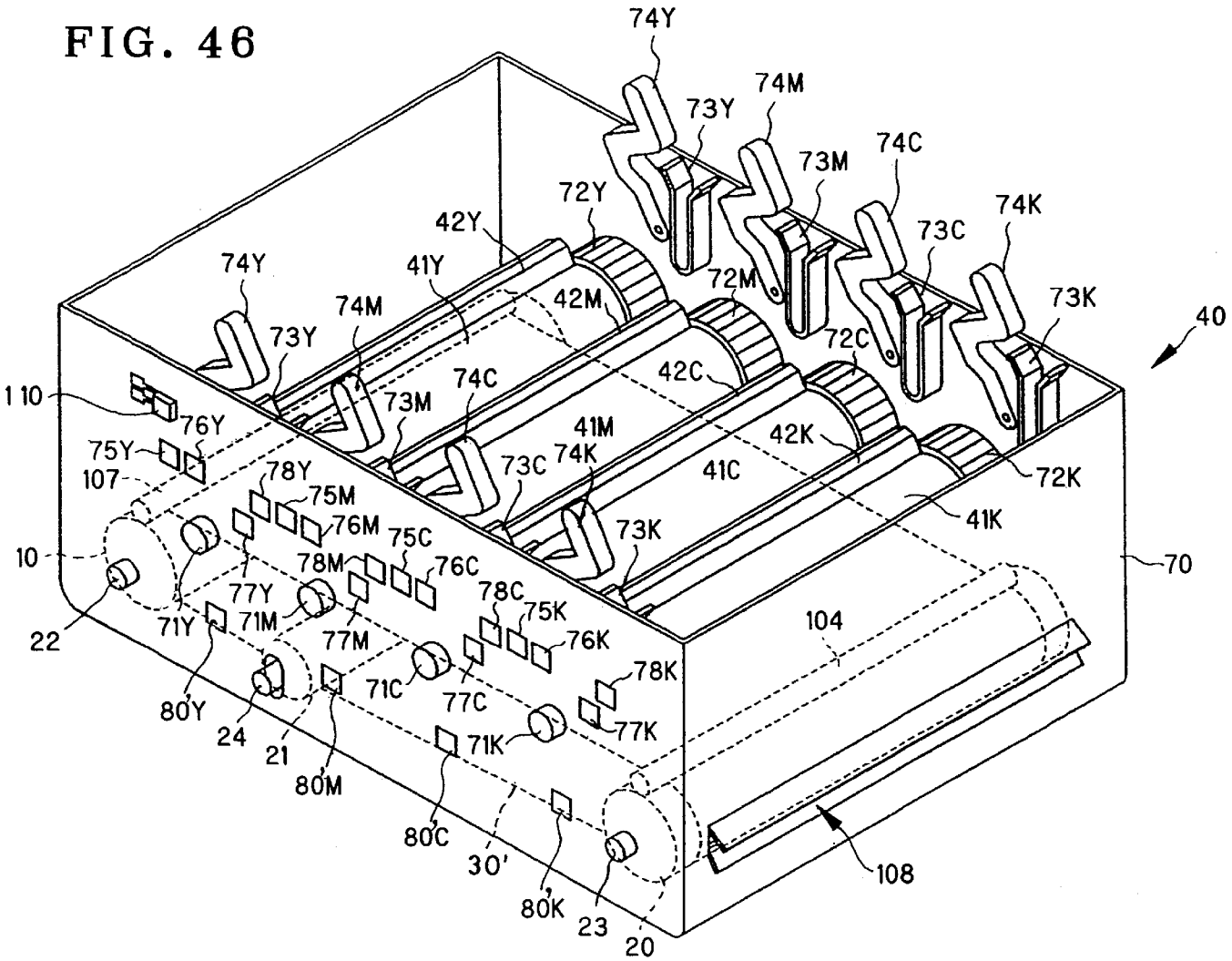
FIG. 46 is a perspective view of the photosensitive member cartridge from which the developing devices are removed.

FIG. 46 is a perspective view of the photosensitive cartridge 40 from which the developing devices 44K, 44C, 44M and 44Y are removed, and FIG. 47 is a perspective view illustrative of how the developing device 44Y is detached from or attached to the photosensitive member cartridge 40 with the developing devices 44K, 44C and 44M remaining mounted thereon. The frame 70 is in a rectangular box form, between both sides plates of which there are four photosensitive members 41K, 41C, 41M and 41Y that are positioned at a given interval and parallel with one another for rotation on their shafts 71K, 71C, 71M and 71Y. The shaft 71 (K, C, M, Y) of each photosensitive member 41 (K, C, M, Y) is provided at its one end with a gear 72 (K, C, M, Y). By way of the gear train to be referred to later, the photosensitive members 41 (K, C, M, Y) are rotatable in the (clockwise) direction indicated by the arrow in FIG. 28 at the same speed and in synchronism with one another.

Between the same two side plates of the frame 70, the corona chargers 42 (K, C, M, Y) and cleaning devices 46 (K, C, M, Y) (which, in FIG. 46, are invisible because of being concealed by the photosensitive members 41 (K, C, M, Y) and frame 70), all appendixes to the photosensitive members 41 (K, C, M, Y), are mounted at given positions. On one side of the side plate of the frame 70 there are provided electrodes 75 (K, C, M, Y) for applying high voltages on the discharge wires of the corona chargers or Scorotrons 42 (K, C, M, Y) and electrodes 76 (K, C, M, Y) for applying high voltages on the grits of the Scorotrons. On the same one side of the side plate of the frame 70 there are also provided electrodes 77 (K, C, M, Y) for applying developing bias voltages on the developing rollers 49 (K, C, M, Y) of the developing devices 44 (K, C, M, Y) in the state where the developing devices 44 (K, C, M, Y) are mounted on the photosensitive member cartridge 40 and electrodes 78 (K, C, M, Y) for applying developing feed bias voltages on the feed rollers 48 (K, C, M, Y) in the same state.

Between both side plates of the frame 70, the driving roller 10, follower roller 20 and tension roller 21, over which the recording medium carrier belt 30' is spanned, are mounted parallel with one another at a given interval in such a manner that they are rotatable on shafts 22, 23 and 23, and the transfer rollers 45 (K, C, M, Y), appendixes to the photosensitive members 41 (K, C, M, Y), are mounted at given positions (although not shown in FIGS. 46 and 47). On the same side of the side plate of the frame 70, there are mounted electrodes 80' (K, C, M, Y) for applying transfer voltages on the transfer rollers 45 (K, C, M, Y).

On the same side plate, there is further provided an IC 110 as memory means for storing information about the fabrication and use of the photosensitive member cartridge 40, color misalignments, etc. Upon the photosensitive member cartridge 40 mounted on the system proper, the electrodes 75 (K, C, M, Y), electrodes 76 (K, C, M, Y), electrodes 77 (K, C, M, Y), electrodes 78 (K, C, M, Y), electrodes 80' (K, C, M, Y) and IC 110 are automatically connected to the power source circuit and control circuit of the system proper. In this state, the shafts 71 (K, C, M, Y) of the photosensitive members 41 (K, C, M, Y) are also automatically connected to ground for earth purposes.

At the inner upper sides of the same two side plates of the frame 70, there are provided guide grooves 73 (K, C, M, Y) for receiving the developing devices 44 (K, C, M, Y) at constant positions corresponding to the photosensitive members 41 (K, C, M, Y). To fix the developing devices 44 (K, C, M, Y) received along the guide grooves 73 (K, C, M, Y), fixing levers 74 (K, C, M, Y) are pivotally provided. On both sides of the developing cartridge 47 (K, C, M, Y) of each developing device 44 (K, C, M, Y), there are guide ridges 79 (K, C, M, Y) that are to be inserted in the associated guide grooves 73 (K, C, M, Y) from the upper open ends thereof (see FIG. 47 where only one guide ridge 79Y of the developing cartridge 47Y is visible). To mount the developing devices 44 (K, C, M, Y) on the associated photosensitive members 41 (K, C, M, Y), the guide ridges 79 (K, C, M, Y) are inserted from above into the associated guide grooves 73 (K, C, M, Y) and the fixing levers 74 (K, C, M, Y) are then pivoted to fix the developing devices in place. To remove the developing cartridges 47 (K, C, M, Y) for replacement or other purposes, the fixing levers 74 (K, C, M, Y) are pivoted back to guide the developing cartridges 47 (K, C, M, Y) upward along the guide grooves 73 (K, C, M, Y).

According to the embodiment of FIG. 47, the developing cartridges 47 (K, C, M, Y) forming part of the individual developing devices 44 (K, C, M, Y) can separately be attached to or detached from the associated photosensitive members 41 (K, C, M, Y); of the developing devices 44 (K, C, M, Y), only an exhausted or dead developing device(s) can be replaced with no wasteful replacement of the rest, so that running cost reductions are achievable.

Figure 48:
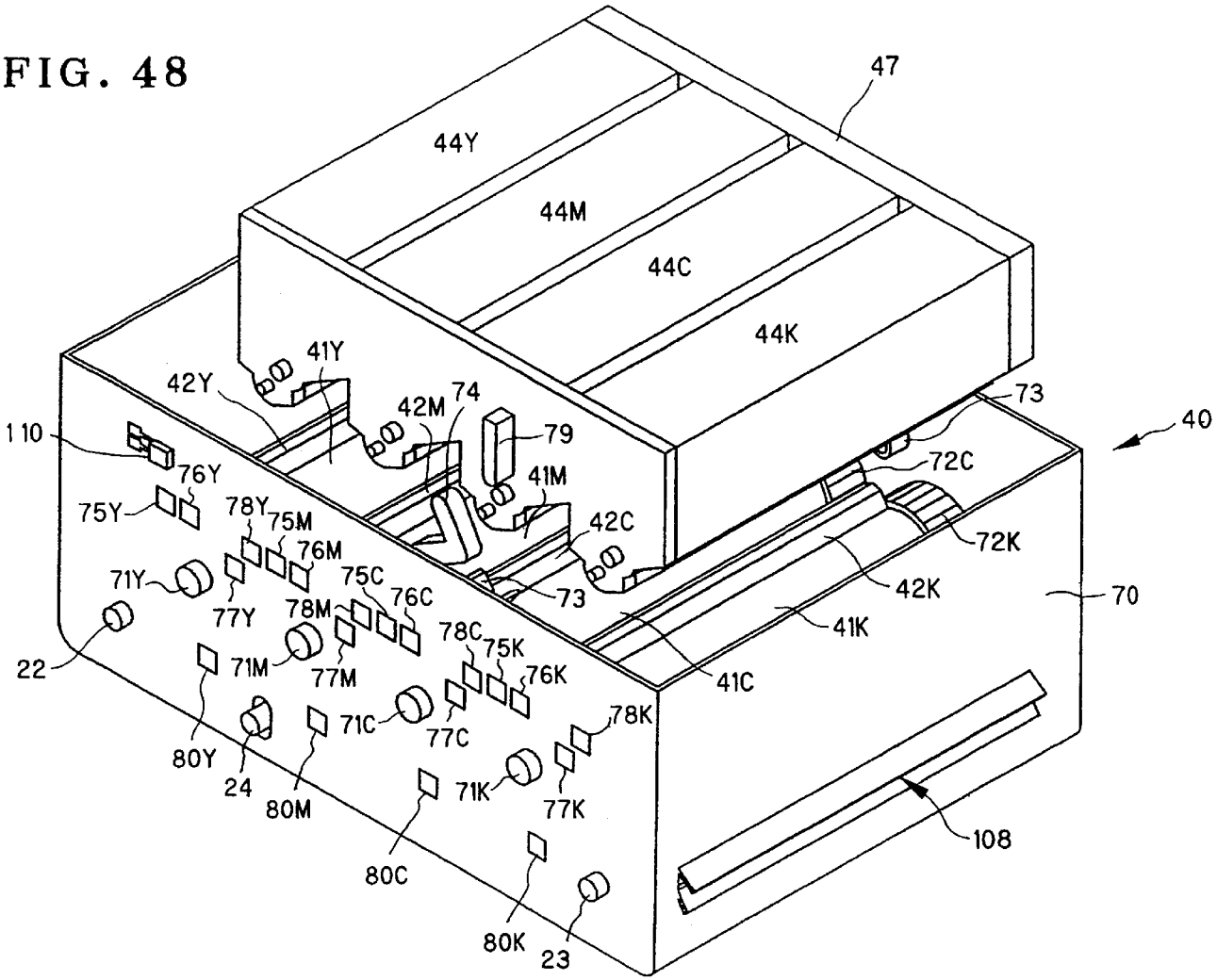
FIG. 48 is a perspective view illustrative of the attachment/detachment mechanism for one embodiment where all developing devices are constructed in the form of an integral developing cartridge.

FIG. 48 is a perspective view illustrative of the attachment/detachment mechanism for an embodiment of the invention wherein four or black, cyan, magenta and yellow developing devices 44 (K, C, M, Y) are constructed in the form of the integral development cartridge 47 for such a photosensitive member cartridge 40 as described above. In this embodiment, only one pair of guide grooves 73 are provided at the inner upper sites of both side plates of the frame 70 of the photosensitive member cartridge 40, spanning between both side plates. Accordingly, only one pair of pivotal fixing levers 74 are provided. On the other hand, the four developing devices 44 (K, C, M, Y) are constructed in the form of the integrated single developing cartridge 47. On each side of the developing cartridge 47 there is mounted a guide ridge 79 that is to be inserted into the associated guide groove 73 from the upper open end thereof (in FIG. 48, one guide ridge 79 alone is visible). To mount the developing cartridge 47 on the photosensitive member cartridge 40, the guide ridges 79 are inserted from above into the guide grooves 73 and the fixing levers 74 are then pivoted to fix the developing cartridge in place. To remove the developing cartridge 47 for replacement or other purposes, the fixing levers 47 are pivoted back so that the developing cartridge 47 can be guided upward along the guide grooves 73.

The embodiment of FIG. 48, wherein the four or black, cyan, magenta and yellow developing devices 44 (K, C, M, Y) are designed as the integral developing cartridge 47, has the merit of reducing the number of consumable parts, thereby improving the integrity of maintenance and avoiding a risk of anything wrong happening upon mounting.

Figure 49:
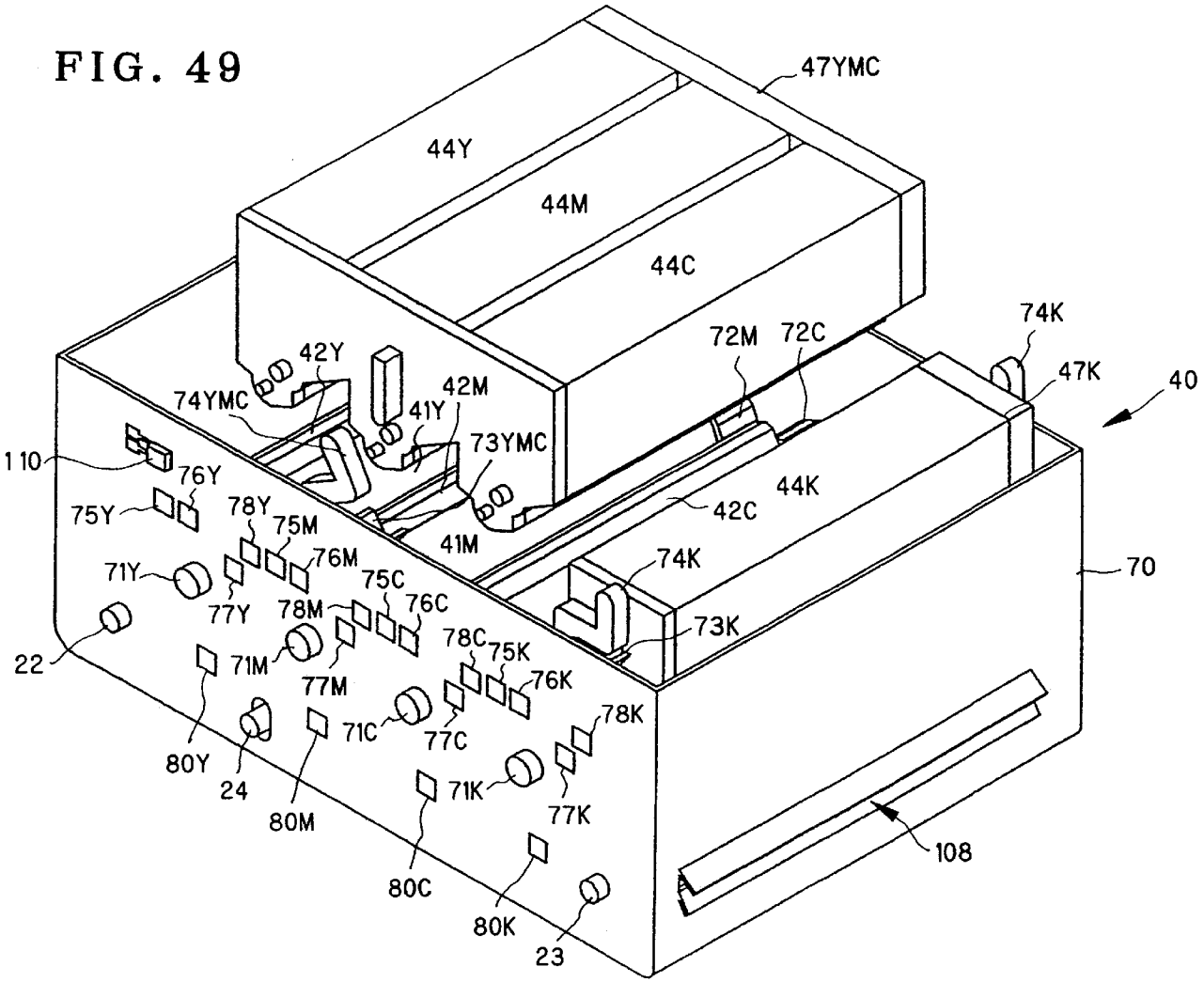
FIG. 49 is a perspective view illustrative of the attachment/detachment mechanism for an embodiment of the invention, wherein the black developing device is constructed in the form of a single developing cartridge and the remaining developing devices are constructed in the form of an integral developing cartridge.

FIG. 49 is a perspective view illustrative of the attachment/detachment mechanism for such a photosensitive member cartridge 40 as described above, wherein a black developing device 44K is constructed in the form of one single developing cartridge 47K that is detachable from or attachable to a black photosensitive member 41K as is the case with FIG. 46 or FIG. 47, and three or cyan, magenta and yellow developing devices 44 (C, M, Y) are constructed in the form of an integral developing cartridge 47YMC. At the inner upper sites of both side plates of a frame 70 of the photosensitive member cartridge 40 there are provided guide grooves 73K for receiving the developing cartridge 47K between both side plates and guide grooves 73YMC for receiving the developing cartridge 47YMC, and there are provided pivotal fixing levers 74K and 74YMC, accordingly. On the other hand, the black photosensitive member cartridge 40 is provided on both its sides with guide ridges 79K and the three-color developing cartridge 47YMC is provided on both its sides with guide ridges 79YMC (in FIG. 49, only one guide ridge 79YMC is visible on the developing cartridge 47YMC). To mount the developing cartridge 47K or 47YMC on the photosensitive member cartridge 40, the guide ridges 79K or 79YMC are inserted from above into the guide grooves 73K or 73YMC, whereupon the fixing levers 74K or 74YMC are pivoted to fix the developing cartridge in place. To remove the developing cartridge 47K or 47YMC for replacement or other purposes, the fixing levers 74K or 74YMC are pivoted back so that the developing cartridge 47K or 47YMC can be guided upward along the guide grooves 73K or 73YMC.

The embodiment of FIG. 49, wherein the three-color or cyan, magenta and yellow developing devices 44 (C, M, Y) are constructed in the form of the integral developing cartridge 47YMC, has the merit of removing the number of consumable parts, thereby improving the integrity of maintenance and avoiding a risk of anything wrong happening upon mounting. This embodiment has another merit of preventing the three-color or cyan, magenta and Y developing devices 44 (C, M, Y) from going to waste, because the black developing device 44K most frequently used in general can be replaced in the form of the independent developing cartridge 47K.

Figure 50:
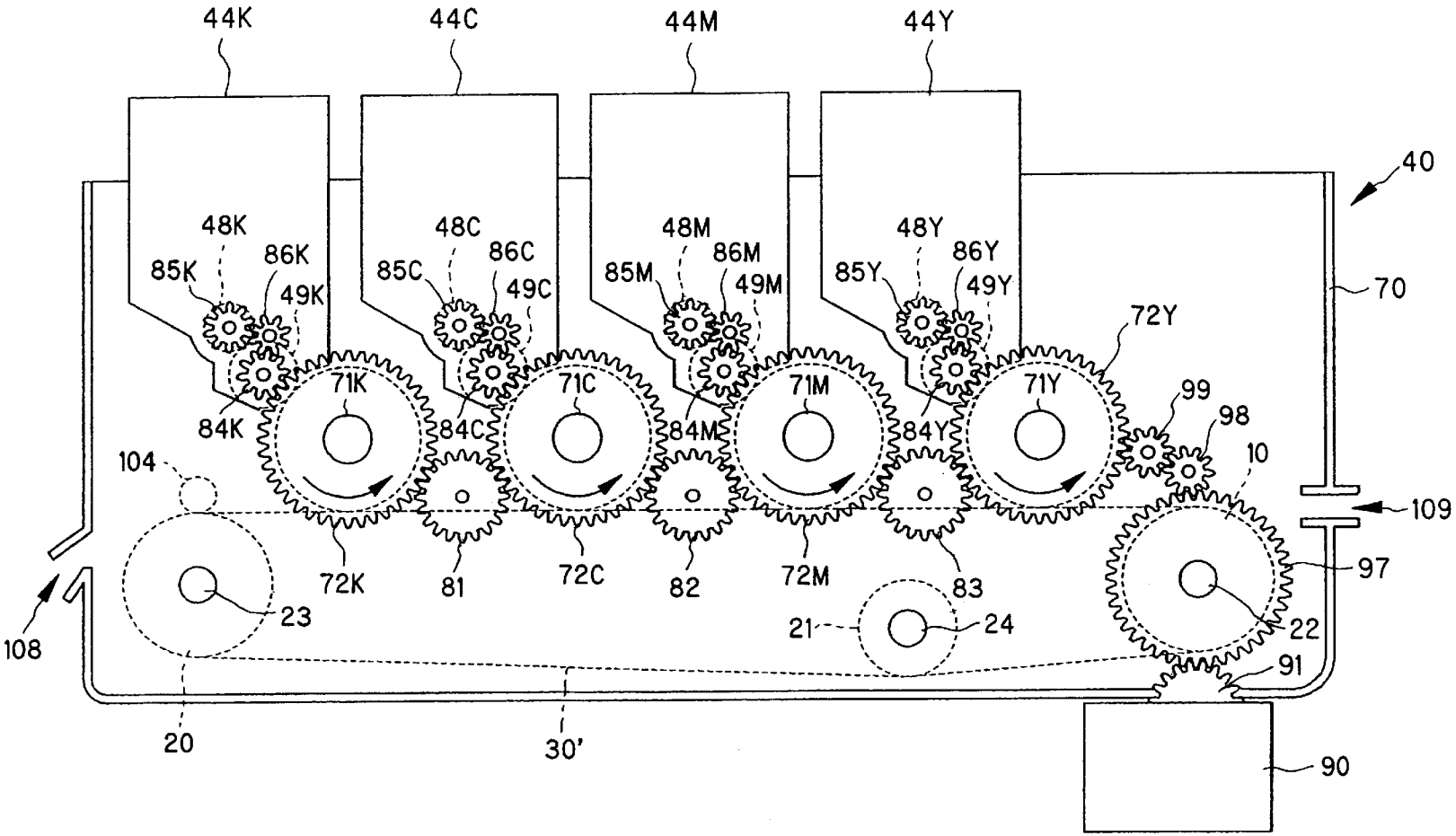
FIG. 50 is illustrative of the construction of one embodiment wherein the photosensitive members in the photosensitive member cartridge are rotated in synchronism with each other.

Next, an account is given of the mechanism of, upon the photosensitive member cartridge 40 mounted on the system proper, rotating and carrying the photosensitive members 41K, 41C, 41M and 41Y in the cartridge 40 in synchronism with one another, thereby preventing any color misalignment. FIG. 50 is illustrative of one construction for achieving this. As already mentioned, the shafts 71 (K, C, M, Y) of the photosensitive members 41 (K, C, M, Y) are mounted at their one ends with gears 72K, 72C, 72M and 72Y, respectively, which are molded using the same mold. An idle gear 81 is interposed between the gears 71K and 72C, an idle gear 82 between the gears 72C and 72M, and an idle gear 83 between the gears 72M and 72Y, forming a gear train for transmission of rotational force. The driving roller 10 is provided at its one end with a gear 97 rotating around a shaft 22, and the gear 97 meshes with the gear 72Y for rotating the photosensitive member 41Y via two gears 98 and 99. The gears 72K, 81, 72C, 82, 72M, 83, 72Y, 99, 98 and 97 thus form a series of gear train. A driving gear 91 in mesh with one gear in this gear train, for instance, gear 97, is disposed at a driving source 90 on the side of the system proper, so that upon the photosensitive cartridge 40 mounted at a given position of the system proper, the driving gear 91 meshes with the gear 97.

On the other hand, the shaft of the developing roller 49 (K, C, M, Y) of the developing device 44 (K, C, M, Y) is fixedly provided at its one end with a developing roller gear 84 (K, C, M, Y), and the shaft of the feed roller 48 (K, C, M, Y) is fixedly provided at its one end with a feed roller gear 85 (K, C, M, Y). An idle roller 86 (K, C, M, Y) is interposed between the developing roller gear 84 (K, C, M, Y) and the feed roller gear 85 (K, C, M, Y). The developing roller gear 84 (K, C, M, Y) meshes with the gear 72 (K, C, M, Y) of the photosensitive member 41 (K, C, M, Y), so that the developing roller 49 (K, C, M, Y) and feed roller 48 (K, C, M, Y) of the developing device 44 (K, C, M, Y), too, can be rotationally driven in synchronism with the rotation of the photosensitive member 41 (K, C, M, Y).

By rotating the driving gear 91 of the driving source at one site on the side of the system proper according to this arrangement, it is possible to rotationally drive the four photosensitive members 41 (K, C, M, Y) and the appendixes thereto, i.e., the developing rollers 49 (K, C, M, Y) and feed rollers 48 (K, C, M, Y) of the developing devices 44 (K, C, M, Y), all in synchronism with one another.

It is here desired that the diameter of the driving roller 10 be set in such a way to give a speed difference of 1 to 5% between the delivery speed of the recording medium carrier belt 30' by the driving roller 10 and the peripheral speed of the photosensitive member 41 (K, C, M, Y). With such a speed difference between the photosensitive member 41 (K, C, M, Y) and the recording medium carrier belt 30', it is possible to increase the efficiency of transfer because the toner can be mechanically moved upon transfer of the toner image.

When only the image carriers (photosensitive members) are replaced as is the case with the prior art, there is a fluctuation of the periphery speed of the image carriers with errors in image carrier shape, which in turn results in a change in the speed difference with the recording medium carrier belt 30'. The fluctuations in the speed difference offer some problems; too small a speed difference renders the efficiency of transfer low whereas too large a speed difference causes deterioration in image quality. Therefore, if the photosensitive members 41 (K, C, M, Y) and recording medium carrier belt 30' are integrated with the photosensitive member cartridge 40 as contemplated herein, it is then possible to reduce the fluctuations in the speed difference between the photosensitive members 41 (K, C, M, Y) and the recording medium carrier belt 30' as by determining the shape of the driving roll 10 in conformity with the shape of the photosensitive member 41 (K, C, M, Y). It is thus possible to provide an imaging system with improved transfer efficiency yet with no deterioration in image quality.

Such an embodiment as shown in FIG. 50 ensures that the operating efficiency of attachment/detachment of the photosensitive member cartridge 40 is improved because the point of meshing of the gears for transmission of driving force upon attachment/detachment of the photosensitive member cartridge 40 is limited to one. Since the positioning criterion for the photosensitive member cartridge 40 is defined by this driving force transmission gear 91, it is also possible to improve the precision of meshing and, hence, provide a system for forming high-quality images that are substantially free from any color misalignment or any banding (variations in densities, etc. at right angles with the feed direction).

It is understood that the mechanism for synchronized transmission of rotational force for the photosensitive members 41K, 41C, 41M and 41Y is not limited to such a gear train as shown, and so may be constructed using a belt or chain, for instance.

Figure 51:
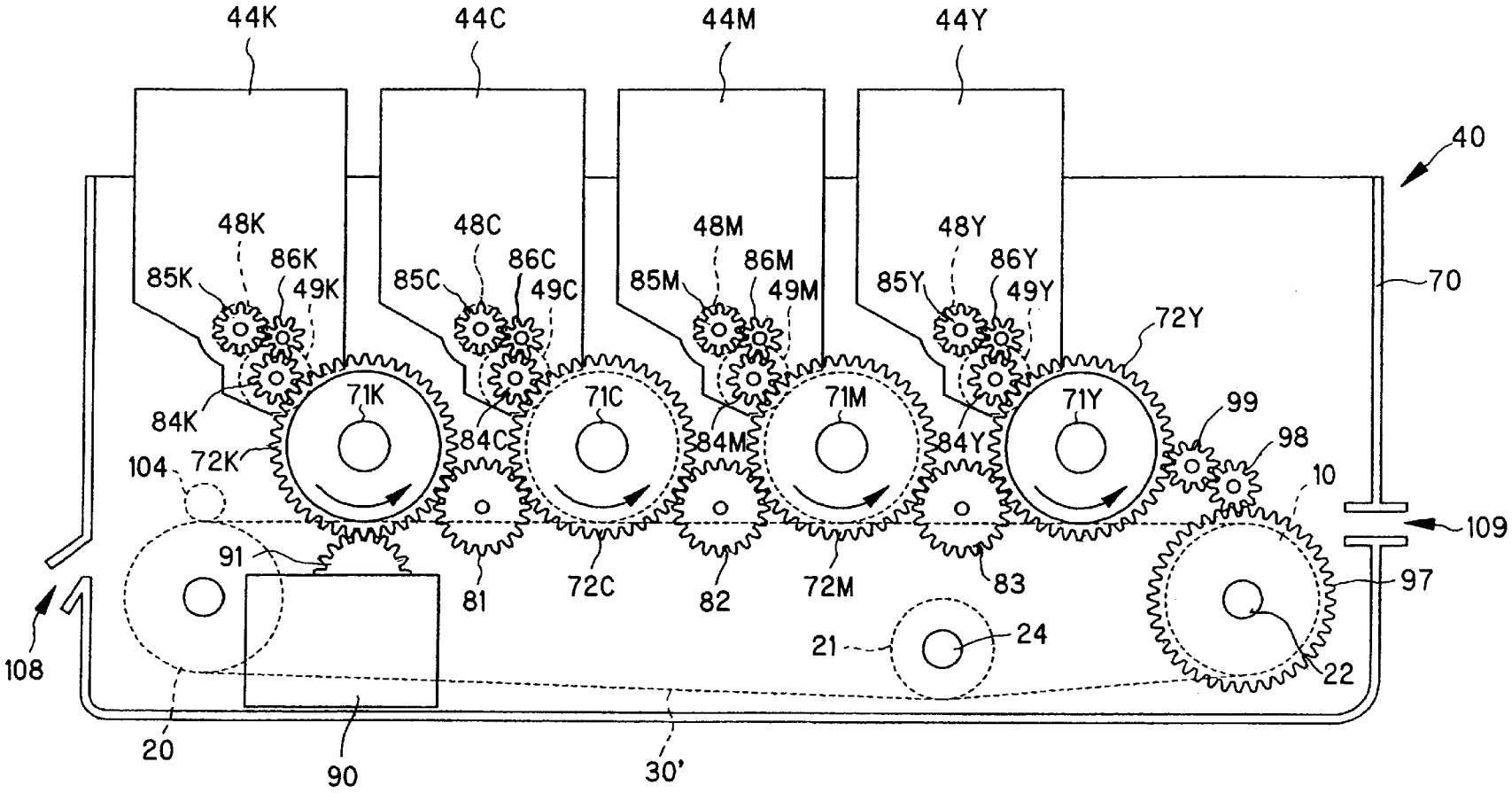
FIG. 51 is illustrative of the construction of one modification to FIG. 50.

FIG. 51 is illustrative of one modification to the embodiment of FIG. 50. In this modification, the driving gear 91 of the driving source 90 (FIG. 50) on the side of the system proper is designed to mesh with the gear 72K in the gear train comprising the gears 72K, 81, 72C, 82, 72M, 83, 72Y, 99, 98 and 97, so that the recording medium carrier belt 30' as well as the four photosensitive members 41 (K, C, M, Y) and their appendixes, i.e., the developing rollers 49 (K, C, M, Y) and feed rollers 48 (K, C, M, Y) of the developing devices 44 (K, C, M, Y) are all rotationally driven. Otherwise, the construction of FIG. 51 is the same as that of FIG. 55.

Figure 52:
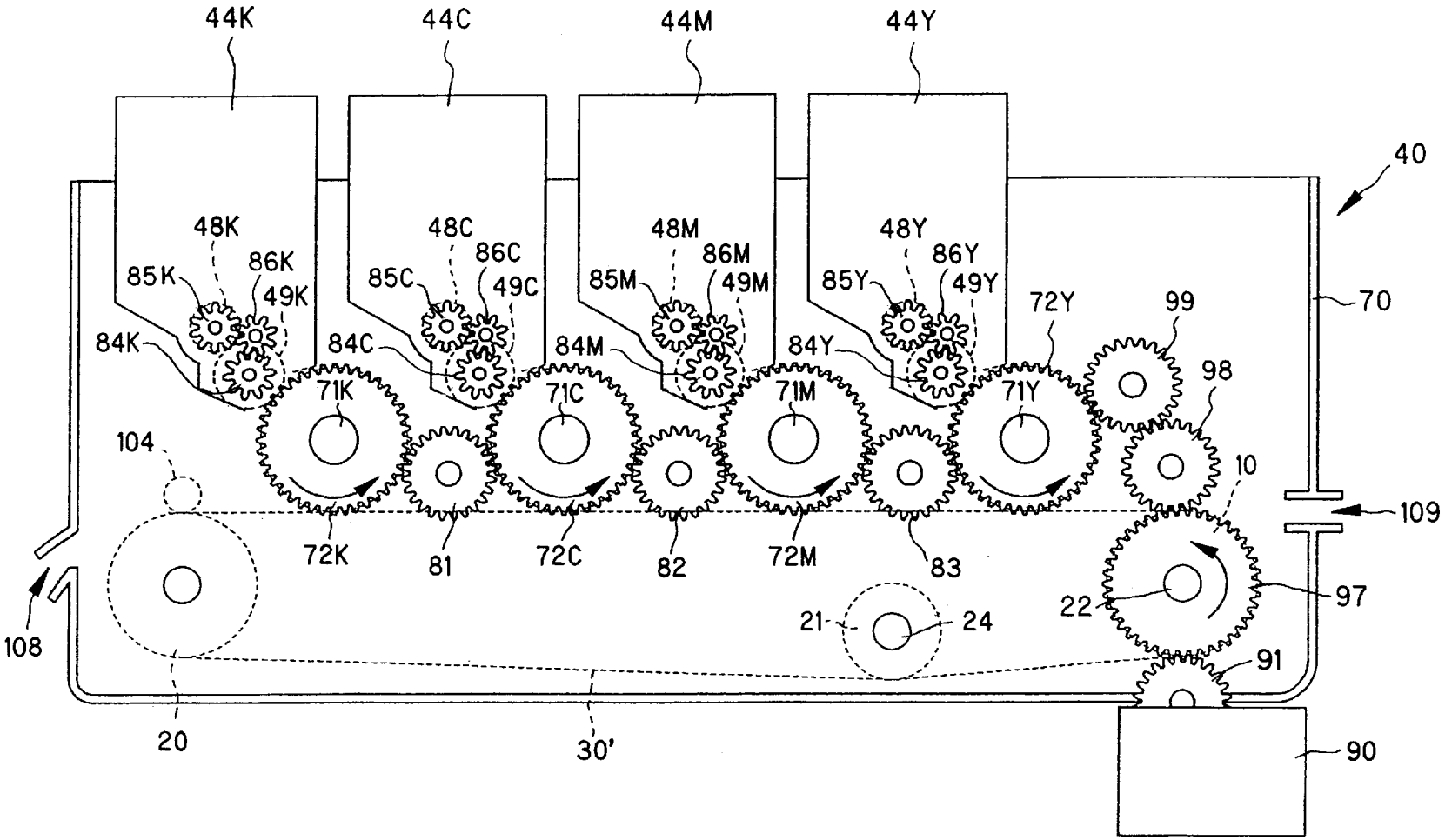
FIG. 52 is illustrative of the construction of the mechanism for synchronized rotation of the photosensitive members in an embodiment of the invention, wherein the photosensitive member cartridge is mounted on the system proper, and the photosensitive members and developing devices are driven by means of separate driving sources.
Figure 53:
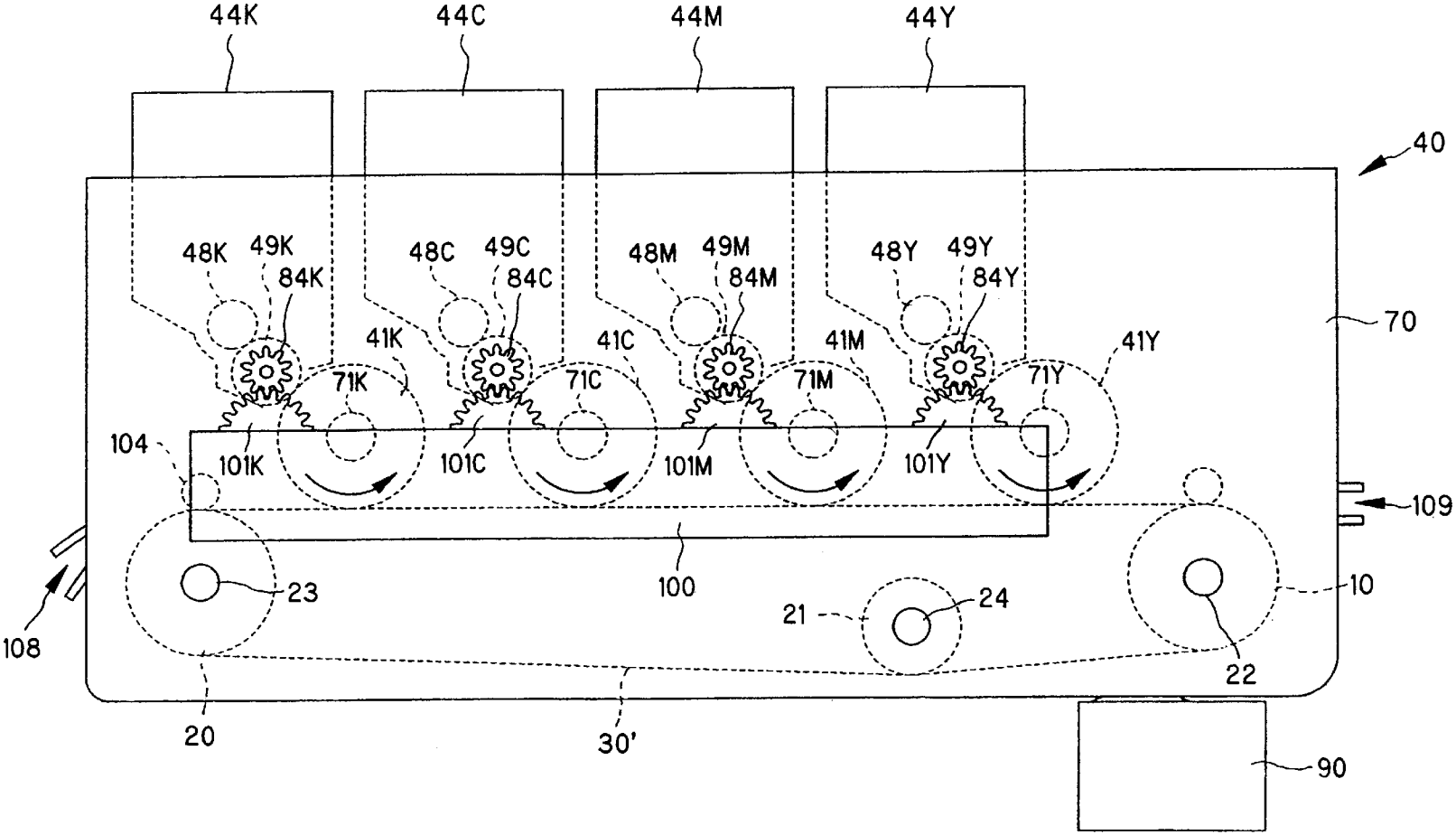
FIG. 53 is illustrative of the construction of the mechanism for rotating the developing devices in the embodiment of FIG. 52.

FIGS. 52 and 53 are illustrative of an embodiment of the invention, wherein the photosensitive member cartridge 40 is mounted on the system proper and the photosensitive members 41 (K, C, M, Y) of the photosensitive member cartridge 40, the recording medium carrier belt 30' and the developing devices 44 (K, C, M, Y) are driven by means of separate driving sources. FIG. 52 is similar to FIG. 50. In this embodiment, the developing roller gears 84 (K, C, M, Y) of the developing devices 44 (K, C, M, Y) are not in mesh with the gears 72 (K, C, M, Y) of the photosensitive members 41 (K, C, M, Y) or separated therefrom, as can be seen from FIG. 52. The embodiment of FIG. 52 is different from that of FIG. 50 only in terms of the gear train of the photosensitive member cartridge 40. By rotating the driving gear 91 of the driving source 90 on the side of the system proper, the recording medium carrier belt 30' and the four photosensitive members 41 (K, C, M, Y) can thus be rotationally driven in synchronism, as can be see from FIG. 52.

Although depending on the driving force of that driving source 90, however, the developing roller 49 (K, C, M, Y) and feed roller 48 (K, C, M, Y) of the developing device 44 (K, C, M, Y) are kept from rotation. In this embodiment, there is another driving source 100 at another site on the side of the system proper, as shown in FIG. 53. When the photosensitive member cartridge 40 is mounted at a given position of the system proper, four gears 101 (K, C, M, Y) of the separate driving source 100, designed to rotate in synchronism and in the same direction, are positioned in such a way that they mesh with the developing roller gears 84 (K, C, M, Y) fixed at one ends of the shafts of the developing rollers 49 (K, C, M, Y) of the developing devices 44 (K, C, M, Y) mounted on the photosensitive member cartridge 40. Thus, the developing devices 44 (K, C, M, Y) are rotationally driven by the driving source 100 that is separate from that for the photosensitive members 41 (K, C, M, Y).

In such an arrangement as shown in FIG. 44, color misalignments and image banding are largely dependent on the precision of rotation of the image carriers and recording medium carrier belt; however, they are less dependent on the precision of rotation of the developing rollers. Therefore, if the driving source 90 for the recording medium carrier belt 30' and photosensitive members 41 (K, C, M, Y) of the photosensitive member cartridge 40 is made separate from the driving source 100 for the developing devices 44 (K, C, M, Y) as shown in FIGS. 52 and 53, it is then possible to prevent rotation variations caused as by fluctuations in the torque of developing means from having influences on the rotation of the image carriers and, hence, provide a system for forming high-quality images with neither color misalignments nor image banding.

In the construction of FIGS. 52 and 53, too, it is acceptable to engage the driving gear 91 of the driving source 90 on the side of the system proper with the gear 72K in the gear train comprising the gears 72K, 81, 72C, 82, 72M, 83, 72Y, 99, 98 and 97 as shown in FIG. 51, thereby rotationally driving the recording medium carrier belt 30' and the four photosensitive members 41 (K, C, M, Y) in synchronism with one another.

Figure 54:
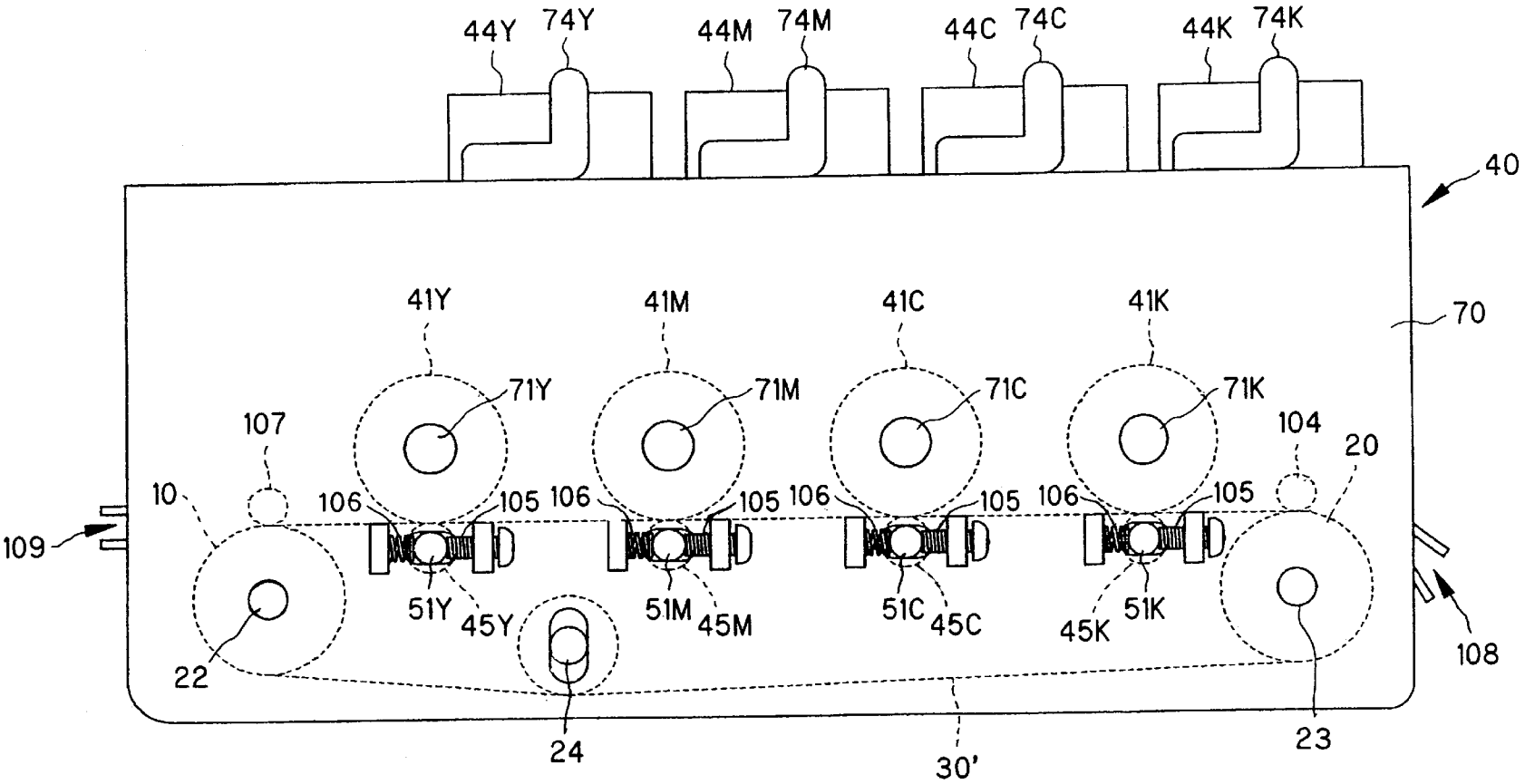
FIG. 54 is illustrative of one embodiment of the mechanism for adjusting the photosensitive member cartridge for color misalignments.

FIG. 54 is illustrative of one embodiment of the mechanism for adjusting color misalignments occurring due to position misalignments between the photosensitive members 41K, 41C, 41M and 41Y of such a photosensitive member cartridge 40, especially skews in parallelism, when four different monochromatic toner images are transferred onto the recording medium P absorbed onto the recording medium carrier belt 30' in a superposed fashion. As shown in FIG. 54, while the shaft 51 (K, C, M, Y) of each transfer roller 45 (K, C, M, Y) extending from one side plate of the frame 70 is sandwiched between an adjustment screw 105 and the leading end of an extensible spring 106, the other end of the extensible spring 106 is fixed to the side plate 70. In this state, if the leading end of the adjustment screw 105 is adjustable in the direction opposite to the direction of extension of the extensible spring 106 to adjust the position of one end of the shaft 51 (K, C, M, Y), there are then changes in the transfer positions of the transfer rollers 45K, 45C, 45M and 45Y. Since there is such a speed difference as mentioned above between the recording medium carrier belt 30' and the photosensitive members 41 (K, C, M, Y), changes in the primary transfer positions cause changes in the transfer positions on the recording medium P absorbed onto the recording medium carrier belt 30' for the toner images of the corresponding colors; that is, color misalignments can be regulated. It is not always required to provide all the four photosensitive members 41K, 41C, 41M and 41Y with such color misalignment adjustment mechanisms. It is noted that it is acceptable to provide the opposite ends of the shafts 51 (K, C, M, Y) with such color misalignment adjustment mechanisms. However, this is not always necessary because misalignments can be electrically eliminated by controlling the timing of when color latent images formed on the photosensitive members 41 (K, C, M, Y) are to be written, as long as given parallelism is maintained between the photosensitive members 41 (K, C, M, Y).

It is here understood that color misalignments may also be regulated by providing similar adjustment mechanisms on the respective shafts 71 (K, C, M, Y) of the photosensitive members 41 (K, C, M, Y).

By providing the photosensitive member cartridge 40 with the position alignment mechanism for the transfer rollers 45 (K, C, M, Y) or the photosensitive members 41 (K, C, M, Y) in this way, it is possible to make fine adjustments of the positions of the photosensitive members 41 (K, C, M, Y) onto which latent images are to be written and transferred, thereby reducing color misalignments. It is here noted that the color misalignment adjustment by this color (position) misalignment adjustment mechanism may be made upon shipment of the photosensitive member cartridge 40 or anytime after its attachment to the system proper.

Figure 55:
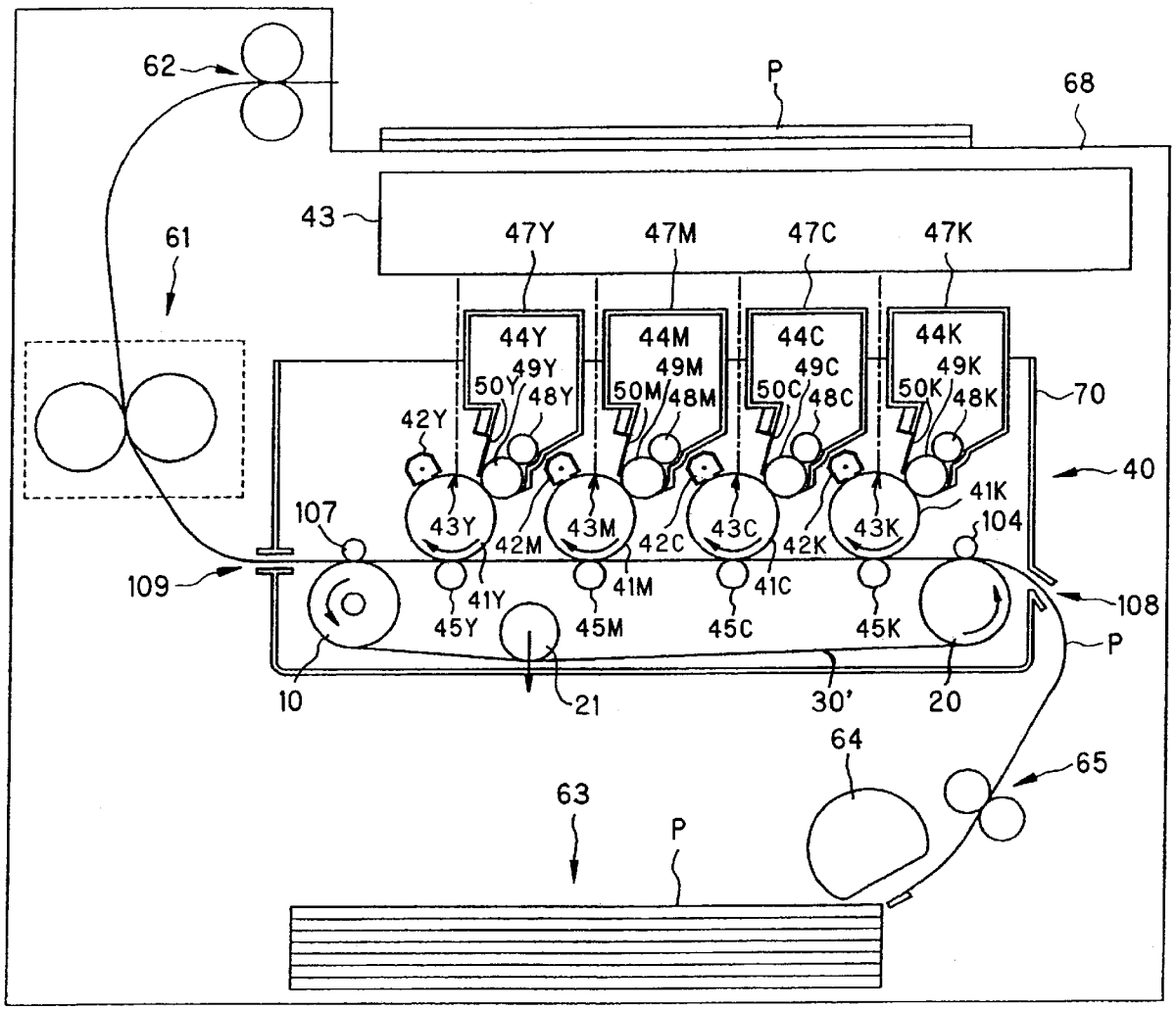
FIG. 55 is a front schematic illustrative of the whole construction of an embodiment of the color image formation system using a "cleaner-less" mode.

Referring now to an electrographic system wherein latent images formed on image carriers are toner developed and the resulting toner images are transferred onto transfer media, there is a so-called "cleaner-less" mode wherein the remnants of toner untransferred onto the image carriers are recovered at developing devices without recourse to such cleaning devices as shown in FIG. 44 (for instance, see JP-B 06-77166). This "cleaner-less" mode is embodied as shown in FIG. 55, dispensing with the cleaning devices 46 (K, C, M, Y) of FIG. 44. The embodiment of FIG. 55 is the same in construction as that of FIG. 44 with the exception of the absence of the cleaning devices 46 (K, C, M, Y); any detailed account of its construction and action is not given. The construction of the photosensitive member cartridge 40 in this embodiment, too, is the same as that of FIGS. 44 and 45 with the exception of the absence of the cleaning devices 46 (K, C, M, Y); four photosensitive members 41K, 41C, 41M and 41Y, corona chargers 42 (K, C, M, Y) disposed around the same and an recording medium carrier belt 30' are constructed in an integral form.

By use of the mode that dispenses with any cleaning device, it is possible to reduce the size of the photosensitive member cartridge 40 and the system proper. In addition, it is possible to diminish reaction force that may otherwise act on the photosensitive members 41 (K, C, M, Y) through the blades, etc. of cleaning devices, resulting in prevention of color misalignments. This is because the frame 70 is kept from deformation so that any position misalignment between the photosensitive members 41 (K, C, M, Y) can be avoided.

Figure 56:
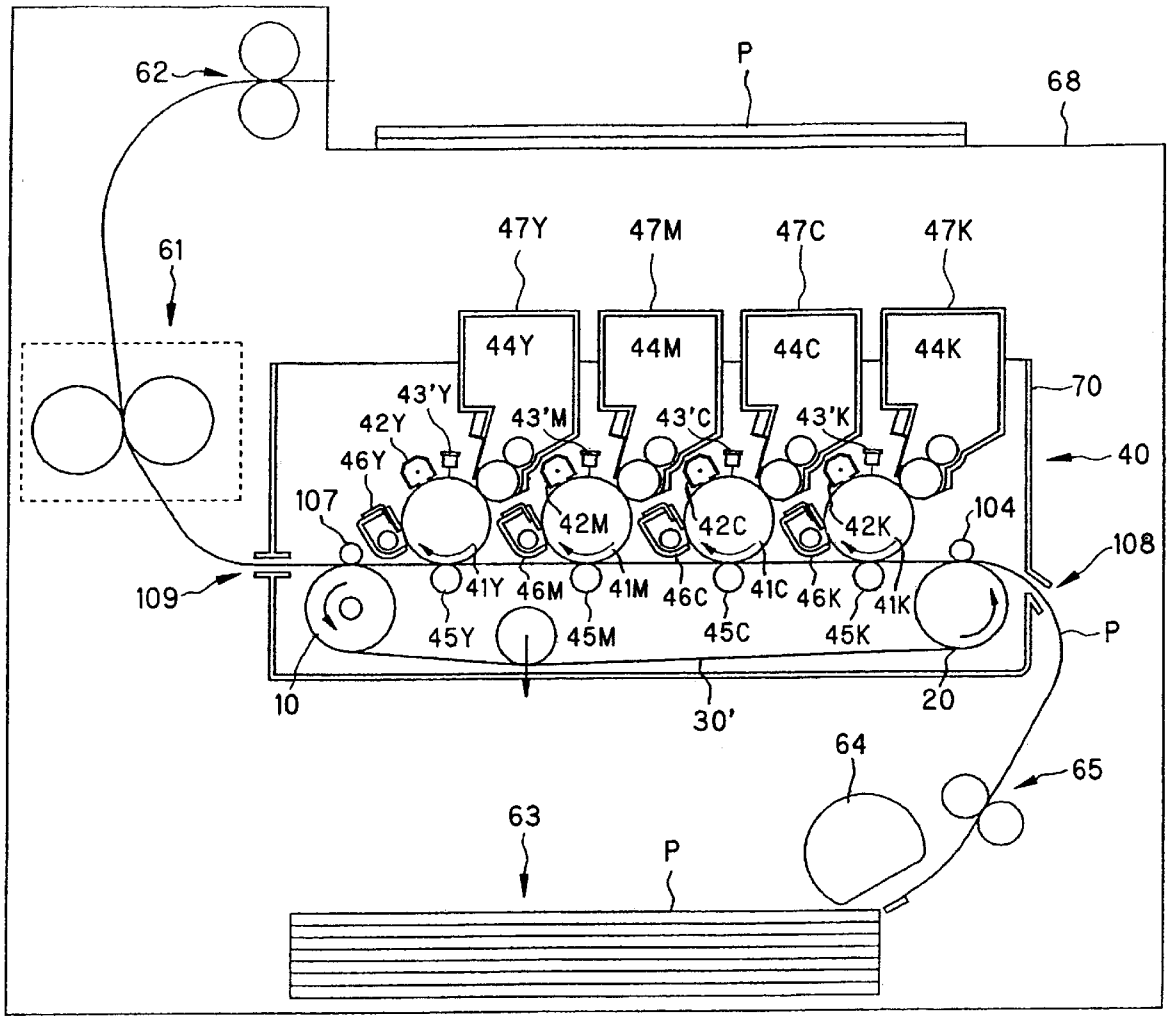
FIG. 56 is similar to FIG. 44, showing an embodiment of the invention wherein the exposure devices are integrated with the photosensitive member cartridge.

FIG. 56 is a view similar to FIG. 44, showing another embodiment of the invention. In this embodiment, no single exposure unit 43 is used unlike the embodiment of FIG. 44. An exposure device 43' (K, C, M, Y) for performing selective exposure per color, corresponding to each photosensitive member 41 (K, C, M, Y), is integrated with a photosensitive member cartridge 40 between a corona charger 42 (K, C, M, Y) and a developing device 44 (K, C, M, Y). In accordance with this embodiment, the photosensitive member cartridge 40 is provided at its frame 70 with four photosensitive members 41K, 41C, 41M and 41Y and their appendixes, i.e., corona chargers 42 (K, C, M, Y), exposure devices 43' (K, C, M, Y) and cleaning devices 46 (K, C, M, Y) while they are relatively positioned. An recording medium carrier belt 30' spanned and endlessly driven over a driving roller 10, a follower roller 20 and a tension roller 21 is attached together with these means to the frame 70 of the photosensitive member cartridge 40 in such a way that it comes into contact with the respective photosensitive members 41 (K, C, M, Y) through transfer rollers 45 (K, C, M, Y).

In this embodiment, the exposure unit 43 is dispensed with. Thus, the photosensitive member cartridge 40 can be withdrawn from the system proper by lifting it substantially upward.

With such an arrangement wherein the exposure devices 43' (K, C, M, Y), photosensitive members 41 (K, C, M, Y), recording medium carrier belt 30' and transfer rollers 45 (K, C, M, Y) are constructed in the form of the integral photosensitive cartridge 40, it is possible to adjust nearly all of color misalignment factors at its production stage, thereby providing a system for the formation of images of high quality.

In the embodiment of FIG. 56, the frame 70 of the photosensitive member cartridge 40 is provided with the four photosensitive members 41K, 41C, 41M and 41Y and the appendixes thereto, i.e., the corona chargers 42 (K, C, M, Y), the exposure devices 43' (K, C, M, Y), the cleaning devices 46 (K, C, M, Y), the recording medium carrier belt 30', the driving roller 10, follower roller 20 and tension roller 21 over which the recording medium carrier belt 30' is spanned, the transfer rollers 45 (K, C, M, Y) for bringing the recording medium carrier belt 30' in contact with the photosensitive members 41 (K, C, M, Y), the sheet absorption roller 104 for absorbing the recording medium P onto the recording medium carrier belt 30' and the release roller 107 for releasing the recording medium P with a toner image carried thereon from the recording medium carrier belt 30' while they are relatively positioned. FIG. 42 is illustrative of one embodiment of how the exposure devices 43' (K, C, M, Y) are attached to the frame 70 of the photosensitive member cartridge 40. To be specific, FIG. 42 is a partly enlarged perspective view of only one end portions of the photosensitive members 41Y and 41M in the photosensitive member cartridge 40. To mount the exposure devices 43' (K, C, M, Y) at precisely located positions on the associated photosensitive members 41 (K, C, M, Y) and parallel therewith, mounting struts 111 (K, C, M, Y) are integrally provided, extending from the inside surfaces of both side plates of the frame 70 and opposing to each other. Each strut 111 (K, C, Y, M) is provided with locating holes for receiving locating pins and threaded holes, both holes not shown. Locating pins 115 provided at both ends of a long-length substrate 113 (FIG. 22) of each exposure device 43' (K, C, M, Y) are inserted into the locating holes in the associated mounting strut 111 (K, C, M, Y) while fixing screws 112 (K, C, M, Y) are fixedly screwed into the threaded holes in the mounting strut 111 (K, C, M, Y) through screw-insertion holes in both ends of the long-length substrate 113 (FIG. 22), so that the each exposure device 43' (K, C, M, Y) is fixed in place.

FIG. 22 is a perspective schematic of each exposure device 43' (K, C, M, Y) constructed in the form of an LED line head comprising an LED array 116. As mentioned above, each exposure device 43' (K, C, M, Y) is mounted on the long-length substrate 113, spanning between both side plates of the frame 70. The LED array 116 for forming a line image on the photosensitive member 41 (K, C, M, Y) and parallel with its axis is mounted on the long-length substrate 113, with each LED connected to a driver IC 117 for controlling light emission. The long-length substrate 113 is provided at each end with a locating pin 115 for the determination of a mounting position and a hole 114 for the insertion of a mounting screw. Thus, each exposure device is fixed at a precise position for the associated photosensitive member 41 (K, C, M, Y). In front of the LED array 116 there is integrally fixed a gradient index type rod lens array 118 having an image-formation action, by which a train of light emission points defined by the LED array 116 is allowed to form an image on the photosensitive surface of the associated photosensitive member 41 (K, C, M, Y).

Figure 57:
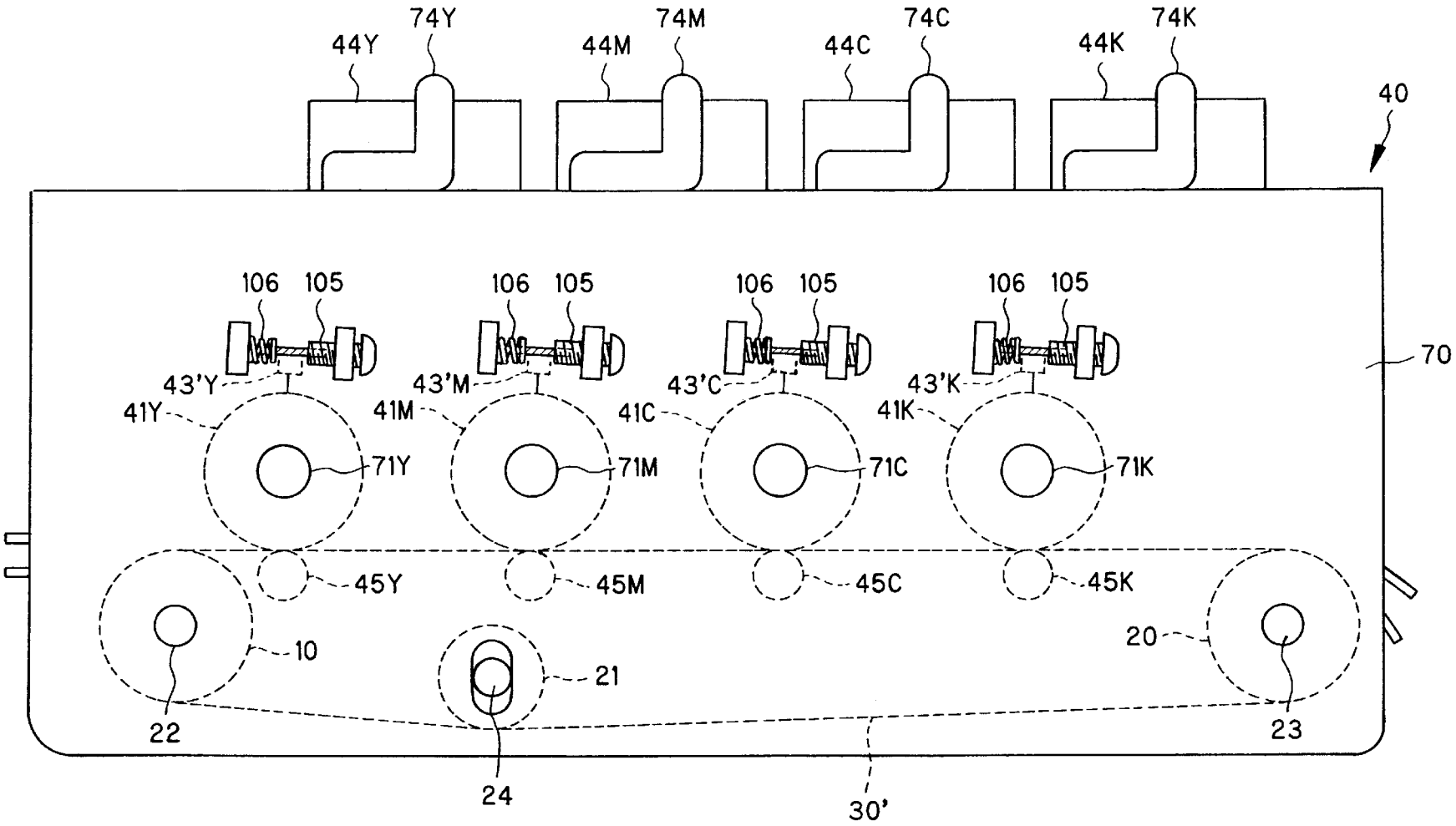
FIG. 57 is illustrative of another embodiment of the mechanism for adjusting the photosensitive member cartridge for color misalignments.

FIG. 57 is illustrative of one embodiment of the mechanism for adjusting color misalignments occurring due to relative position misalignments between the exposure devices 43'K, 43'C, 43'M and 43'Y positioned and mounted on the photosensitive members 41 (K, C, M, Y) of the photosensitive member cartridge 40 of FIG. 56, especially skews in parallelism, when four different monochromatic toner images are transferred onto the recording medium P absorbed onto the recording medium carrier belt 30' in a superposed fashion. As shown in FIG. 57, while the mounting ridge 111 (K, C, M, Y) of each exposure device 43' (K, C, M, Y) extending from one side plate of the frame 70 or a long-length substrate 113 is sandwiched between an adjustment screw 105 and the leading end of an extensible spring 106, the other end of the extensible spring 106 is fixed to the side plate 70. In this state, if the leading end of the adjustment screw 105 is adjustable in the direction opposite to the direction of extension of the extensible spring 106 to adjust the position of one end of the exposure device 43' (K, C, M, Y), it is then possible to adjust skews in parallelism between the exposure devices 43'K, 43'C, 43'M and 43'Y. It is not always required to provide all the four exposure devices 43'K, 43'C, 43'M and 43'Y with such color misalignment adjustment mechanisms. It is noted that it is acceptable to provide the opposite ends of the exposure devices 43' (K, C, M, Y) with such color misalignment adjustment mechanisms. However, this is not always necessary because misalignments can be electrically eliminated by controlling the timing of when color latent images formed at the exposure devices 43' (K, C, M, Y) are to be written, as long as given parallelism is maintained between the exposure devices 43' (K, C, M, Y).

By providing the photosensitive member cartridge 40 with the position alignment mechanism for the exposure devices 43' (K, C, M, Y) in this way, it is possible to make fine adjustments of the positions of the photosensitive members 41 (K, C, M, Y) onto which latent images are to be written and transferred, thereby reducing color misalignments. It is here noted that the color misalignment adjustment by this color (position) misalignment adjustment mechanism may be made upon shipment of the photosensitive member cartridge 40 or anytime after its attachment to the system proper.

In the embodiment of FIG. 56, the write means that are integrally mounted together with the photosensitive members 41 (K, C, M, Y) and recording medium carrier belt 30' on the photosensitive member cartridge 40 are not necessarily limited to such optical write means as shown in FIG. 22. For instance, it is acceptable to make use of write means having recourse to charge transfer such as injection or elimination of charges, for instance, those proposed by the applicant in Japanese Patent Application Nos. 2000-298925 and 2000-298927, etc. FIG. 27 is a front schematic illustrative of the whole construction of a color image formation system wherein charge injection electrode line heads 3 (K, C, M, Y) are used as write means, and FIG. 27 is a perspective schematic illustrative of how the charge injection electrode line heads 3 (K, C, M, Y) are arranged and constructed with respect to photosensitive members 41 (K, C, M, Y). When writing is carried out by the injection of charges, it is not always necessary to use the chargers 42 (K, C, M, Y) of FIG. 40. The charge injection electrode line head 3 (K, C, M, Y) comprises an array of electrodes 3*b* that come in contact with the associated photosensitive member 41 (K, C, M, Y) to create a potential profile therein and so form a latent image. Charges injected into each electrode 3*b* are controlled by a driver IC119.

In accordance with the inventive color image formation system wherein, as explained above, a plurality of photosensitive members 41 (K, C, M, Y) and the recording medium carrier belt 30' are mutually positioned and mounted on a photosensitive member cartridge 40 detachable from and attachable to the system proper and developing devices 44 (K, C, M, Y) are disposed in such a way as to be detachable from and attachable to the photosensitive members 41 (K, C, M, Y) mounted on the photosensitive member cartridge 40, the precision of relative positions between the photosensitive members is so improved that color misalignments ascribable to misalignments between the photosensitive members and skews thereof can be prevented.

Gears can be associated with the photosensitive members in such phase relations as to reduce speed fluctuations due to the gears that drive the photosensitive member, so that the cartridge 40 can be constructed in an integral form. In addition, color misalignments due to the photosensitive member-driving gears can be considerably reduced (FIG. 50 and so on). Where the photosensitive members are individually mounted on the system proper, it is impossible to make phase adjustments of such gears because the photosensitive members rotate by themselves.

Further, the photosensitive member cartridge 40 can be finished up using photosensitive members of uniform performance singled out at the time of shipping, so that color changes due to variations in the properties of the photosensitive members of different colors can be prevented. In addition, the integrity of maintenance can be improved because a plurality of photosensitive members can be replaced at the same time.

Furthermore, the arrangement wherein the developing devices 44 (K, C, M, Y) are designed as detachable from and attachable to the photosensitive member cartridge 40 ensures that the developing devices 44 (K, C, M, Y) can be replaced independently of the photosensitive member cartridge 40. Therefore, even when the developing devices 44 (K, C, M, Y) are exhausted or used up and so must be replaced with new ones, there is no need of making a replacement for the photosensitive members 41 (K, C, M, Y), so that running cost reductions are achievable.

What is necessary when the developing devices 44 (K, C, M, Y) are used up is only their replacement. There is no need of any color matching operation depending on the positions and configuration of the photosensitive members 41 (K, C, M, Y) and write means 43' (K, C, M, Y) or 3 (K, C, M, Y). It is thus possible to provide an image formation system having improved operating efficiency.

For replacement of the developing devices 44 (K, C, M, Y), only the withdrawal of the photosensitive member cartridge 40 is needed. Then, new developing devices are attached to the photosensitive member cartridge 40. Thus, the operation for replacement of the developing devices 44 (K, C, M, Y) is so facilitated that the integrity of maintenance can be improved.

It is also acceptable to construct a plurality of photosensitive members 41 (K, C, M, Y) in the form of one single replacement and the developing devices 44 (K, C, M, Y) in the form of one single replacement 47 (FIG. 48), so that the integrity of maintenance can be much more improved.

While the color image formation systems of the present invention has been explained with their embodiments, it is understood that the present invention is not limited to these embodiments and so many modifications may be possible.

As can be appreciated from the foregoing, the first aspect of the present invention provides a system for forming color images, wherein a plurality of image carriers are mounted on an image carrier cartridge detachable from or attachable to a system proper while they are mutually positioned, and developing means is provided in such a way as to be detachable from or attachable to each image carrier mounted on said image carrier cartridge. Thus, the precision of relative positions of the image carriers is so improved that any misalignments ascribable to position and parallelism misalignments of the image carriers can be prevented. Since a plurality of image carriers can be replaced at the same time, the integrity of maintenance of the system can be improved. The developing means and the image carrier cartridge can be independently replaced so that running cost reductions are achievable because even when used-up developing means re replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

The second aspect of the present invention provides a system for forming color images, wherein a plurality of image carriers are mounted on an image carrier cartridge detachable from or attachable to a system proper while they are mutually positioned, developing means is provided in such a way as to be detachable from or attachable to each image carrier mounted on said image carrier cartridge, and write means are located and mounted at positions of said image carrier cartridge corresponding to a plurality of image carriers. Thus, the precision of relative positions of the image carriers and write means is so improved that any misalignments ascribable to position and parallelism misalignments of the image carriers and write means can be prevented. Since a plurality of image carriers can be replaced at the same time, the integrity of maintenance of the system can be improved. The developing means and the image carrier cartridge can be independently replaced so that running cost reductions are achievable because even when used-up developing means re replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

The third aspect of the present invention provides a system for forming color images, wherein a plurality of image carriers are mounted on an image carrier cartridge detachable from or attachable to a system proper, an intermediate transfer belt is mounted contiguously to said plurality of image carriers, and developing means is provided in such a way as to be detachable from or attachable to each image carrier mounted on said image carrier cartridge. Thus, the precision of relative positions of the image carriers, and the precision of transfer positions is so improved that any misalignments ascribable to position and parallelism misalignments of the image carriers and transfer position misalignments can be prevented. Since a plurality of image carriers can be replaced at the same time, the integrity of maintenance of the system can be improved. The developing means and the image carrier cartridge can be independently replaced so that running cost reductions are achievable because even when used-up developing means re replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

The fourth aspect of the present invention provides a system for forming color images, wherein a plurality of image carriers are mounted on an image carrier cartridge detachable from or attachable to a system proper while they are mutually positioned, and developing means is provided in such a way as to be detachable from or attachable to each image carrier mounted on said image carrier cartridge. Thus, the precision of relative positions of the image carriers is so improved that any misalignments ascribable to position and parallelism misalignments of the image carriers can be prevented. Since a plurality of image carriers can be replaced at the same time, the integrity of maintenance of the system can be improved. The developing means and the image carrier cartridge can be independently replaced so that running cost reductions are achievable because even when used-up developing means re replaced, there is no need of replacing the image carriers. For replacement of used-up developing means, their replacement alone is needed and so there is no need of color matching depending on the positions and shape of the image carriers. Thus, the system for forming color images according to this aspect can have high efficiency of operation. For replacement of the developing means, only the withdrawal of the image carrier cartridge from the system proper is needed, followed by detachment of used-up developing means and attachment of new one. Thus, the operation for replacement of the developing means is so facilitated that the integrity of maintenance of the system can be improved.

What we claim is:

1. A tandem system for forming color images comprising:

at least two image formation stations, each image formation station comprising:

an image carrier;

a charging means;

a developing means; and a transfer means;

wherein said charging means, said developing means and said transfer means are disposed around said image carrier, wherein a color image is formed by passing a transfer medium through each station, wherein a plurality of image carriers are mounted on an image carrier cartridge detachable from and attachable to a system proper while they are mutually positioned, and wherein said developing means is provided in such a way as to be detachable from or attachable to each image carrier mounted on said image carrier cartridge.

2. The color image formation system according to claim 1, wherein a developing agent in said developing means comprises a mono-component developing agent.

3. The color image formation system according to claim 1 or 2, wherein said plurality of image carriers are integrally mounted on said image carrier cartridge while they are mutually positioned, and a plurality of developing cartridges, each forming developing means for each of said plurality of image carriers, are disposed with respect to said image carrier cartridge in a separately detachable/attachable manner.

4. The color image formation system according to claim 3, wherein a black developing cartridge is disposed on an image carrier located on an uppermost stream side in a medium transfer direction, and a yellow developing cartridge is disposed on an image carrier located on a lowermost stream side in said medium transfer direction.

5. The color image formation system according to claim 1 or 2, wherein said plurality of image carriers are integrally mounted on said image carrier cartridge while they are mutually positioned, and a developing cartridge forming developing means for each of said plurality of image carriers, wherein all developing means for said plurality of image carriers are integrated into one piece, is disposed with respect to said image carrier cartridge in a detachable/attachable manner.

6. The color image formation system according to claim 1 or 2, wherein said plurality of image carriers are integrally mounted on said image carrier cartridge, and two developing cartridges are disposed with respect to said image carrier cartridge in a separately detachable/attachable manner; and wherein in one of said two developing cartridges there is developing means for one specific image carrier in said plurality of image carriers, and in another of said two developing cartridges all developing means for the remaining image carriers are integrated together.

7. The color image formation system according to claim 1, wherein driving forces for said plurality of image carriers and the developing means for each of said plurality of image carriers are received at one site on said system proper and said driving force for said plurality of image carriers is divided in said image carrier cartridge and then transmitted to said developing means.

8. The color image formation system according to claim 7, wherein a mutual transmission of driving force between said plurality of image carriers takes place via a gear train, a belt or a chain.

9. The color image formation system according to claim 1, wherein a driving force for said plurality of image carriers is received from one driving source of said system proper and a driving force for developing means for each of said plurality of image carriers is received from another driving source of said system proper.

10. The color image formation system according to claim 1, further comprising a mechanism for adjusting color misalignments by regulating a position of at least one image carrier in said image carrier cartridge relative to other image carriers therein.

11. The color image formation system according to claim 1, wherein around each image carrier in said image carrier cartridge there is no cleaning means for collecting the remnants of the developing agent in an independent manner.

12. A tandem system for forming color images comprising:

at least two image formation stations, each image formation station comprising:

an image carrier;

a charging means;

a write means;

a developing means; and a transfer means, wherein said charging means, said write means, said developing means and said transfer means are disposed around said image carrier, wherein a color image is formed by passing a transfer medium through each station, wherein a plurality of image carriers are mounted on an image carrier cartridge detachable from and attachable to a system proper while they are mutually positioned, wherein said developing means is provided in such a way as to be detachable from or attachable to each image carrier mounted on said image carrier cartridge, and wherein said write means is located and mounted at a position corresponding to each of said plurality of image carriers in said image carrier cartridge.

13. The color image formation system according to claim 12, wherein a developing agent in said developing means comprises a mono-component developing agent.

14. The color image formation system according to claim 12 or 13, wherein said plurality of image carriers are integrally mounted on said image carrier cartridge while they are mutually positioned, and a plurality of developing cartridges, each forming developing means for each of said plurality of image carriers, are disposed with respect to said image carrier cartridge in a separately detachable/attachable manner.

15. The color image formation system according to claim 12 or 13, wherein said plurality of image carriers are integrally mounted on said image carrier cartridge while they are mutually positioned, and a developing cartridge forming developing means for each of said plurality of image carriers, wherein all developing means for said plurality of image carriers are integrated into one piece, is disposed with respect to said image carrier cartridge in a detachable/attachable manner.

16. The color image formation system according to claim 12 or 13, wherein said plurality of image carriers are integrally mounted on said image carrier cartridge, and two developing cartridges are disposed with respect to said image carrier cartridge in a separately detachable/attachable manner, and wherein in one of said two developing cartridges there is developing means for one specific image carrier in said plurality of image carriers, and in another of said two developing cartridges all developing means for the remaining image carriers are integrated together.

17. The color image formation system according to claim 12, wherein driving forces for said plurality of image carriers and the developing means for each of said plurality of image carriers are received at one site on said system proper and said driving force for said plurality of image carrier is divided in said image carrier cartridge and then transmitted to said developing means.

18. The color image formation system according to claim 17, wherein a mutual transmission of driving force between said plurality of image carriers takes place via a gear train, a belt or a chain.

19. The color image formation system according to claim 12, wherein a driving force for said plurality of image carriers is received from one driving source of said system proper and a driving force for developing means for each of said plurality of image carriers is received from another driving source of said system proper.

20. The color image formation system according to claim 12, further comprising a mechanism for adjusting a position of at least one image carrier in said image carrier cartridge relative to other image carriers therein, thereby adjusting color misalignments.

21. The color image formation system according to claim 12, wherein said write means is constructed as a line head for performing line writing on each of said image carriers.

22. The color image formation system according to claim 12, wherein around each image carrier in said image carrier cartridge there is no cleaning means for collecting the remnants of the developing agent in an independent manner.

23. A tandem system for forming color images comprising:

at least two image formation stations, each image formation station comprising:

an image carrier;

a charging means;

a developing means; and a transfer means, wherein said charging means, said developing means, and said transfer means are disposed around said image carrier, wherein a color image is formed by passing a transfer medium through each station, wherein a plurality of image carriers are mounted on an image carrier cartridge detachable from and attachable to a system proper while they are mutually positioned, wherein an intermediate transfer belt is provided contiguously to said plurality of image carriers, and wherein said developing means is provided in such a way as to be detachable from or attachable to each image carrier mounted on said image carrier cartridge.

24. The color image formation system according to claim 23, wherein a developing agent in said developing means comprises a mono-component developing agent.

25. The color image formation system according to claim 23 or 24, wherein said plurality of image carriers are integrally mounted on said image carrier cartridge while they are mutually positioned, and a plurality of developing cartridges, each forming developing means for each of said plurality of image carriers, are disposed with respect to said image carrier cartridge in a separately detachable/attachable manner.

26. The color image formation system according to claim 23 or 24, wherein said plurality of image carriers are integrally mounted on said image carrier cartridge while they are mutually positioned, and a developing cartridge forming developing means for each of said plurality of image carriers, wherein all developing means for said plurality of image carriers are integrated into one piece, is disposed with respect to said image carrier cartridge in a detachable/attachable manner.

27. The color image formation system according to claim 23 or 24, wherein said plurality of image carriers are integrally mounted on said image carrier cartridge, and two developing cartridges are disposed with respect to said image carrier cartridge in a separately detachable/attachable manner, and wherein in one of said two developing cartridges there is developing means for one specific image carrier in said plurality of image carriers, and in another of said two developing cartridges all developing means for the remaining image carriers are integrated together.

28. The color image formation system according to claim 23, wherein driving forces for said plurality of image carriers, the developing means for each of said plurality of image carriers and said intermediate transfer belt are received at one site on said system proper and said driving force for said plurality of image carrier is divided in said image carrier cartridge and then transmitted to said developing means.

29. The color image formation system according to claim 28, wherein a mutual transmission of driving force between said plurality of image carriers takes place via a gear train, a belt or a chain.

30. The color image formation system according to claim 23, wherein driving forces for said plurality of image carriers and said intermediate transfer belt are received from one driving source of said system proper and driving force for developing means for each of said plurality of image carriers is received from another driving source of said system proper.

31. The color image formation system according to claim 23, wherein there is a speed difference between the peripheral speed of said plurality of image carriers and the delivery speed of said intermediate transfer belt.

32. The color image formation system according to claim 31, further comprising a mechanism for adjusting a transfer position at which said intermediate transfer belt comes into contact with said plurality of image carriers, thereby adjusting color misalignments.

33. The color image formation system according to claim 23, further comprising a mechanism for adjusting a position of at least one image carrier in said image carrier cartridge relative to other image carriers therein, thereby adjusting color misalignments.

34. The color image formation system according to claim 23, further comprising a write means which is located and mounted at a position corresponding to each of said plurality of image carriers in said image carrier cartridge.

35. The color image formation system according to claim 34, further comprising a mechanism for adjusting a position of at least one write means mounted on said image carrier cartridge, thereby adjusting color misalignments.

36. The color image formation system according to claim 34 or 35, wherein said write means is constructed as a line head for performing line writing on each of said image carriers.

37. The color image formation system according to claim 23, wherein around each image carrier in said image carrier cartridge there is no cleaning means for collecting the remnants of the developing agent in an independent manner.

38. The color image formation system according to claim 23, wherein when said image carrier cartridge is detached from said system proper, said image carrier cartridge is spaced away from said intermediate transfer belt.

39. The color image formation system according to claim 23, wherein a diameter of a driving roller is set to give a speed difference of 1 to 5% between a delivery speed of said intermediate transfer belt and a peripheral speed of said plurality of image carriers.

40. A tandem system for forming color images comprising:

at least two image formation stations, each image formation station comprising:

an image carrier;

a charging means;

a developing means; and a transfer means;

wherein said charging means, said developing means and said transfer means are disposed around said image carrier, wherein a color image is formed by passing a transfer medium through each station, wherein a plurality of image carriers are mounted on an image carrier cartridge detachable from and attachable to a system proper while they are mutually positioned, wherein a recording medium carrier belt is provided contiguously to said plurality of image carriers, and wherein said developing means is provided in such a way as to be detachable from or attachable to each image carrier mounted on said image carrier cartridge.

41. The color image formation system according to claim 40, wherein a developing agent in said developing means comprises a mono-component developing agent.

42. The color image formation system according to claim 40 or 41, wherein said plurality of image carriers are integrally mounted on said image carrier cartridge while they are mutually positioned, and a plurality of developing cartridges, each forming developing means for each of said plurality of image carriers, are disposed with respect to said image carrier cartridge in a separately detachable/attachable manner.

43. The color image formation system according to claim 40 or 41, wherein said plurality of image carriers are integrally mounted on said image carrier cartridge while they are mutually positioned, and a developing cartridge forming developing means for each of said plurality of image carriers, wherein all developing means for said plurality of image carriers are integrated into one piece, is disposed with respect to said image carrier cartridge in a detachable/attachable manner.

44. The color image formation system according to claim 40 or 41, wherein said plurality of image carriers are integrally mounted on said image carrier cartridge, and two developing cartridges are disposed with respect to said image carrier cartridge in a separately detachable/attachable manner, and wherein in one of said two developing cartridges there is developing means for one specific image carrier in said plurality of image carriers, and in another of said two developing cartridges all developing means for the remaining image carriers are integrated together.

45. The color image formation system according to claim 40, wherein driving forces for said plurality of image carriers, the developing means for each of said plurality of image carriers and said recording medium carrier belt are received at one site on said system proper and said driving force for said plurality of image carrier is divided in said image carrier cartridge and then transmitted to said developing means.

46. The color image formation system according to claim 45, wherein mutual transmission of driving force between said plurality of image carriers takes place via a gear train, a belt or a chain.

47. The color image formation system according to claim 40, wherein driving forces for said plurality of image carriers and said recording medium carrier belt are received from one driving source of said system proper and driving force for developing means for each of said plurality of image carriers is received from another driving source of said system proper.

48. The color image formation system according to claim 40, wherein there is a speed difference between the peripheral speed of said plurality of image carriers and the delivery speed of said recording medium carrier belt.

49. The color image formation system according to claim 48, further comprising a mechanism for adjusting a transfer position at which said recording medium carrier belt comes into contact with said plurality of image carriers, thereby adjusting color misalignments.

50. The color image formation system according to claim 40, further comprising a mechanism for adjusting a position of at least one image carrier in said image carrier cartridge relative to other image carriers therein, thereby adjusting color misalignments.

51. The color image formation system according to claim 40, further comprising a write means which is located and mounted at a position corresponding to each of said plurality of image carriers in said image carrier cartridge.

52. The color image formation system according to claim 51, further comprising a mechanism for adjusting a position of at least one write means mounted on said image carrier cartridge, thereby adjusting color misalignments.

53. The color image formation system according to claim 51 or 52, wherein said write means is constructed as a line head for performing line writing on each of said image carriers.

54. The color image formation system according to claim 40, wherein around each image carrier in said image carrier cartridge there is no cleaning means for collecting the remnants of the developing agent in an independent manner.

55. A system for forming color images comprising:

at least two image formation stations, each image formation station comprising:

an image carrier;

a charging device;

a developing device; and a transfer device;

wherein said charging device, said developing device and said transfer device are disposed around said image carrier, wherein a color image is formed by passing a transfer medium through each station, wherein a plurality of image carriers are mounted on an image carrier cartridge detachable from and attachable to said system while they are mutually positioned, and wherein said developing device is provided in such a way as to be detachable from or attachable to each image carrier mounted on said image carrier cartridge.

56. A system for forming color images comprising:

at least two image formation stations, each image formation station comprising:

an image carrier;

a charging device;

a write device;

a developing device; and a transfer device, wherein said charging device, said write device, said developing device and said transfer device are disposed around said image carrier, wherein a color image is formed by passing a transfer medium through each station, wherein a plurality of image carriers are mounted on an image carrier cartridge detachable from and attachable to said system while they are mutually positioned, wherein said developing device is provided in such a way as to be detachable from or attachable to each image carrier mounted on said image carrier cartridge, and wherein said write device is located and mounted at a position corresponding to each of said plurality of image carriers in said image carrier cartridge.

57. A system for forming color images comprising:

at least two image formation stations, each image formation station comprising:

an image carrier;

a charging device;

a developing device; and a transfer device, wherein said charging device, said developing device, and said transfer device are disposed around said image carrier, wherein a color image is formed by passing a transfer medium through each station, wherein a plurality of image carriers are mounted on an image carrier cartridge detachable from and attachable to said system while they are mutually positioned, wherein an intermediate transfer belt is provided contiguously to said plurality of image carriers, and wherein said developing device is provided in such a way as to be detachable from or attachable to each image carrier mounted on said image carrier cartridge.

58. A system for forming color images comprising:

at least two image formation stations, each image formation station comprising:

an image carrier;

a charging device;

a developing device; and a transfer device;

wherein said charging device, said developing device and said transfer device are disposed around said image carrier, wherein a color image is formed by passing a transfer medium through each station, wherein a plurality of image carriers are mounted on an image carrier cartridge detachable from and attachable to said system while they are mutually positioned, wherein a recording medium carrier belt is provided contiguously to said plurality of image carriers, and wherein said developing device is provided in such a way as to be detachable from or attachable to each image carrier mounted on said image carrier cartridge.

* * * * *